US010486047B2

(12) United States Patent
Coffman

(10) Patent No.: US 10,486,047 B2
(45) **Date of Patent: *Nov. 26, 2019**

(54) ENHANCED GOLF SIMULATION SYSTEM

(71) Applicant: VG Buyer, LLC, Greenwich, CT (US)

(72) Inventor: Sean Coffman, Beresford, SD (US)

(73) Assignee: Full-Swing Golf, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/941,675

(22) Filed: Mar. 30, 2018

(65) Prior Publication Data

US 2018/0221747 A1 Aug. 9, 2018

Related U.S. Application Data

(63) Continuation-in-part of application No. 15/228,284, filed on Aug. 4, 2016, now Pat. No. 9,987,543, which is a continuation-in-part of application No. 15/191,053, filed on Jun. 23, 2016, now Pat. No. 10,137,351, which is a continuation-in-part of application No. 14/718,344, filed on May 21, 2015, now Pat. No. 9,993,713, which is a (Continued)

(51) Int. Cl.

| | |
|---|---|
| ***A63B 69/36*** | (2006.01) |
| ***A63B 67/02*** | (2006.01) |
| *A63B 71/06* | (2006.01) |
| *A63B 24/00* | (2006.01) |

(52) U.S. Cl.

CPC ..... *A63B 69/3661* (2013.01); *A63B 67/02* (2013.01); *A63B 71/0622* (2013.01); *A63B 2024/0034* (2013.01); *A63B 2067/025* (2013.01); *A63B 2225/093* (2013.01)

(58) Field of Classification Search

CPC ..... A63B 69/3661; A63B 67/02; A63B 2225/093; A63B 2024/0034; A63B 71/0622; A63B 2067/025

USPC ..... 473/150, 157–163, 171, 278, 279

See application file for complete search history.

(56) References Cited

U.S. PATENT DOCUMENTS 1,612,291 A 12/1926 Jackson
1,612,292 A 12/1926 Jackson (Continued)

OTHER PUBLICATIONS

Matihew Ralphs; "Re-Configurable Putting Green"; Thesis; 64 pages; Utah State University, Undergraduate Honors Theses, Paper 110, Logan, Utah; http://digitalcommons_usu_edu/honors/110.

*Primary Examiner* — Nini F Legesse

(74) *Attorney, Agent, or Firm* — Veros Legal Solutions, LLP

(57) ABSTRACT

A green simulation apparatus having a configurable upper surface with a changeable contour may comprise a covering forming the upper surface and a plurality of vertically movable positioning elements forming an array on which the covering rests. Each positioning element has a head, a bottom element, and a support frame positioned between the head and bottom element. The support frame includes at least a first frame member and a second frame member each having opposite ends and being pivotally connected together at a cross-over point spaced from opposite ends of the frame members in a scissor-like configuration such that convergence of the frame members raises the head and divergence of the frame members lowers the head.

12 Claims, 60 Drawing Sheets

Related U.S. Application Data continuation-in-part of application No. 14/644,929, filed on Mar. 11, 2015, now Pat. No. 9,987,542, which is a continuation-in-part of application No. 14/302,767, filed on Jun. 12, 2014, now Pat. No. 9,308,429, which is a continuation-in-part of application No. 14/093,963, filed on Dec. 2, 2013, now Pat. No. 9,028,335, which is a continuation of application No. 13/917,896, filed on Jun. 14, 2013, now Pat. No. 8,616,988.

(60) Provisional application No. 62/106,027, filed on Jan. 21, 2015.

(56) References Cited

U.S. PATENT DOCUMENTS

| | | | | |
|---|---|---|---|---|
| 2,678,823 | A | 5/1954 | Hugman | |
| 3,170,694 | A | 2/1965 | Dolce | |
| 3,595,581 | A | 7/1971 | Anderson et al. | |
| 3,601,406 | A | 8/1971 | Giusti | |
| 3,658,343 | A | 4/1972 | Rogers | |
| 3,892,412 | A | 7/1975 | Koo | |
| 4,009,881 | A | 3/1977 | Potter | |
| 4,160,942 | A | 7/1979 | Lynch et al. | |
| 4,222,568 | A | 9/1980 | Russo | |
| 4,611,809 | A | 9/1986 | Gettelfinger | |
| 4,749,169 | A | 6/1988 | Pickles | |
| 4,790,538 | A | 12/1988 | Gettelfinger | |
| 4,943,034 | A | 7/1990 | Wagnon | |
| 5,031,916 | A | 7/1991 | Boswell | |
| 5,056,791 | A | 10/1991 | Poillon et al. | |
| 5,087,045 | A | 2/1992 | Kim | |
| 5,094,569 | A | 3/1992 | Fleming | |
| 5,100,145 | A | 3/1992 | Kim | |
| 5,172,914 | A | 12/1992 | Primerano | |
| 5,221,082 | A | 6/1993 | Curshod | |
| 5,333,874 | A | 8/1994 | Floyd et al. | |
| 5,390,926 | A | 2/1995 | Hanson et al. | |
| 5,390,927 | A | 2/1995 | Angelos | |
| 5,657,964 | A | 8/1997 | Yoshida | |
| 5,855,522 | A | 1/1999 | Bevan | |
| 5,950,990 | A | 9/1999 | Castillo | |
| 6,056,645 | A | 5/2000 | Servatius | |
| 6,179,721 | B1 | 1/2001 | Bevan | |
| 6,338,682 | B1 | 1/2002 | Torchia et al. | |
| 6,695,289 | B1 | 2/2004 | Mickael | |
| 6,746,338 | B1 | 6/2004 | Keaton | |
| 6,769,993 | B1 | 8/2004 | Lasalandra | |
| 6,805,638 | B2 | 10/2004 | Chang | |
| 6,913,541 | B2 | 7/2005 | Chen | |
| 6,964,615 | B2 | 11/2005 | Lee | |
| 8,616,988 | B1 | 12/2013 | Coffman | |
| 9,028,335 | B1 | 5/2015 | Coffman | |
| 9,308,429 | B1 | 4/2016 | Coffman | |
| 9,731,183 | B2 | 8/2017 | Coffman | |
| 9,987,543 | B2 * | 6/2018 | Coffman | A63B 69/3661 |
| 10,137,351 | B2 * | 11/2018 | Coffman | A63B 69/3661 |
| 2001/0003103 | A1 | 6/2001 | Bevan | |
| 2005/0153788 | A1 | 7/2005 | Saldana | |
| 2011/0192069 | A1 | 8/2011 | Potterfield et al. | |
| 2011/0192096 | A1 * | 8/2011 | Koberinski | E04B 5/43 52/126.6 |
| 2014/0073445 | A1 | 3/2014 | Flammer | |
| 2015/0231479 | A1 | 8/2015 | Coffman | |

* cited by examiner

ENHANCED GOLF SIMULATION SYSTEM

REFERENCE TO RELATED APPLICATION

This application is a continuation-in-part of U.S. patent application Ser. No. 15/228,284, filed Aug. 4, 2016, which is a continuation-in-part of U.S. patent application Ser. No. 15/191,053, filed Jun. 23, 2016, which is a continuation-in-part of U.S. patent application Ser. No. 14/718,344, filed May 21, 2015, which claims the priority of U.S. Provisional Patent Application No. 62/106,027, filed Jan. 21, 2015, and which is a continuation-in-part of U.S. patent application Ser. No. 14/644,929, filed Mar. 11, 2015, which is a continuation-in-part of U.S. patent application Ser. No. 14/302,767, filed Jun. 12, 2014, which was issued as U.S. Pat. No. 9,308,429 on Apr. 12, 2016, and which is a continuation-in-part of U.S. patent application Ser. No. 14/093,963, filed Dec. 2, 2013, which was issued as U.S. Pat. No. 9,028,335 on May 12, 2015, and which is a continuation of U.S. patent application Ser. No. 13/917,896, filed Jun. 14, 2013, which was issued as U.S. Pat. No. 8,616,988, all of which are hereby incorporated by reference in their entireties.

BACKGROUND

Field

The present disclosure relates to golf simulation apparatus and more particularly pertains to a new golf simulation system for providing a more realistic and challenging contouring of the surface of a simulated green surface.

SUMMARY

In one aspect, the present disclosure relates to an apparatus having a configurable upper surface with a changeable contour. The apparatus may comprise a plurality of movable surface elements positioned in a close array and each forming portions of the upper surface. Each of the surface elements has a top surface forming a respective portion of the upper surface, and each of the surfaces elements may be elongated with a longitudinal axis. The top surface of a said surface element has a perimeter and the perimeters of adjacent surface elements may define a gap therebetween. The perimeters may be configured such that the gap between the perimeters is substantially uniform. The surface elements may be movable in the longitudinal direction to adjust the position of the top surface. The surface elements may have a neutral position, and the top surfaces of surface elements in the neutral position may define a reference plane. The surface element may have a plurality of raised positions in which the top surface is located vertically higher than the reference plane.

In another aspect, the present disclosure relates to a golf simulation system may comprise a screen with a projection surface, a ball path analysis device configured to predict a path of a ball struck by a club of a user, and a green simulation apparatus having a configurable upper surface with a changeable contour. The apparatus may comprise a plurality of movable surface elements positioned in a close array and each forming portions of the upper surface. Each of the surface elements has a top surface forming a respective portion of the upper surface, and each of the surfaces elements may be elongated with a longitudinal axis. The top surface of a said surface element has a perimeter and the perimeters of adjacent surface elements may define a gap therebetween. The perimeters may be configured such that the gap between the perimeters is substantially uniform. The surface elements may be movable in the longitudinal direction to adjust the position of the top surface. The surface elements may have a neutral position, and the top surfaces of surface elements in the neutral position may define a reference plane. The surface element may have a plurality of raised positions in which the top surface is located vertically higher than the reference plane.

In yet another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The plurality of positioning elements may include active positioning elements and passive positioning elements, and the active positioning elements may be associated with a said movement actuator and the passive positioning elements may not be associated with a said movement actuator.

In still another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The array of positioning elements may include a central region and at least one peripheral region positioned peripheral to the central region, with a density of positioning elements in the reference plane being greater in the central region than in the at least one peripheral region.

In still yet another aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, with the plurality of positioning elements being positioned in an array extending in a reference plane and the positioning elements being movable along axes extending substantially perpendicular to the reference plane. The positioning elements may be elongated with a longitudinal axis. The support assembly may also comprise a movement actuator configured to move at least one of the positioning elements independently of other positioning elements in the array. The covering support assembly may comprise a plurality of modules each including at least one positioning element, with the modules being removably connected to each other to form the array of positioning elements.

In another embodiment, the disclosure relates to a green simulation apparatus having a configurable upper surface with a changeable contour, and may comprise a covering forming the upper surface and a covering support assembly configured to support the covering. The support assembly may comprise a plurality of movable positioning elements having the covering resting thereon, and the plurality of positioning elements may be positioned in an array extending in a reference plane, the positioning elements being movable along axes extending substantially perpendicular to the reference plane. The positioning elements may be elongated with a longitudinal axis. The support assembly may include a movement actuator configured to move at least one of the positioning elements independently of other positioning elements in the array. At least one of the positioning elements may comprise a pin and at least two heads supported on the pin.

In still another embodiment, the disclosure relates to a green simulation apparatus having a configurable upper surface with a changeable contour, and may comprise a covering forming the upper surface and a covering support assembly configured to support the covering. The support assembly may comprise a plurality of movable positioning elements having the covering resting thereon, with the plurality of positioning elements being positioned in an array extending in a reference plane. The positioning elements may be movable along axes extending substantially perpendicular to the reference plane, the positioning elements being elongated with a longitudinal axis. The support assembly may comprise a movement actuator configured to move at least one of the positioning elements independently of other positioning elements in the array. At least one of the positioning elements may comprise a head and a support frame supporting the head in manner permitting upward and downward movement of the head. The support frame may include at least two frame members connected together in a scissors arrangement.

In another embodiment, the disclosure relates to a green simulation apparatus having a configurable upper surface with a changeable contour, and the apparatus may comprise a covering forming the upper surface and a covering support assembly configured to support the covering. The support assembly may comprise a plurality of movable positioning elements having the covering resting thereon. The plurality of positioning elements may be positioned in an array extending in a reference plane, and the positioning elements may be movable along axes extending obliquely to the reference plane. The positioning elements may be elongated with a longitudinal axis. The support assembly may comprise a movement actuator configured to move at least one of the positioning elements independently of other positioning elements in the array.

In a further aspect, the disclosure relates to a green simulation apparatus having a configurable upper surface with a changeable contour. The apparatus may comprise a covering forming the upper surface and a covering support assembly configured to support the covering. The support assembly may comprise a plurality of movable positioning elements having the covering resting thereon, and the plurality of positioning elements may be positioned in an array extending in a reference plane. The support assembly may comprise a movement actuator configured to move at least one of the positioning elements independently of other positioning elements in the array. At least one of the positioning elements may comprise a head and a support frame supporting the head in manner movement of the head movable along an axis extending substantially perpendicular to the reference plane. The support frame may include at least two frame members pivotally connected together such that convergence of the frame members produces movement of the head in a first direction with respect to the reference plane and divergence of the frame members produces movement of the head in a second direction with respect to the reference plane.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
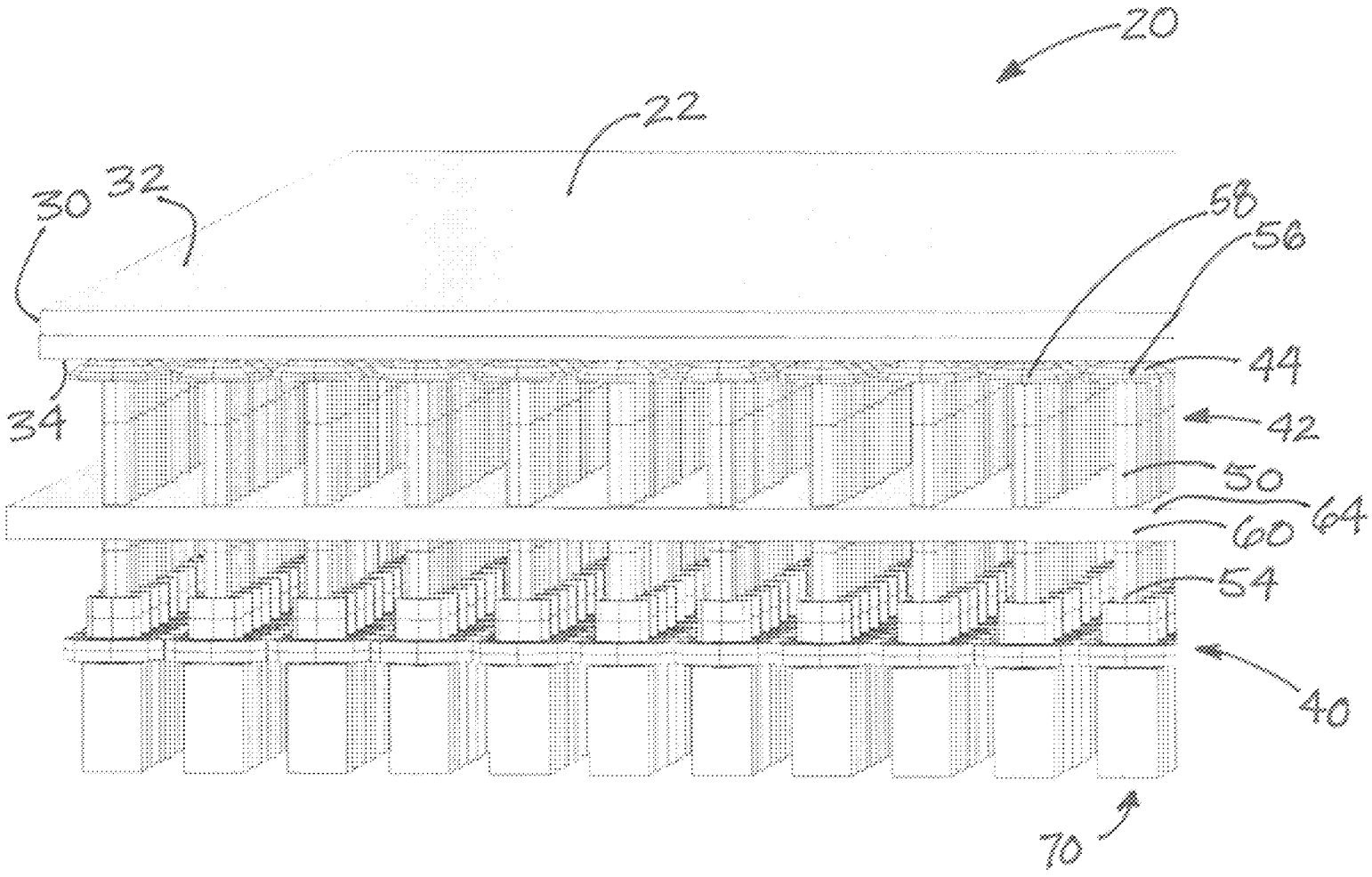
FIG. 1 is a schematic perspective view of the green simulation apparatus of a new golf simulation system according to the present disclosure, with the covering in a base condition and the support assembly in a neutral position.
Figure 63:
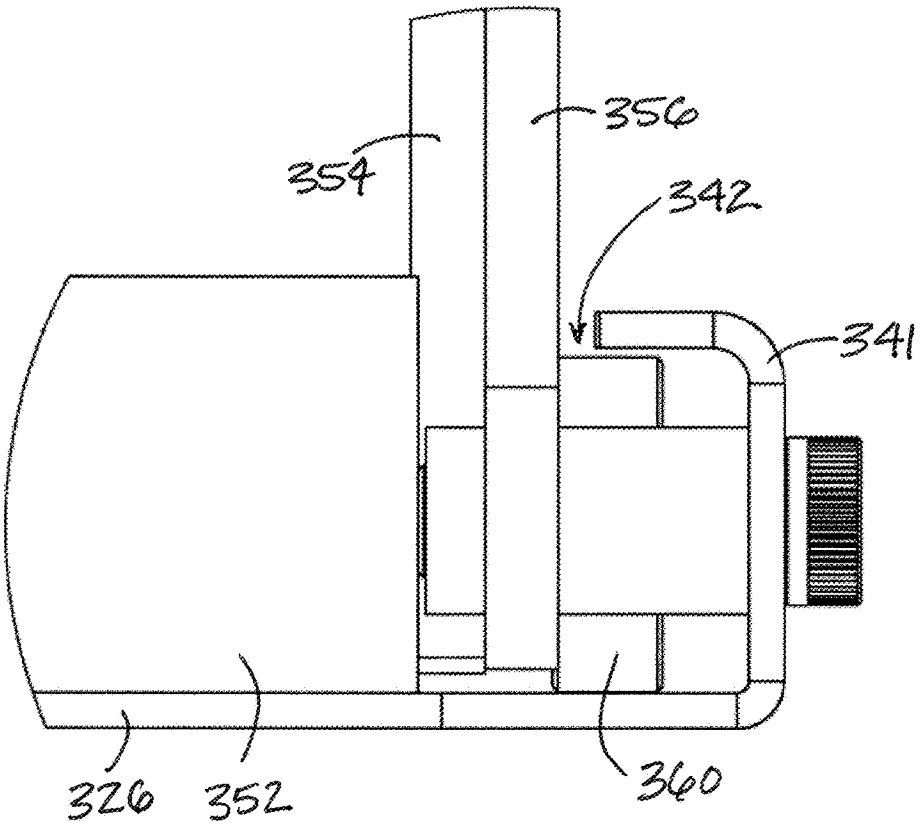
FIG. 63 is a schematic enlarged view of the portion of FIG. 61 encompassed by the circle labeled "63."

With reference now to the drawings, and in particular to FIGS. 1 through 63 thereof, a new golf simulation system embodying the principles and concepts of the disclosed subject matter will be described.

Applicant has recognized the value of devices that provide a virtual experience that is close to the actual experience. One example is a golf simulation system that allows the user to practice his or her golf swing in a controlled environment that provides a screen on which an image of a golf course fairway is projected for the purpose of the user lining up a shot and taking the shot, with the system providing some indication of the movement of the ball after the swing has been taken and the ball has been struck. Typically these simulators utilize a path of simulated turf large enough only for the user to stand and address the ball in a normal golf stance.

Applicant has also recognized that the value of such conventional simulators for short game practice, especially putting, is very limited. Typically, putting practice has been conducted on the floor of a room or platform which presents a flat, level, and not very realistic environment for practice. Golf course greens are typically not completely flat and level, particularly if the course is intended to be challenging to the player. Applicant has developed a system that may be used to realistically simulate golf greens with a variety of changeable contours to provide a more realistic and challenging practice experience, and which may be used with more conventional golf simulators which only attempt to simulate the long game.

Broadly, the aspects of the disclosure may be used to contour a surface such as a surface located on a support or platform in a manner that is easily and quickly changeable from one contour to another contour. The contouring may be produced and reproduced from contour data that has been generated from actual landscapes or may be created with no real antecedent landscape basis for the contour.

In one aspect of the development, a golf simulation system 10 comprises a screen 12 that may have a projection surface 14 onto which various golf course representations may be projected. The projection surface 14 of the screen may be substantially vertically oriented, and may be curved to extend about the user to some degree. The system 10 may also include a ball path analysis device 16 that uses various parameters such as club path, club speed, ball spin, etc. to determine a path for movement of the image of a simulated ball on the projection screen. The particular technology used to determine ball path and other aspects of the long game is not critical to the system and is known to those skilled in the art and will not be further discussed here.

Another aspect of the disclosure is a green simulation apparatus 20 that may be used with the aforementioned elements of the system 10. Significantly, the green simulation apparatus 20 has a configurable upper surface 22 that is moveable to provide a changeable contour. The configurable upper surface 22 may have a periphery 24, and the periphery may have opposite lateral sides 26, 27 and opposite ends 28, 29. In some embodiments, the periphery 24 of the upper surface may be surrounded by a frame having a stationary upper surface.

In general, the apparatus may include a covering 30 that may extend between the sides 26, 27 and ends 28, 29 and a covering support assembly 40 that supports the cover and also causes the contouring of the covering. The covering may be continuous between the sides and ends, or may comprise pieces that are mounted on one or more of the movable positioning elements 42 of the support assembly 40.

The covering 30 may form the upper surface 22 of the apparatus 20. The covering 30 may have a base condition (see FIG. 1) in which the upper surface 22 has a substantially planar or flat configuration and may also be level, which may represent a flat and level green surface. The covering may also have a contoured condition (see FIG. 2) in which the upper surface has a contoured configuration including portions of the surface that slope with peaks or ridges and valleys to simulate a green surface without an entirely flat and level orientation.

The covering 30 may have an upwardly-oriented top face 32 which forms the upper surface 22. The top face may be substantially continuous in character between the sides 26, 27 and ends 28, 29 of the periphery. The top face may also be configured in a manner that simulates the surface of a golf green, such as by the inclusion of a simulated turf material, although this is not critical to the system 10. The covering 30 may also have a bottom face positioned opposite of the top face and oriented downwardly.

Significantly, the covering 30 may be flexible, and may also be stretchable. The material forming the covering may be relatively incapable of supporting the weight of a user absent the covering support assembly described below. Materials having elastomeric properties may be highly suitable.

The covering support assembly 40 may support the covering in the various conditions, such as the base condition and the contoured condition. As the covering may not have any natural shape, or only a flat shape, the support assembly may form contours in the upper surface of the covering by varying the vertical level of support provided to different portions of the covering.

Figure 3:
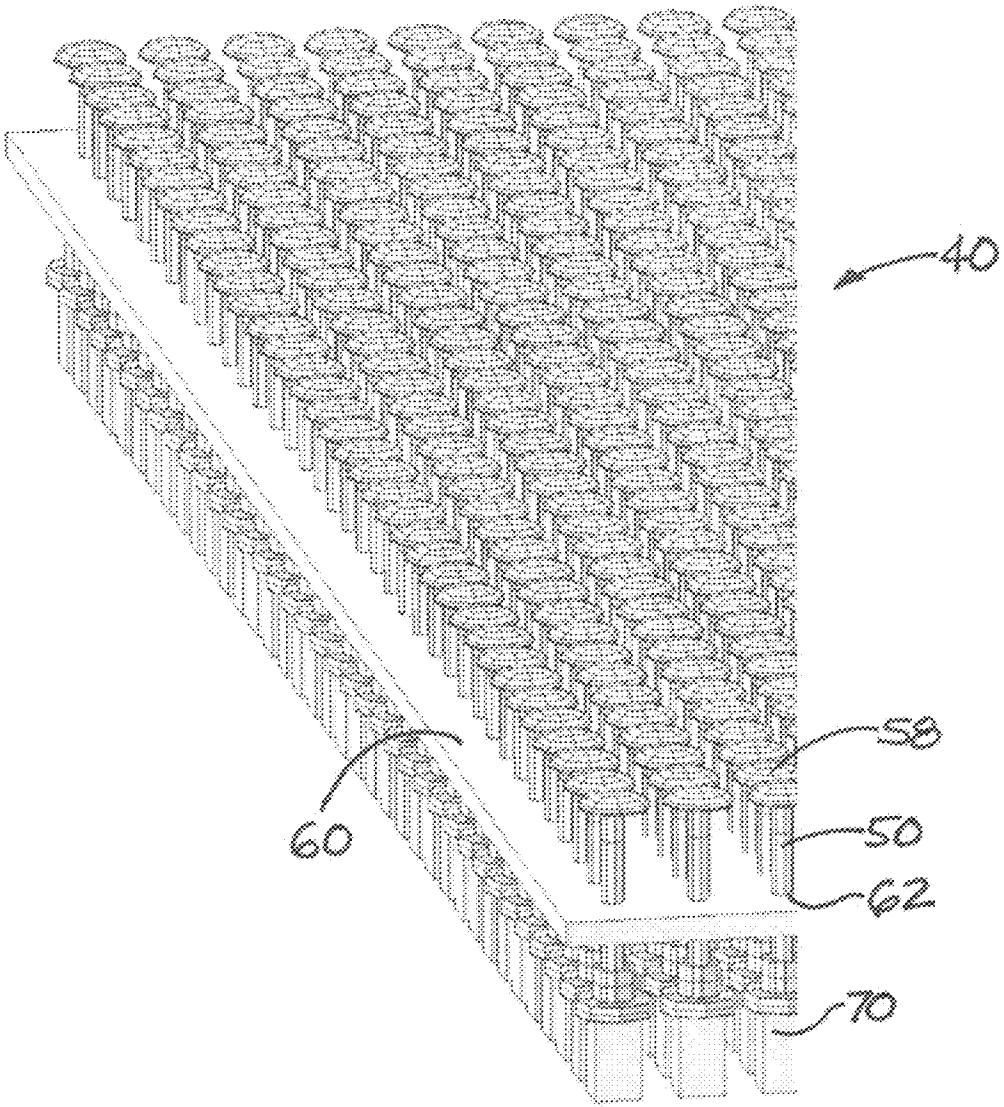
FIG. 3 is a schematic perspective view of the support assembly with the covering removed to show detail of the positioning elements, the guide and the movement actuators in the neutral position.
Figure 4:
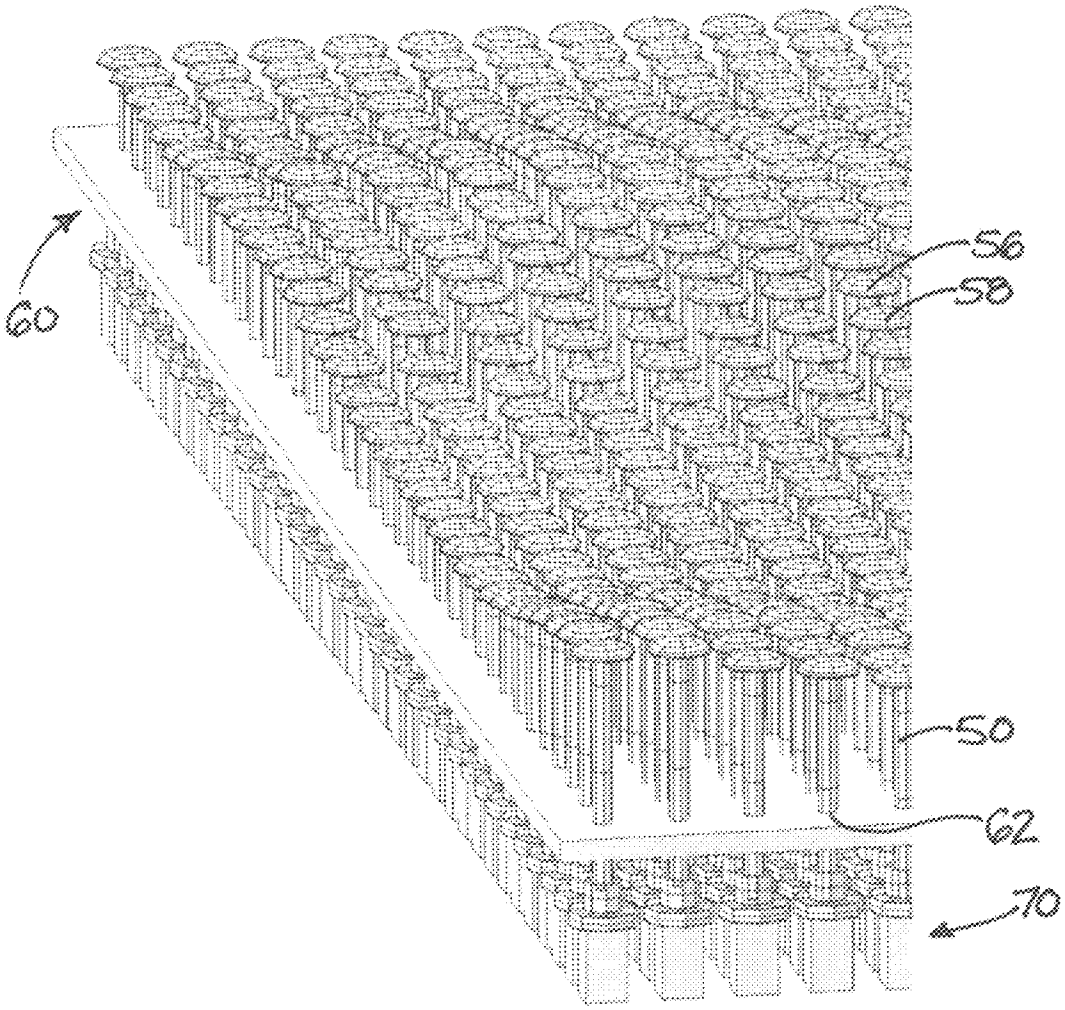
FIG. 4 is a schematic perspective view of the support assembly with the covering removed to show detail of the positioning elements, the guide and the movement actuators in the raised position.
Figure 7:
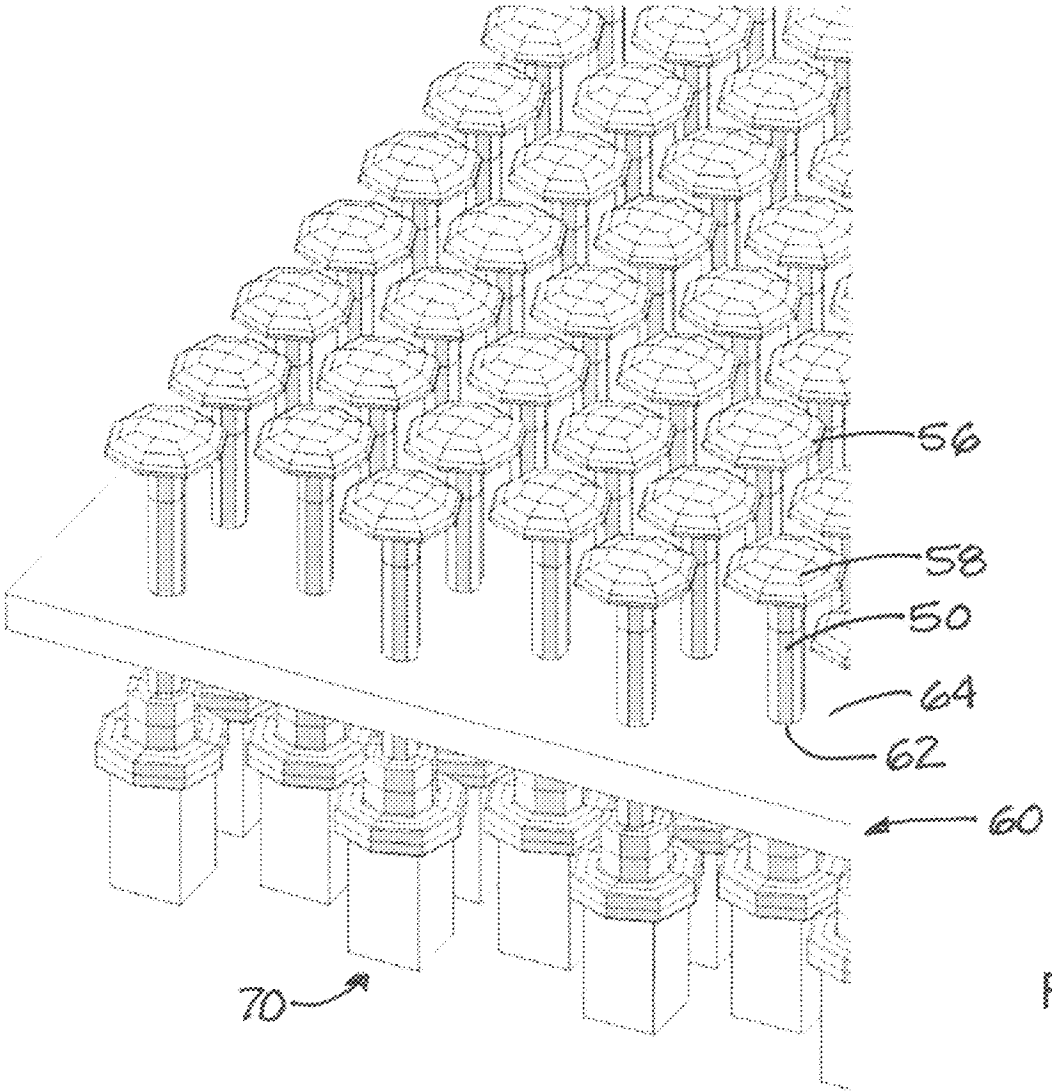
FIG. 7 is a schematic perspective view of the support assembly with the covering removed to show detail of the support assembly with the positioning elements in an optional arrangement.
Figure 8:
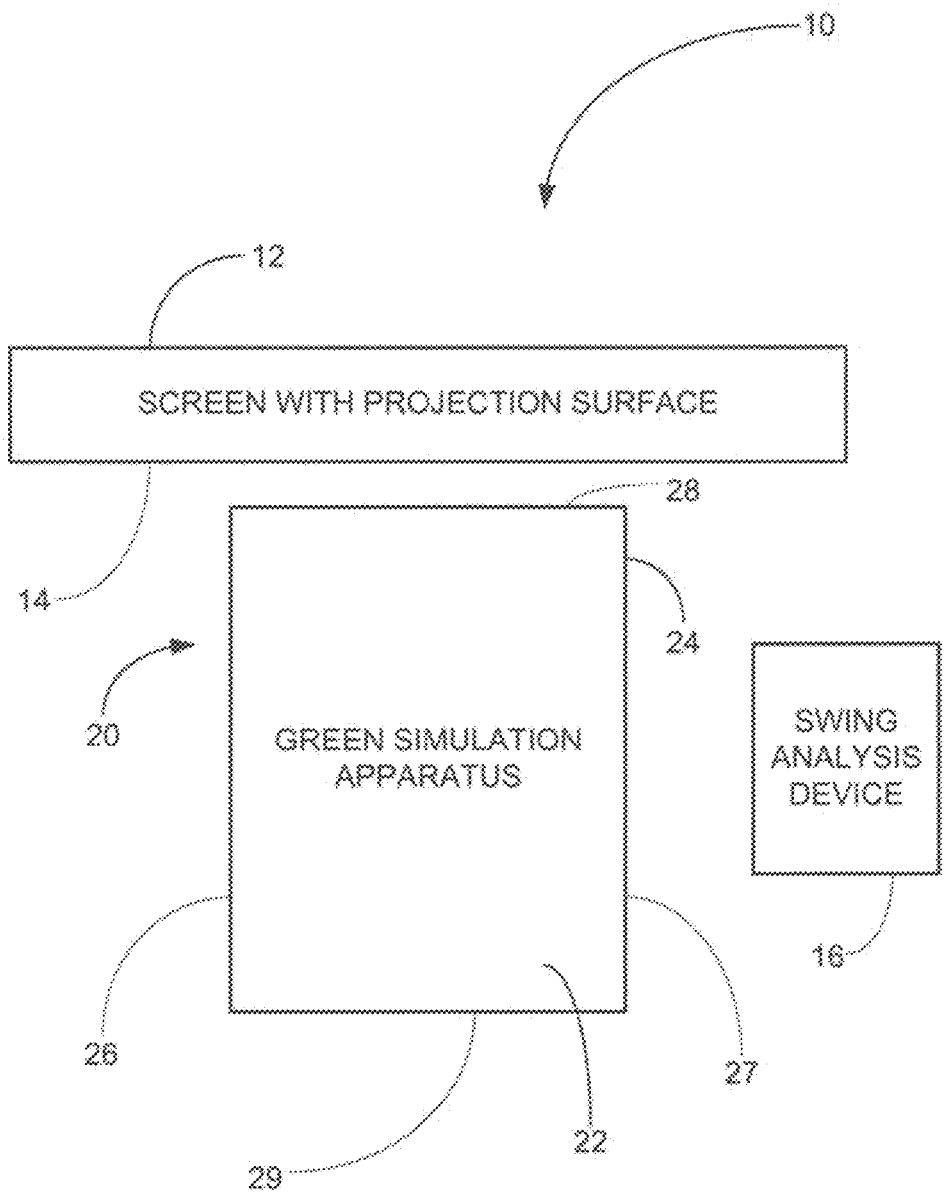
FIG. 8 is a schematic diagram of the golf simulation system, according to an illustrative embodiment.

The support assembly 40 may comprise a plurality of movable positioning elements 42 that have the covering resting thereon such that the elements may control the vertical position of the portion of the covering that is located above the element. The plurality of positioning elements may be positioned in an array, and the array may have each of the positioning elements 42 positioned in a first line and a second line. In some embodiments, the first and second lines may be substantially perpendicular to each other (see FIG. 3), and in other embodiments the first and second lines may be at an oblique angle with respect to each other (see FIG. 7).

Figure 5:
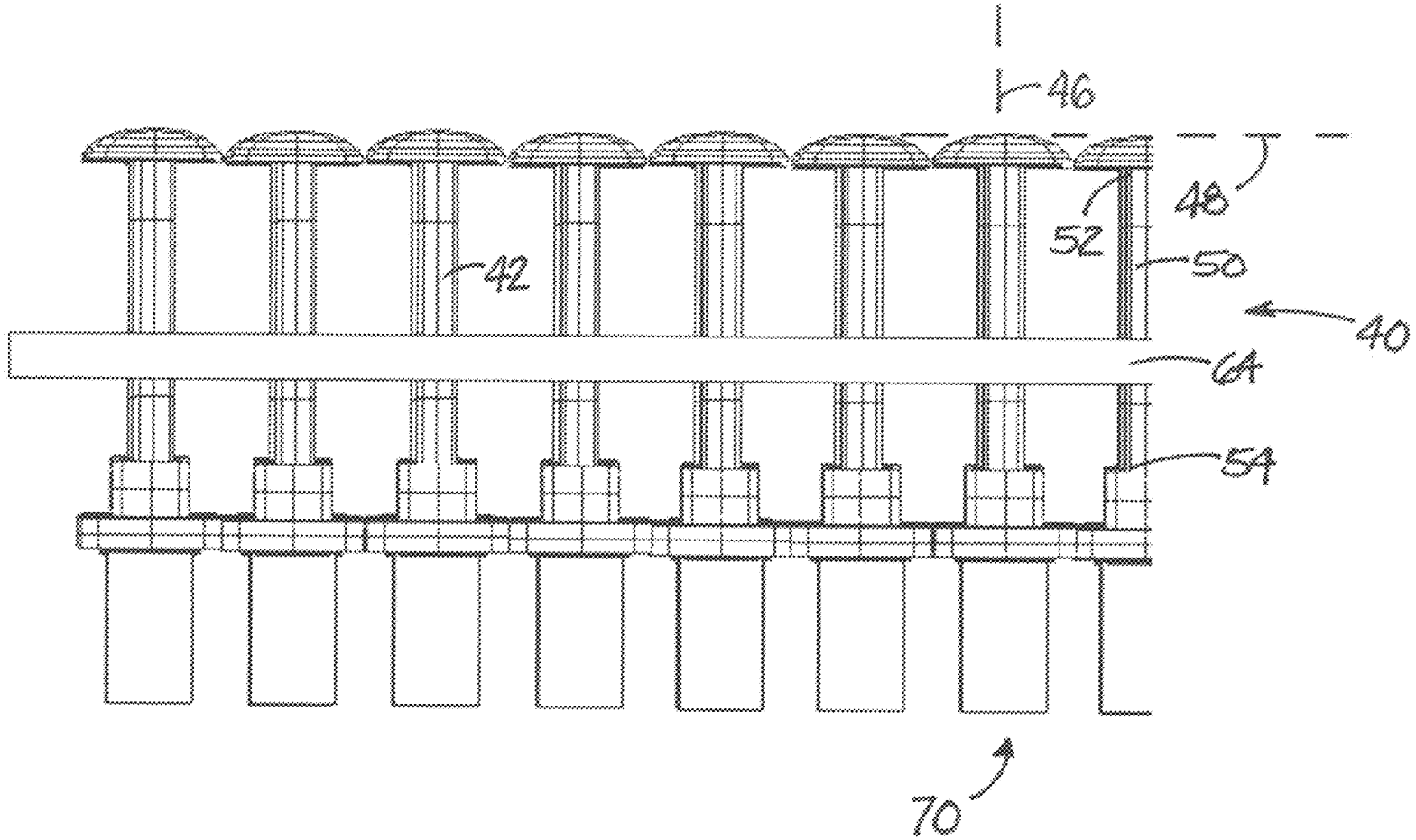
FIG. 5 is a schematic side view of the support assembly with the covering removed to show detail of the support assembly in the neutral position.

The positioning elements 42 may each have an upper end 44 for contacting a portion of the covering for moving the covering in a generally upward and downward direction. The positioning elements 42 may be substantially vertically movable to adjust the position of the upper end and thereby the position of the portion of the covering 30 being contacted by the upper end 44. The positioning elements 42 may be elongated in shape with a longitudinal axis 46, which may be substantially vertically oriented. The upper ends 44 may be moveable with respect to a reference plane, represented by reference number 48 in FIG. 5. The reference plane 48 may be defined by the upper ends 44 of the positioning elements when those elements are in a neutral position (see FIG. 5). The neutral position may be the lowermost positioning of the vertical travel of the positioning elements, but this is not required. The base condition of the covering 30 may generally correspond with the positioning elements 42 being in the neutral position. The positioning elements 42 may have a plurality of raised positions that are located vertically higher than the neutral position, and in some embodiments the positions of the elements, and the upper ends thereof, may be infinitely variable between the neutral position and a position of maximum vertical elevation of the upper end. The vertical positions of a positioning element may generally be independent of the other positioning elements. Suitable ranges of the distance of vertical movement may vary from 0 inches to approximately 24 inches, although greater or lesser ranges may be utilized, including ranges of 0 inches to 48 inches, 72 inches or even more. In some embodiments, a range of movement of 0 inches to approximately 12 inches may be employed.

In the illustrative embodiments, each positioning element 42 may comprise a pin 50 which has a top end 52 and a bottom end 54, and the pin may have a length between the top and bottom ends. The pin may have a maximum width which may be measured perpendicular to the longitudinal axis 46 of the element 42. In some of the most preferred embodiments, the outer surface of the pin may be substantially cylindrical in shape, although cross sectional shapes other than circular may be employed, particularly where resistance to rotation of the pin is desired.

Each positioning element 42 may also comprise a head 56 that is mounted on the pin 50. The head may be located on the top end 52 of the pin, and the head may define at least a portion of the upper end 44 of the positioning element. In some of the most preferred embodiments, the head 56 of a positioning element is unconnected to the heads of the adjacent positioning elements such that the positioning elements are able to move substantially independently of each other, although attachment to the covering (if employed) may produce some degree of constraint. In some of the most preferred embodiments, the head may have a substantially circular perimeter shape when viewed from above, any rounded shape may be employed, including oval shapes. Other perimeter shapes, including polygonal shapes when viewed from above may also be used.

The head 56 may have a top surface 58, and in some embodiments the top surface has a convex shape which may be advantageous, and may give the overall element a general mushroom-shape. The convexity of the top surface is not critical, as the top surface may also, for example, be substantially flat. The head 56 may have a maximum width which may be measured perpendicular to the longitudinal axis 46 of the element 42. The maximum width of the head may be uniform among all of the elements, although variation in dimension may be employed. The maximum width of the head may be greater than the maximum width of the pin such that the head is enlarged in width with respect to the pin, and presents a broader top surface than would the top end of the pin alone. The range of maximum widths for the heads may vary, and may range from approximately ¼ inch to approximately 6 inches which is believed to provide the greatest variability in the contour of the upper surface of the covering, although larger head sizes may be effectively employed as well.

In the array of positioning elements, the head 56 of one positioning element may be spaced from the head of an adjacent positioning element such that there is some separation of the heads, which may be advantageous but is not critical. A closest distance of the spacing between the adjacent heads may be about equal to or somewhat less than the maximum width of the head. The size of the maximum width of the head 56 and the spacing distance between the heads may be varied independently of each other to provide a desirable degree of adjustment in contour while still providing a suitable degree of support for the covering and a user standing on the covering. The spacing distance between heads may range from approximately 1/32 inch to approximately 12 inches, although spacings greater than these may be employed.

In some embodiments, the covering 30 may be fixed or attached to some or all of the positioning elements 42 to cause the portion of the covering above an element 42 to move with the movement of the element 42. The covering may be secured to the element 42, such as the top surface 58 of the head 56, in any suitable manner, such as by bonding (using, for example, an adhesive) or by mechanical fastening. Attachment of the covering to some of, or all of, the heads may constrain the movement of adjacent positioning elements to some degree as the covering may not be able to conform to substantial differences in vertical elevation between adjacent positioning elements. The relative flexibility and stretchability or elasticity of the material forming the covering may have an effect on the maximum difference in vertical elevation between adjacent elements 42. In some embodiments, the covering 30 may not be physically attached to some or all of the positioning elements, and the weight of the covering may be sufficient to keep the portion of the covering above an element 42 in close proximity to, if not contact with, the top surface 58 of the head 56.

The support assembly 40 may further include a guide 60 that is configured to guide the positioning elements 42 as the elements move. In some embodiments, the guide 60 has a guide aperture 62 for receiving each of the positioning elements. The positioning element 42 may be movable, and in some cases slidable, through the guide aperture 62. The guide aperture 62 may have a substantially vertical axis, and the aperture may be shaped and sized for a somewhat snug relationship with the pin to facilitate vertical movement without undue lateral movement. The guide 60 may have a plurality of the guide apertures, and the apertures may be substantially uniformly spaced from adjacent guide apertures formed in the guide. In the illustrative embodiments, the guide 60 may comprise at least one guide plate 64 with the guide apertures being formed in the plate 64. Other suitable configurations of the guide may be employed, such as, for example, multiple plates in a substantially parallel relationship, or a plurality of sleeves that each receive the pin of one of the elements.

The support assembly 40 may also comprise a movement actuator 70 that is configured to move at least one of the positioning elements 42. In some embodiments, one of the movement actuators 70 acts on each positioning element such that each positioning element is movable independently of other positioning elements. The movement actuator 70 may be positioned below the reference plane, and may be located below the guide 60. The movement actuator 70 may act on the bottom end 54 of the pin 50, or a bottom portion of the pin. The movement actuator 70 may be any suitable actuator that is capable of moving a pin vertically. Examples of suitable technology may employ pneumatics, hydraulics, magnetics, or mechanical action. Structures employing these technologies include, for example, piston and cylinder structures and linear actuators. The activation of the movement actuators may be controlled manually by a user, or may be controlled by a computerized system that controls the movement actuators automatically to produce a contouring that has been programmed into the system.

A golf hole or cup may be provided for the apparatus 20 in various ways. In some embodiments, the cup may be formed by a depression in the upper surface of the covering by dropping the position of the movable positioning elements at the desired location of the cup. In some embodiments, a hole may be formed in the covering (optionally with a cup extending downwardly therefrom) at a location that is relatively fixed on the upper surface, and the upper surface may thus be contoured around the hole and cup.

Using the disclosed green simulation apparatus, the user surface may be contoured in a manner that is able to produce an area of the upper surface that is raised to a vertical level that is relatively higher than areas of the upper surface that surround the raised area. This differentiates the apparatus of the disclosure from other apparatus that simply tilt the upper surface, or form a depressed "valley" between raised "ridges." While the disclosed apparatus is capable of forming these relatively simpler types of contours in the upper surface, it is not limited to them and is also capable of forming more complex contours such as the aforementioned raised areas of the upper surface surrounded depressed areas that can more accurately represent real world green contours. Further, the contouring of the upper surface may be controlled, through actuation of the movement actuators in an individual manner, by a computerized system that may replicate the contours of greens of actual golf courses.

Figure 10:
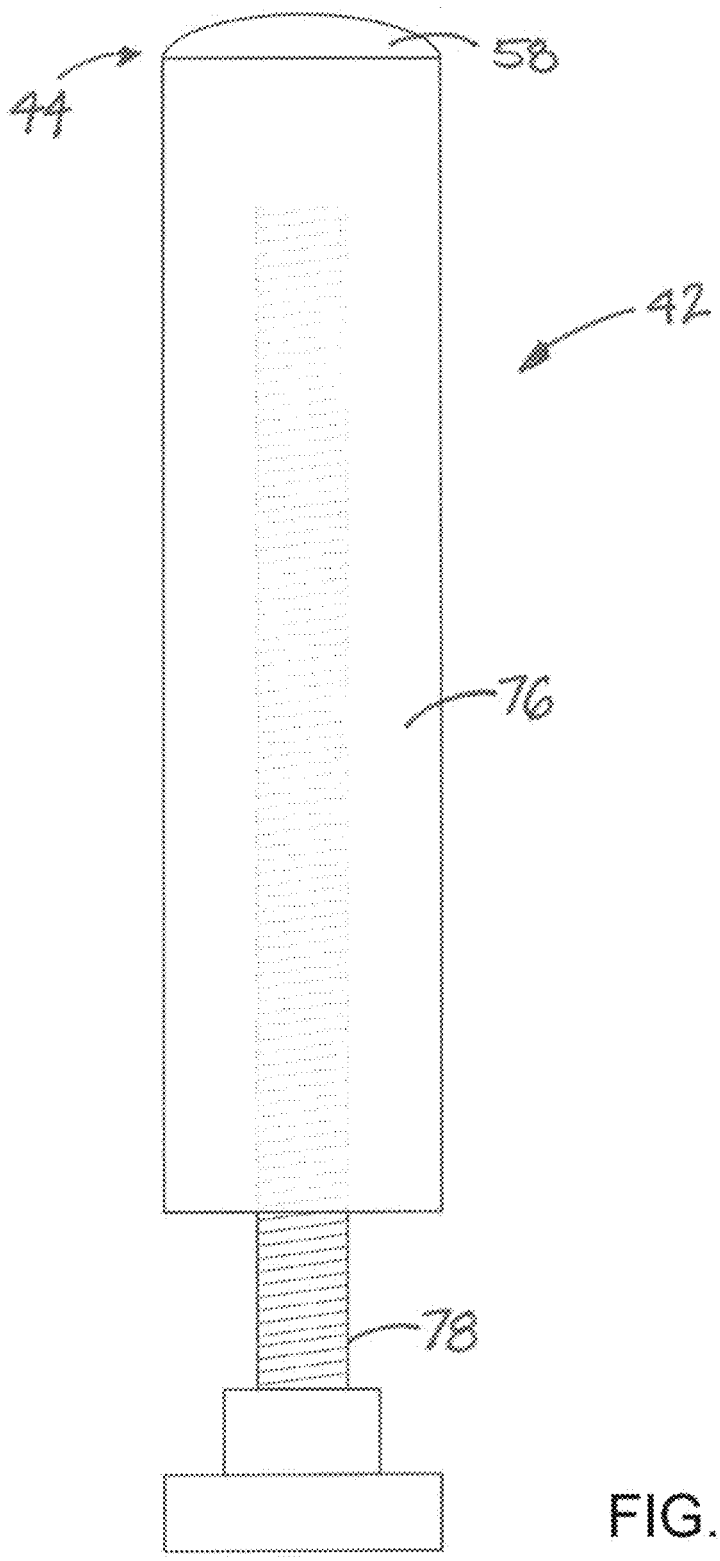
FIG. 10 is a schematic side view of one embodiment of a positioning element utilizing a cylinder and post arrangement, according to an illustrative embodiment.
Figure 11:
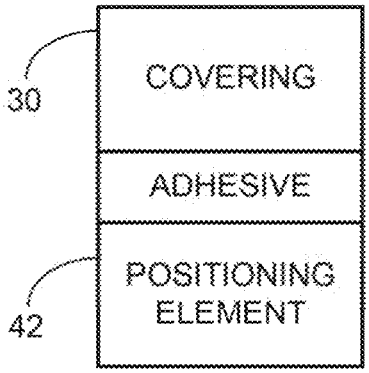
FIG. 11 is a schematic diagram of an illustrative relationship between the covering and one of the positioning elements.
Figure 12:
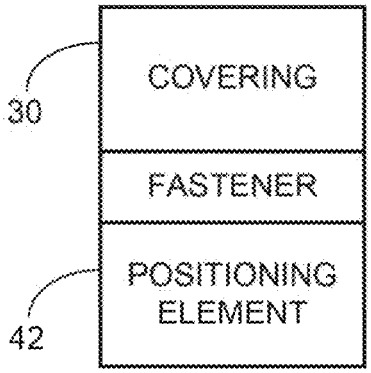
FIG. 12 is a schematic diagram of another illustrative relationship between the covering and one of the positioning elements.
Figure 13:
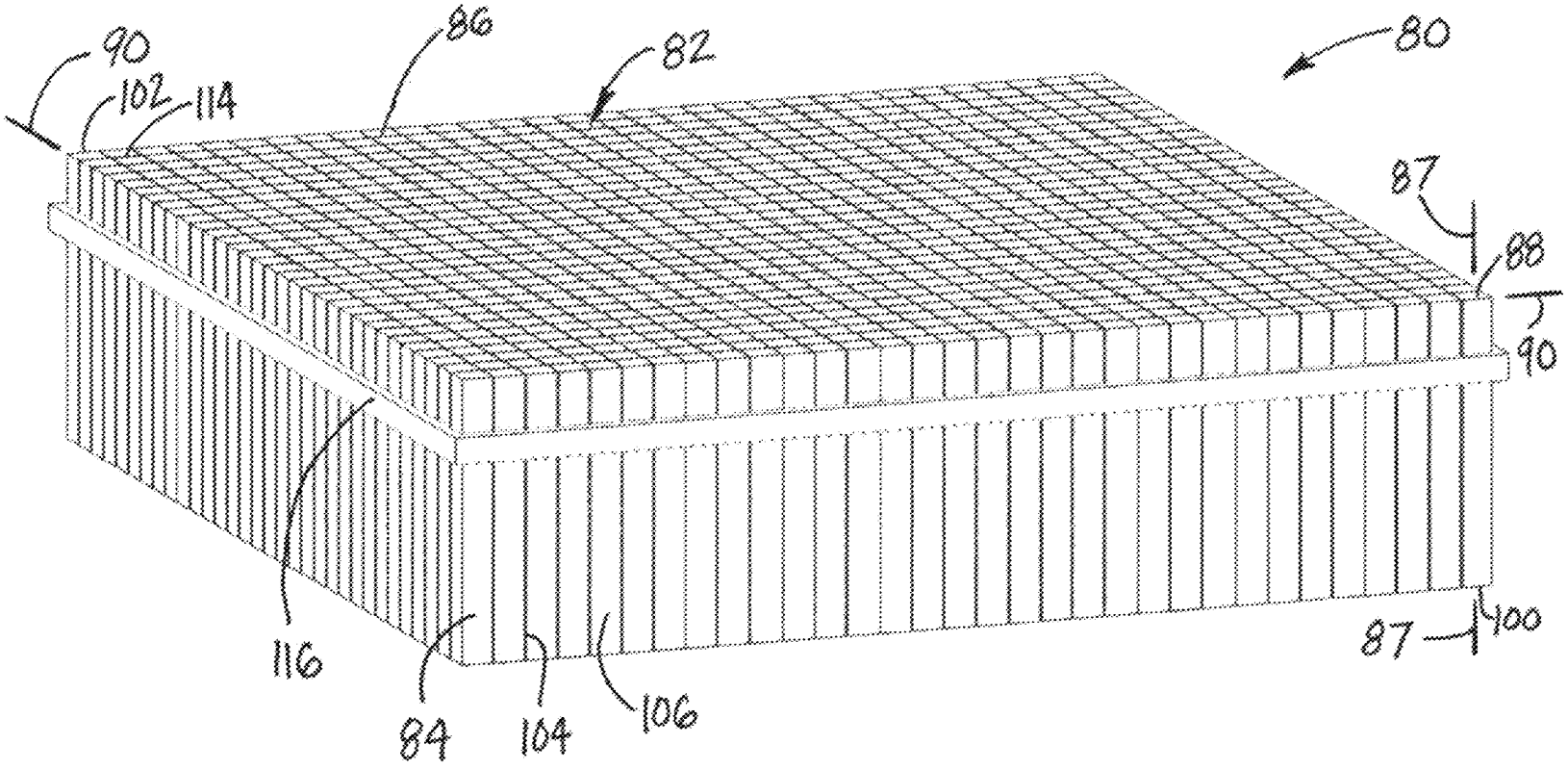
FIG. 13 is a schematic perspective view of an embodiment of a green simulation apparatus according to the present disclosure, showing surface elements with top surfaces having a square perimeter shape in a neutral position.
Figure 14:
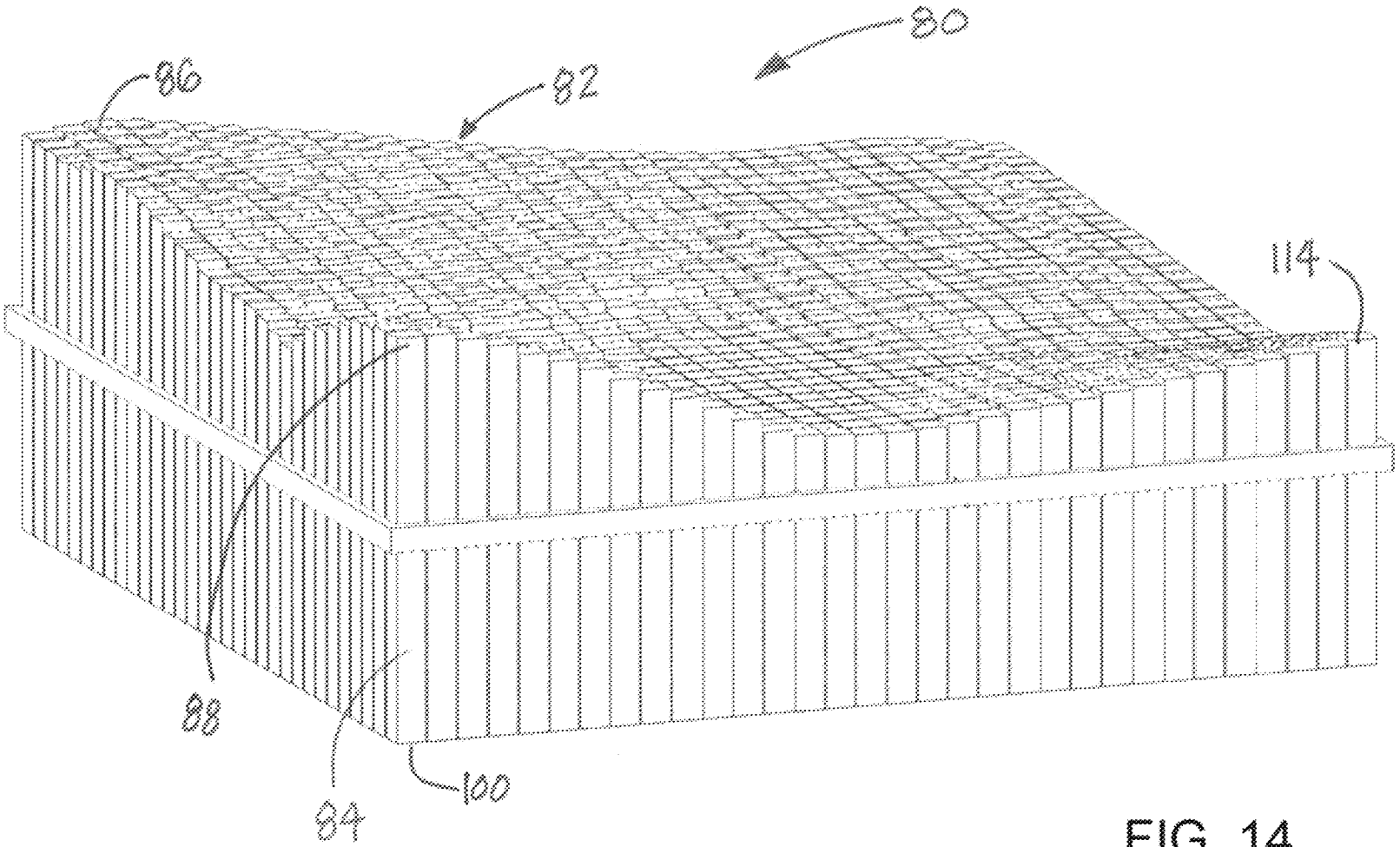
FIG. 14 is a schematic perspective view of the embodiment of a green simulation apparatus shown in FIG. 13, showing surface elements with top surfaces having a square perimeter shape in a raised position.
Figure 15:
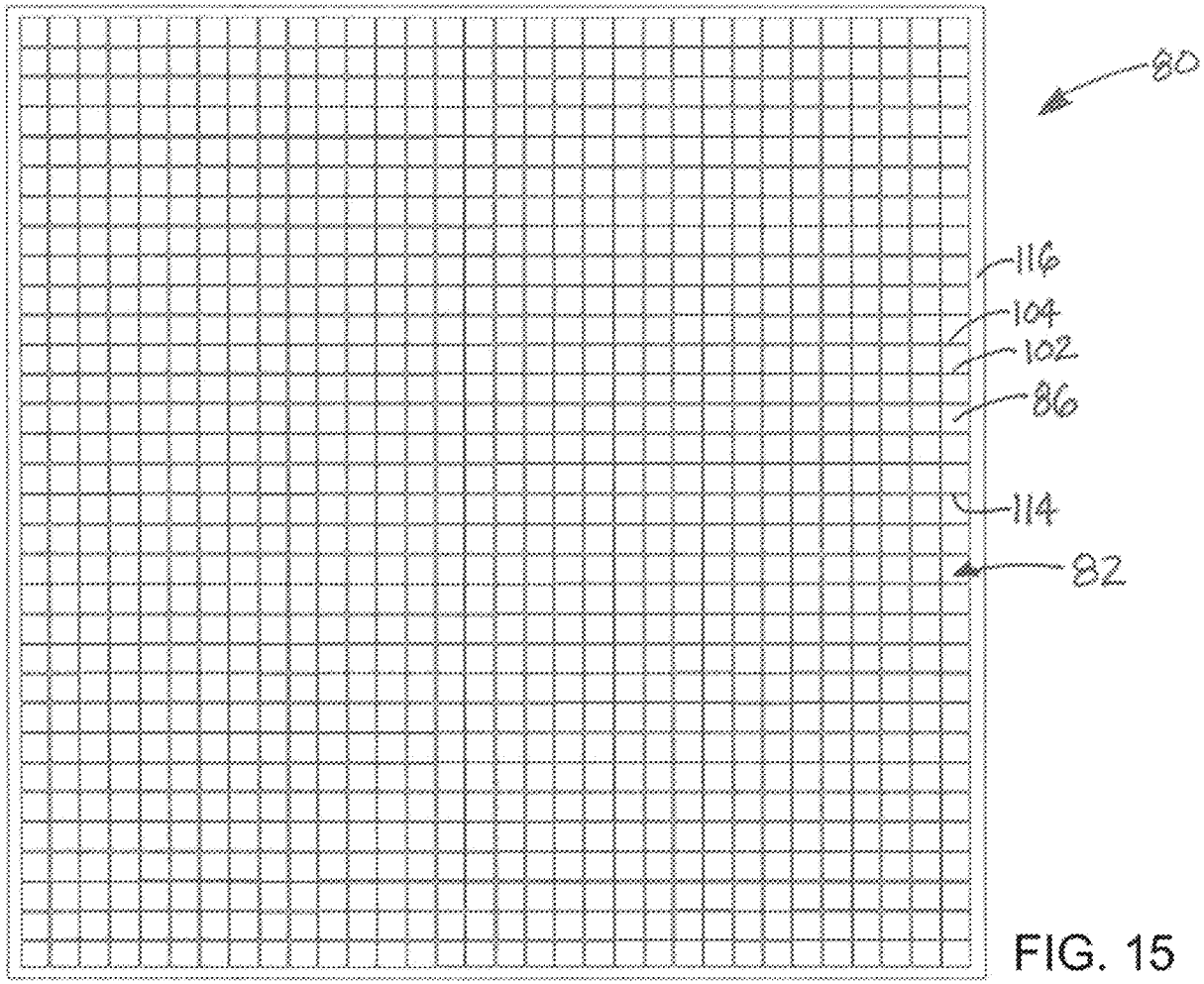
FIG. 15 is a schematic top view of the embodiment of a green simulation apparatus shown in FIG. 13.
Figure 16:
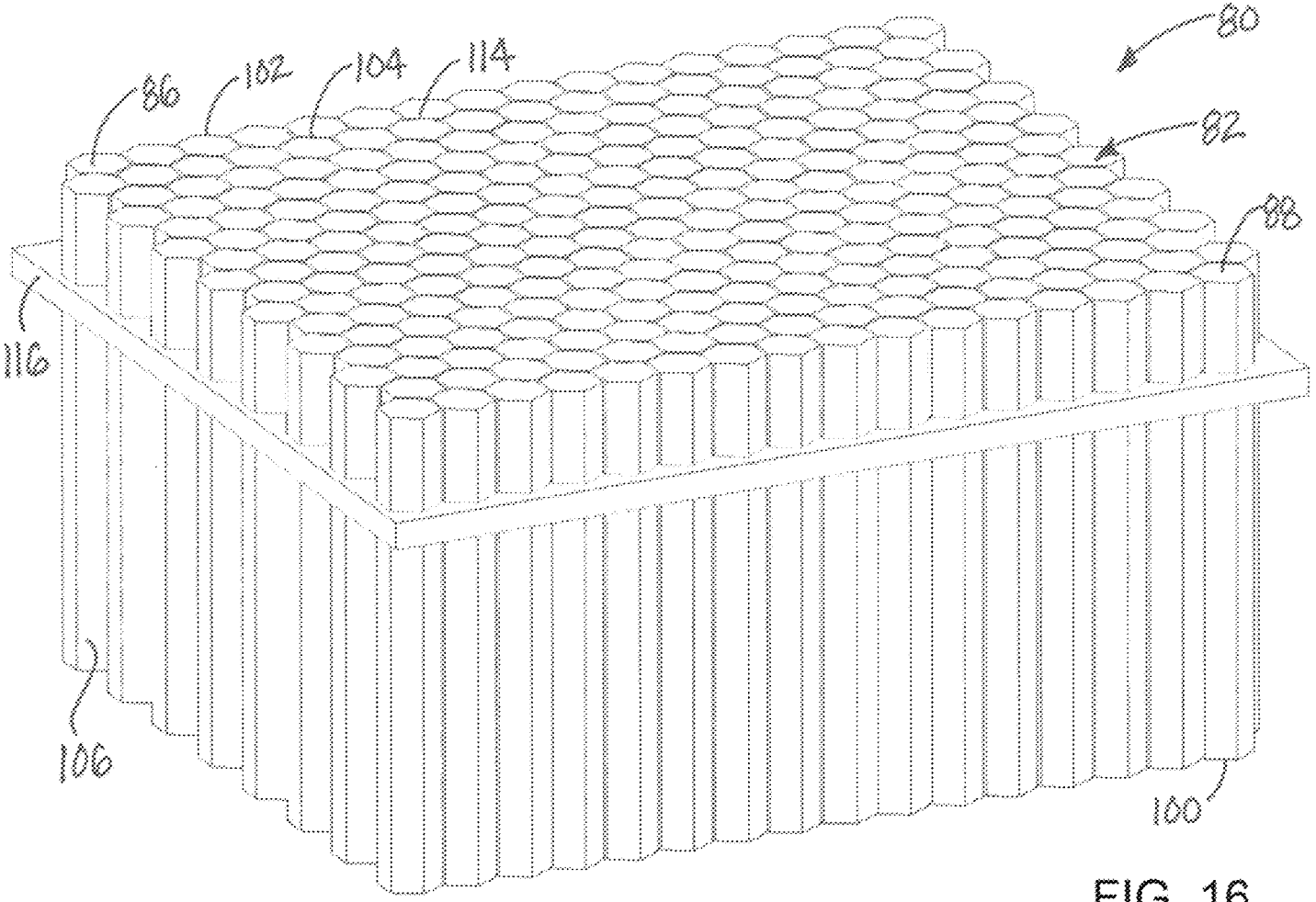
FIG. 16 is a schematic perspective view of an embodiment of a green simulation apparatus according to the present disclosure, showing surface elements with top surfaces having a hexagonal perimeter shape in a neutral position.
Figure 17:
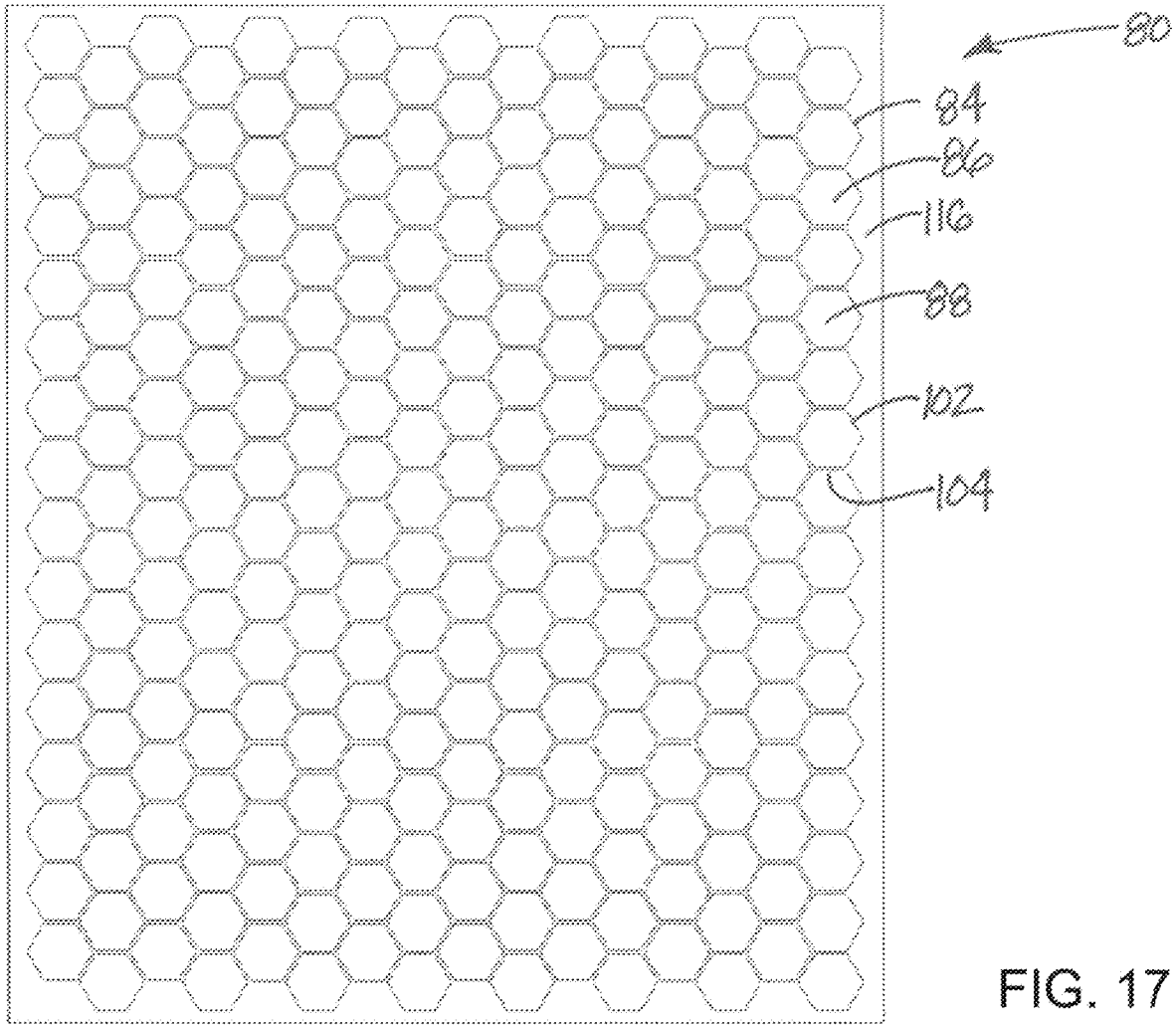
FIG. 17 is a schematic top view of the embodiment of a green simulation apparatus shown in FIG. 16.
Figure 18:
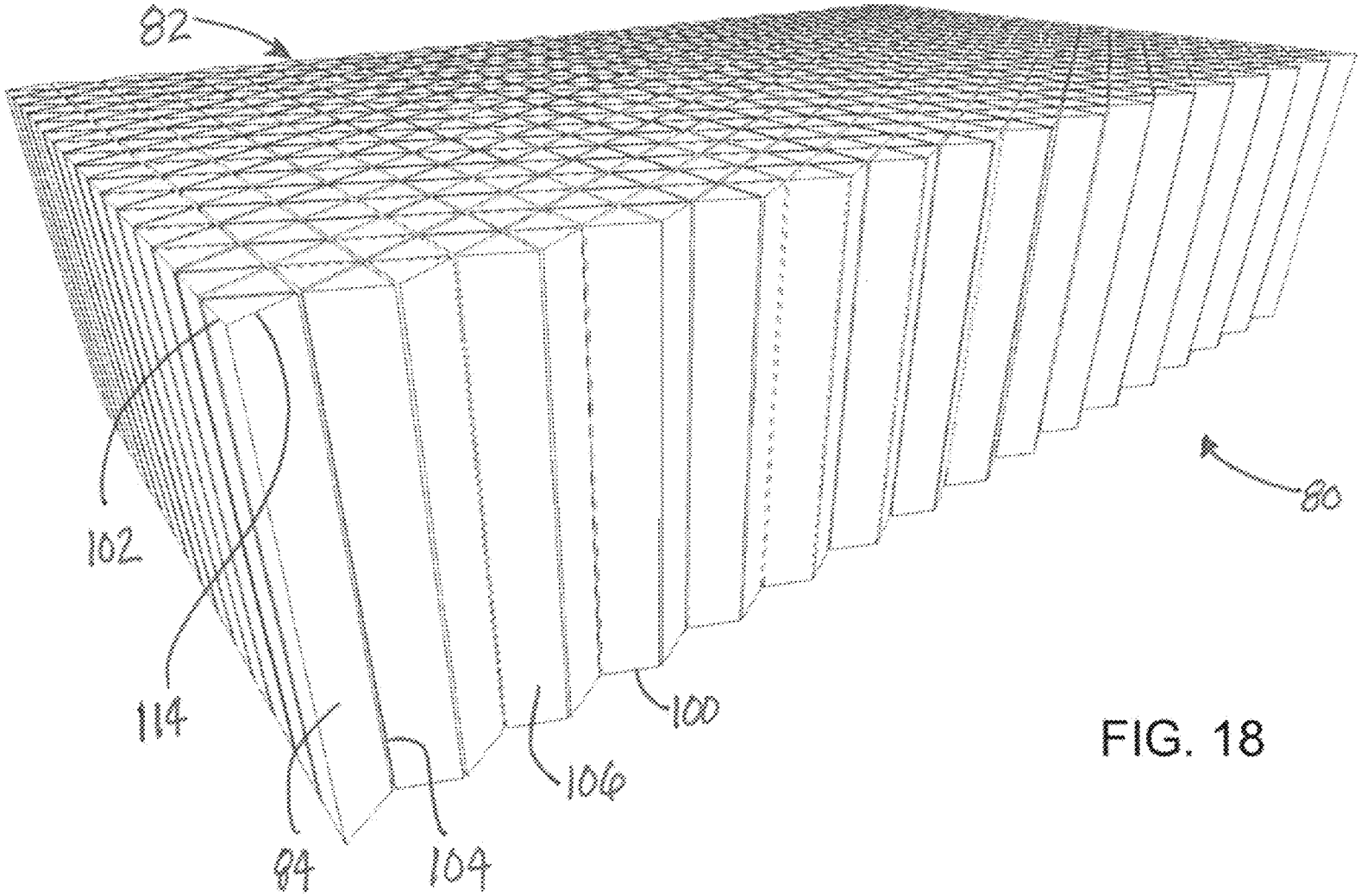
FIG. 18 is a schematic perspective view of an embodiment of a green simulation apparatus according to the present disclosure, showing surface elements with top surfaces having a triangular perimeter shape in a neutral position.
Figure 19:
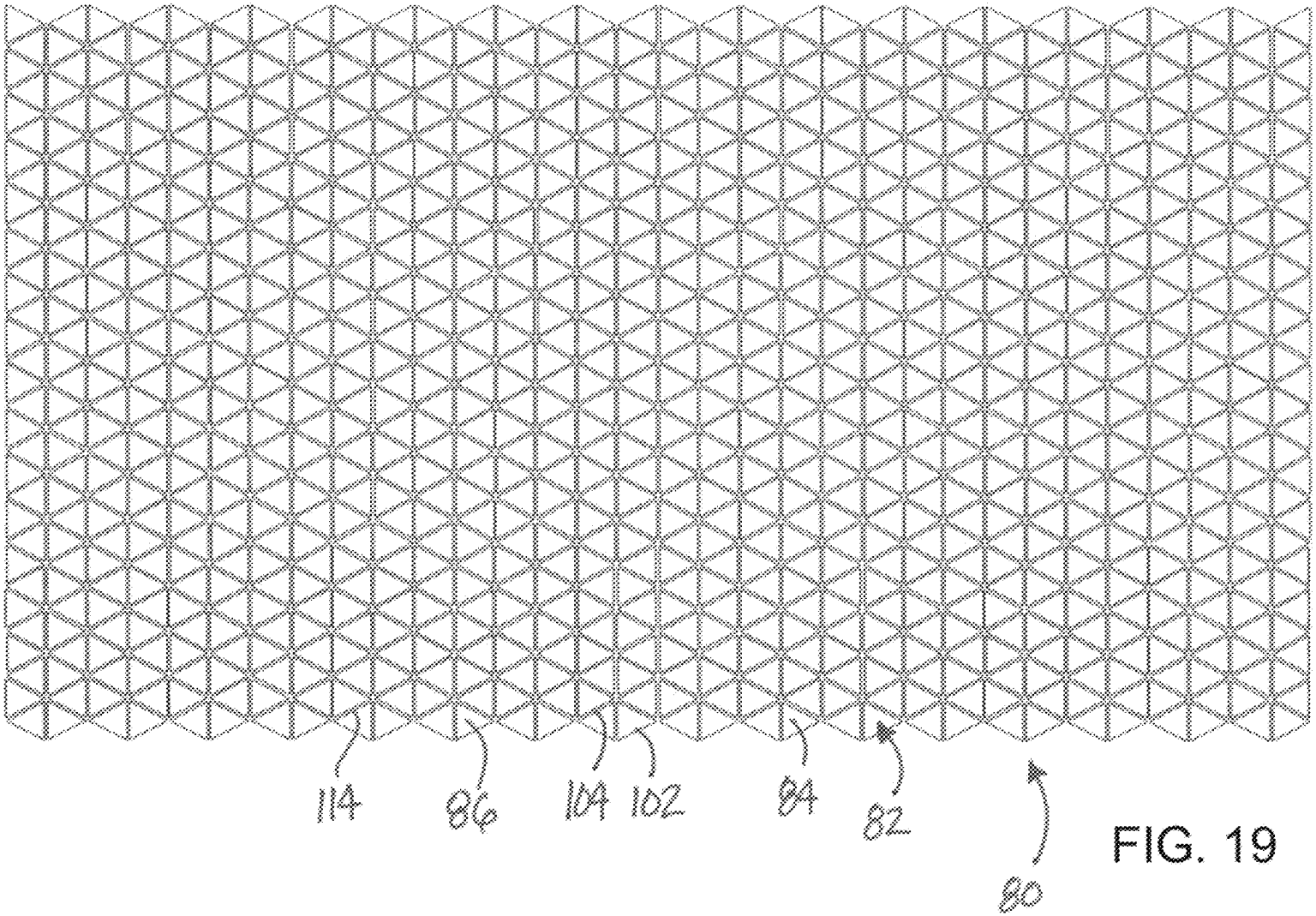
FIG. 19 is a schematic top view of the embodiment of a green simulation apparatus shown in FIG. 18.
Figure 21:
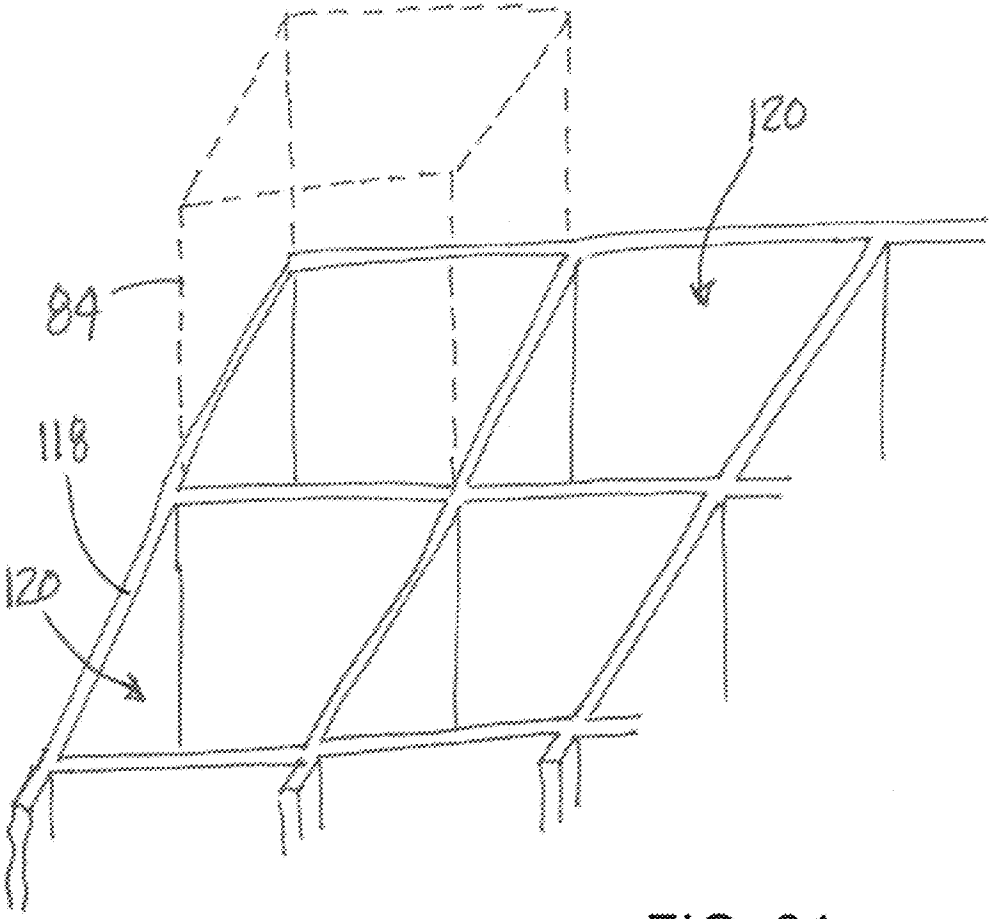
FIG. 21 is a schematic perspective view of a frame defining channels for the surface elements.

In some embodiments, the movable positioning elements may be formed of structures that include a female cylinder 76 or sleeve that includes the top end of the element, and defines a channel into which extends a male post 78 forming the bottom end of the element. In some embodiments (see FIG. 10), the exterior surface of the post 78 and interior surface of the channel in the cylinder 76 may be complementarily threaded so that the threads engage. The post may be mounted to permit rotation about a vertical axis, and the post may be rotated to cause raising and lowering of the sleeve, and the top end located thereon. The post may be rotated by a motor or by any suitable mechanical, hydraulic, pneumatic, or other, means. The motor may be operated or controlled to raise or lower the top end and the portion of the covering located above the positioning element. Optionally, other means may be employed to cause the cylinder to move with respect to the post.

In some further embodiments, the moveable positioning elements may comprise pins that are relatively free floating (within extreme limits that have lower ends that are exposed to contact a contoured substrate that correlates in some manner to the desired contour of the upper surface of the covering. The substrate may have a contoured upper face that is positioned below the lower ends of the pins, and movement of the substrate upwardly to contact the lower ends of the pins tends to raise the pins to a degree that varies with the contour of the upper face at the location that the lower end contacts the face. The pins may thus telegraph the contour of the upper face of the substrate to the covering, and the upper surface of the covering.

Figure 9:
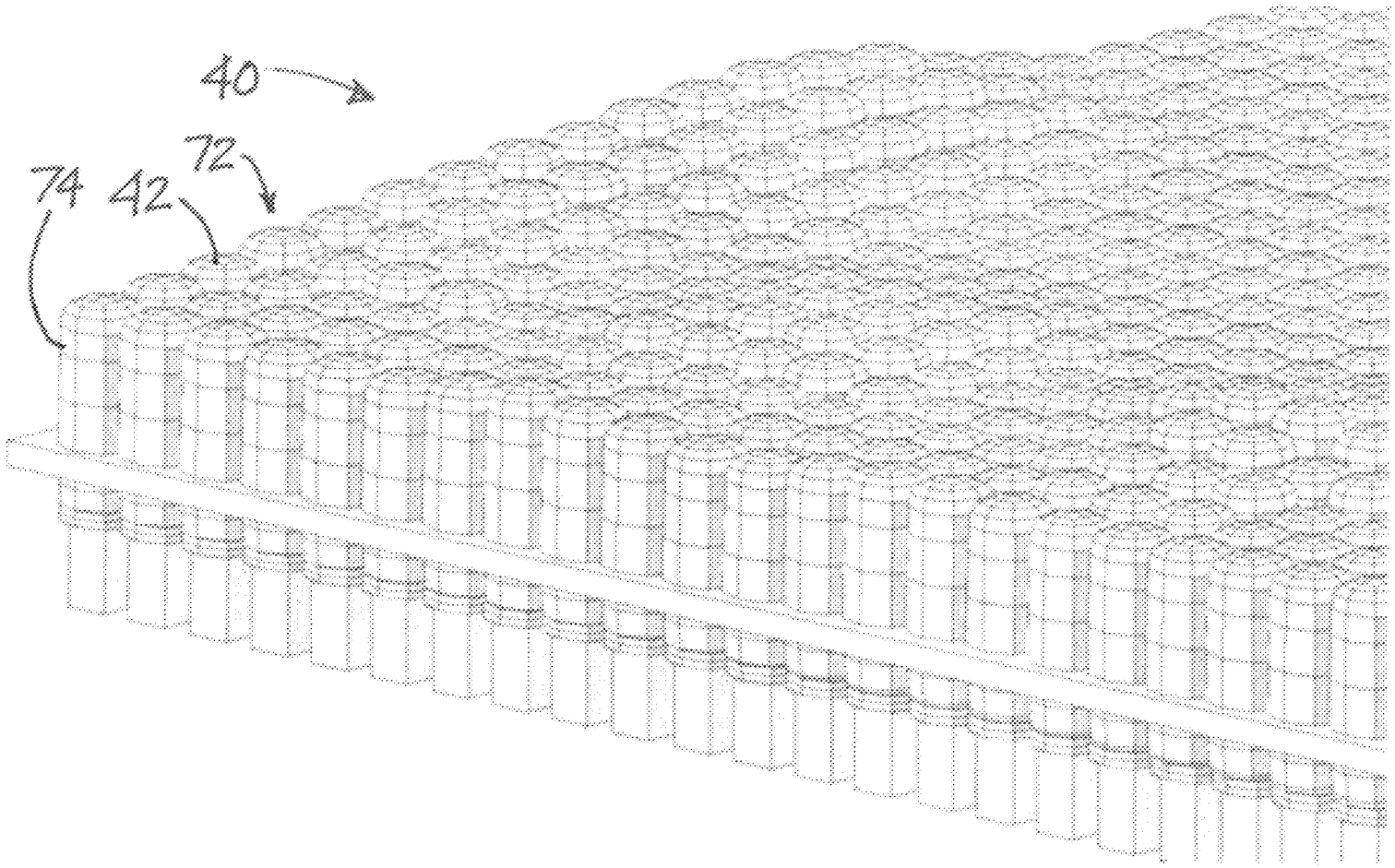
FIG. 9 is a schematic perspective view of an embodiment of the support assembly with the covering removed to show detail of the positioning elements, which defined a plurality of chambers for supporting the covering.

In some still further embodiments, the plurality of movable positioning elements may comprise a plurality of chambers 72 for receiving a fluid such as a liquid or a gas that is moved into and out of the chamber to expand or contract the volume of the chamber (see FIG. 9). The chamber may be defined by a flexible wall 74, such as a bag or balloon or sack that contains without leakage the fluid utilized which moves into and out of the chamber. The movement of the fluid into and out of the chambers may be individually controlled such that the chambers may be filled to different degrees to provide different levels of expansion and vertical lift of the covering positioned above the chamber.

In some optional embodiments, the covering 40 may be omitted and the upper end 44 of the positioning elements may collectively form the upper surface 22 of the apparatus, as if the upper end of each of the elements was a "pixel" of the upper surface. Illustratively, FIGS. 13 through 21 show a simulation apparatus 80 with a configurable upper surface 82 with a changeable contour, and the upper surface may form a play surface across which a golf ball or other object may roll. The upper surface 82 may have a periphery with the upper surface being substantially continuous between the peripheries. The apparatus 80 may comprise a plurality of movable surface elements 84 that are positioned in a close array. Each element 84 may form a portion of the upper surface 82 of the simulation apparatus such that the upper surface is collectively formed by the elements 84. Each of the surface elements 84 may have a top surface 86 that forms a respective portion of the upper surface 82. Each of the surface elements 84 may be elongated with a longitudinal axis 87. The plurality of surface elements may be elongated with the top surface being located at an upper end 88 of the element, and a lower end 100 may be located opposite of the upper end. It will be appreciated that the longitudinal axis of the elements 84 may be substantially vertically oriented although this is not critical and may be horizontally oriented or oriented in other directions, and therefore the upper ends are not necessarily located higher than the lower ends.

The movable surface elements 84 may be movable to adjust the position of the top surface 86 of the respective element 84 with respect to other elements 84. Illustratively, the surface elements may be movable in a substantially vertically direction. The surface elements 84 may have a neutral position, and the top surfaces of surface elements in the neutral position may define a reference plane 90 (see FIG. 13). In addition to the neutral position, each surface element may also have a plurality of raised positions in which the top surface is located spaced or displaced from the neutral position, and may be vertically higher than, the reference plane 90 (see FIG. 14).

The top surface 86 of the surface element has a perimeter 102. In some embodiments, the perimeters of adjacent surface elements may have a gap 104 located therebetween, although in some embodiments there may not be any significant gap. The perimeters of the surface elements may be configured such that a width of the gap 104 between the perimeters 102 of the adjacent surface elements is substantially uniform, and may be configured such that the width of the gap is substantially uniform along substantially the entire perimeter 102 of the surface element. The gap between the surface elements may be minimal such that side surfaces 106 of the surface elements abut against the side surfaces of adjacent surface elements, and the side surfaces of one element 84 may be in sliding contact with the side surfaces of one or more adjacent surface elements. In such embodiments, the surface elements positioned about a surface element may function to guide movement of the surface element through the sliding contact.

Figure 20:
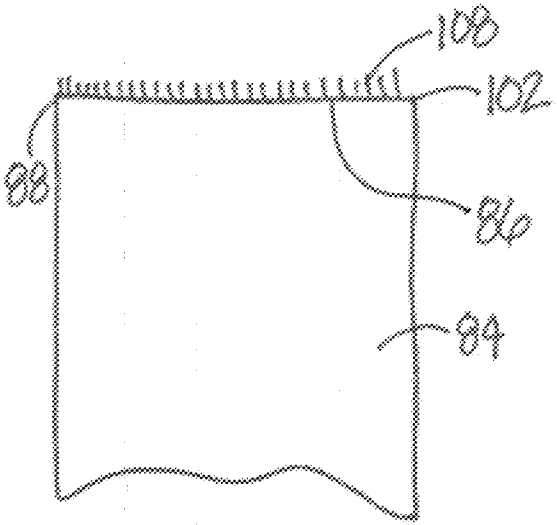
FIG. 20 is a schematic side view of a surface element showing turf elements.

In some embodiments, the top surface 86 may be textured, and may have turf elements 108 positioned thereon to simulate turf or grass on the top surface (see FIG. 20). The turf elements 108 may comprise filaments that extend from the top surface 86.

Optionally, the top surface 86 of each surface element 84 may have a cover patch mounted the surface 86. In some embodiments, a perimeter of the cover patch may be larger in size and area than the top surface of the surface element such that the perimeter extends beyond the borders of the perimeter 102 of the top surface, and the cover patch of one surface element may overlap a portion of the cover patch of an adjacent surface element.

The perimeter 102 of the surface element has a perimeter shape, and in the most preferred embodiments the perimeter shape may be uniform for each of the surface elements. In some embodiments, the perimeter shape may be formed of a plurality of straight lines to form edges 114 of the top surface for positioning adjacent to edges 114 of the top surfaces of the adjacent surface elements. The perimeter shape may be a regular shape, and in some embodiments, the perimeter shape is substantially rectangular (see FIGS. 13 through 15), substantially hexagonal (see FIGS. 16 through 17), substantially triangular (see FIGS. 18 through 19) as a few illustrative examples. The surface elements may have a substantially uniform lateral cross sectional shape from the upper end 88 to the lower end 100.

The top surface 86 may have a substantially planar contour which may lie in a plane oriented substantially perpendicular to the longitudinal axis 87 of the surface element, although in some embodiments the contour of the top surface may be somewhat or slightly domed.

Optionally, a band 116 may extend about the plurality of surface elements 84 to hold the elements 84 together, and portions of the band may extend along the lateral sides and opposite ends of the simulation apparatus. The band 116 may extend in a substantially horizontal plane where the longitudinal axes 87 are vertically oriented. The portions of the band may have inner surfaces positioned and contoured to follow contours of the side surfaces 106 of the surface elements at the lateral sides and ends of the apparatus. As a further option, a frame 118 may form a plurality of channels 120 (see FIG. 21), with each of the channels receiving one of the movable surface elements 84. The channels 120 may have an axis extending substantially parallel to a direction of movement of the surface elements, and the channels may have a cross sectional shape that corresponds to the shape of the perimeter of the surface element.

A movement actuator may be configured to move a surface element 84 independently of other positioning elements, and may act on the lower end of the surface element although this is not critical. The movement actuator may have various characteristics and configurations of the movement actuators described in this disclosure.

Figure 22:
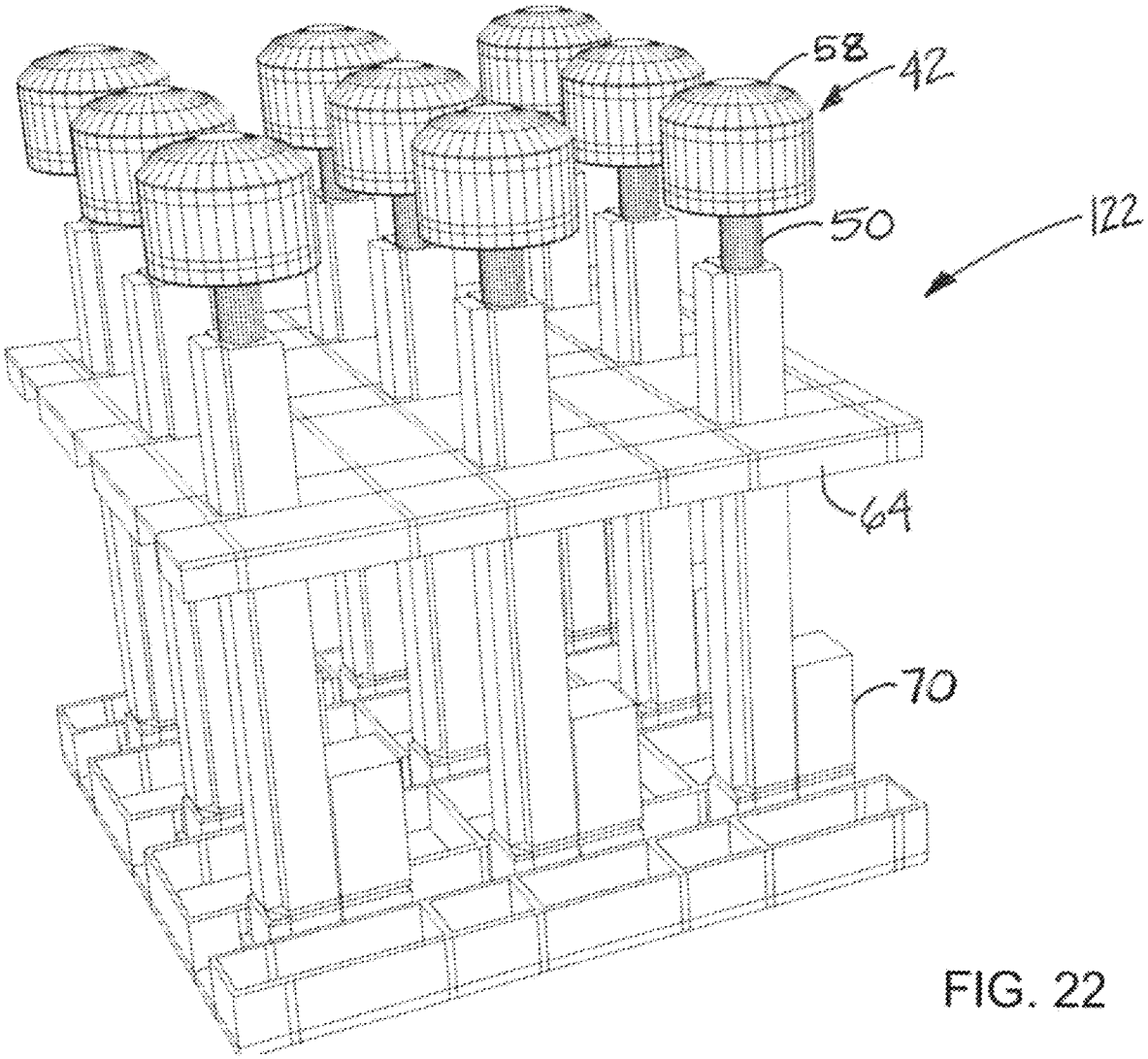
FIG. 22 is a schematic perspective view of a module of an embodiment of the covering support assembly, with the covering removed to show detail of the positioning elements.
Figure 23:
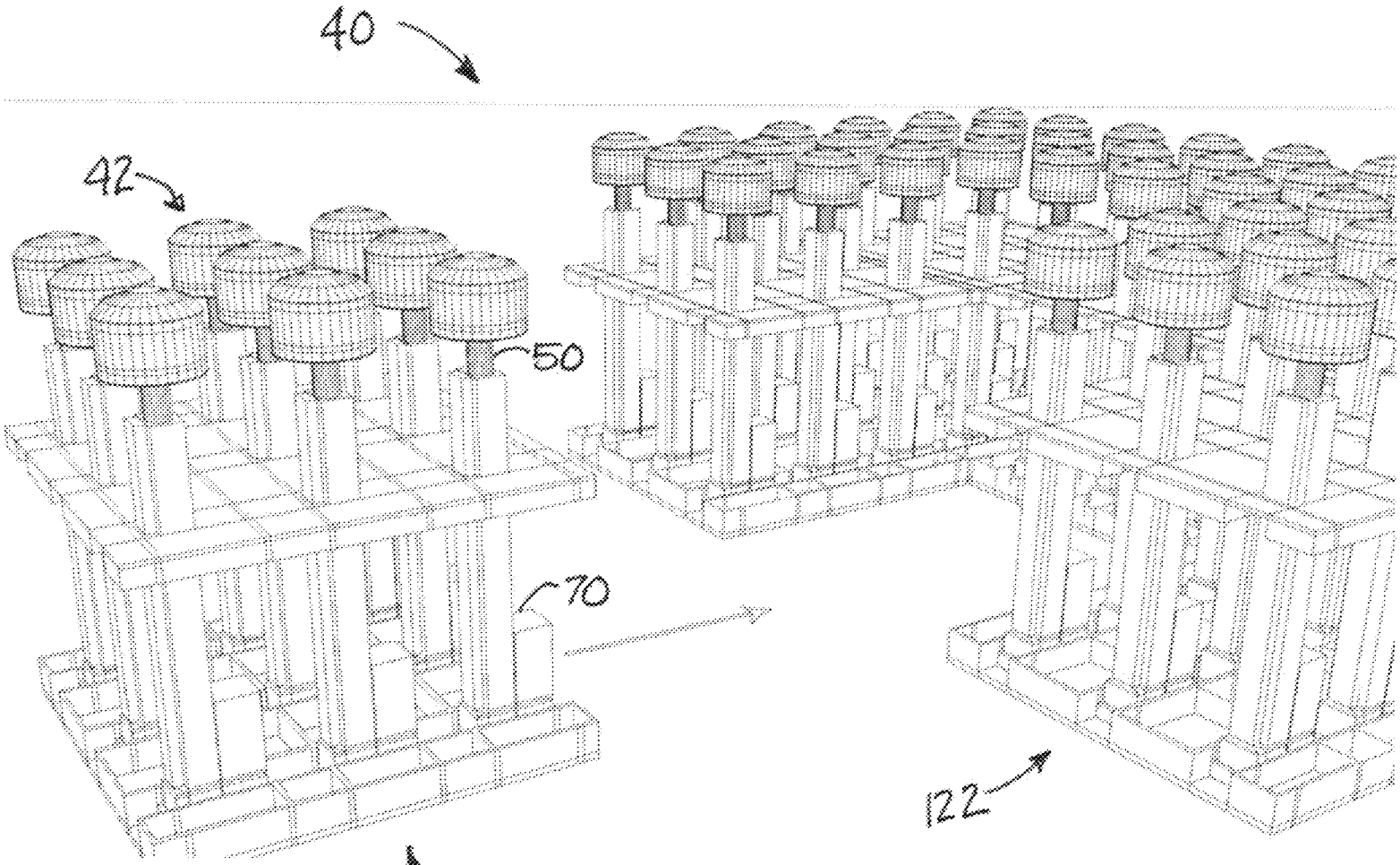
FIG. 23 is a schematic perspective view of a module removed from an array of modules of an illustrative embodiment of the covering support assembly.
Figure 25:
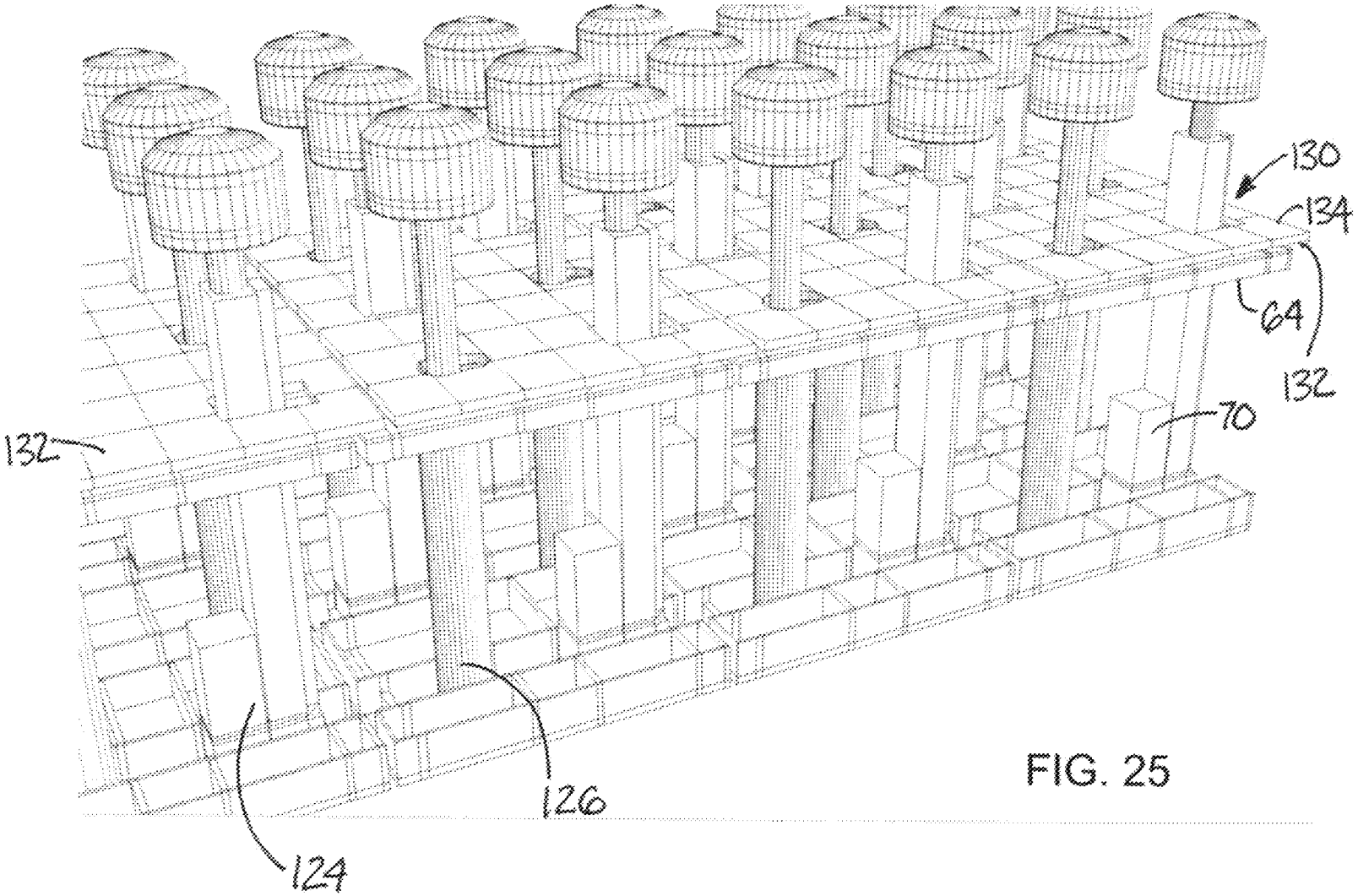
FIG. 25 is a schematic perspective view of an array of modules of active and passive positioning elements, according to an illustrative embodiment.
Figure 26A:
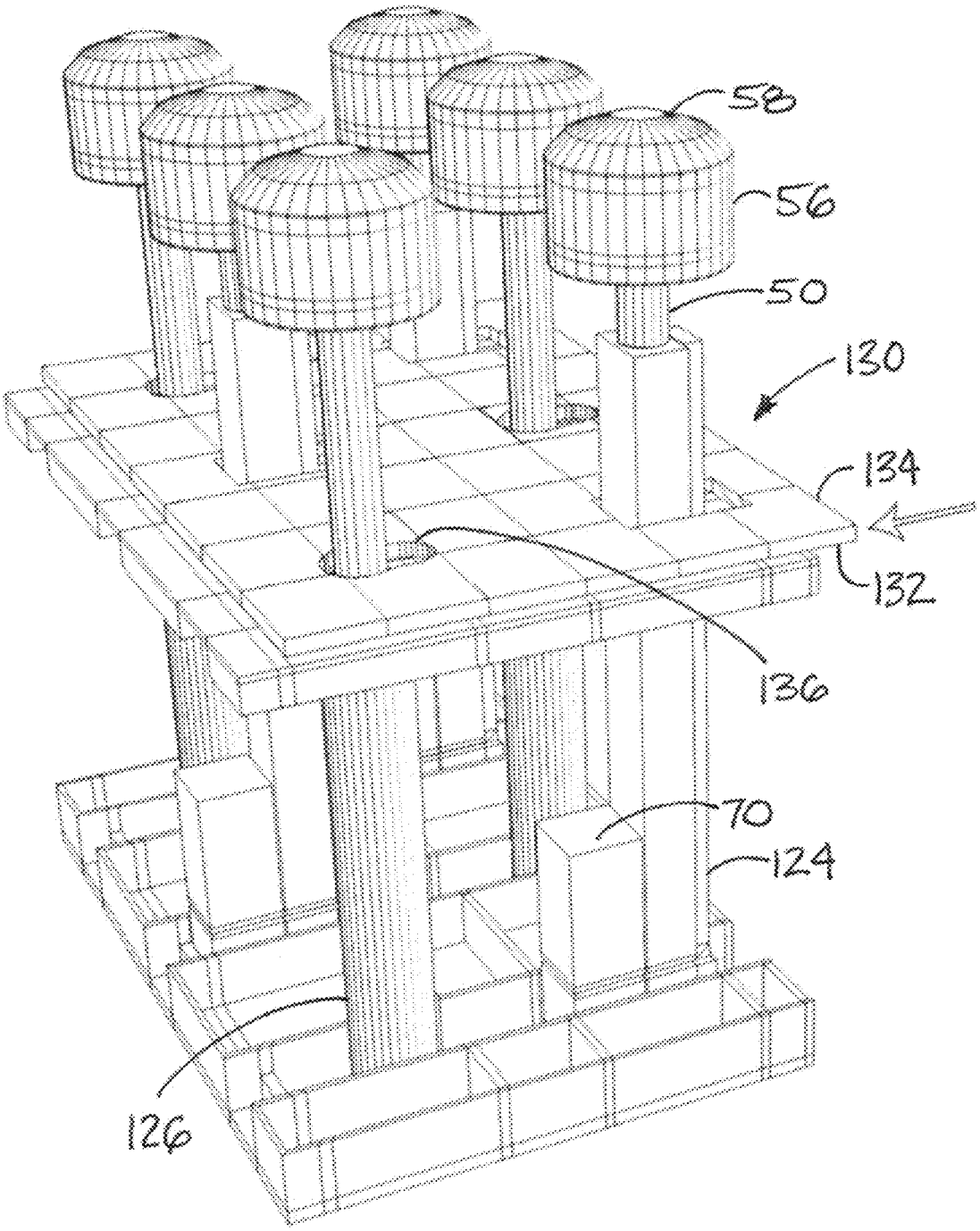
FIG. 26A is a schematic perspective view of a module of active and passive positioning elements, according to an illustrative embodiment.
Figure 26B:
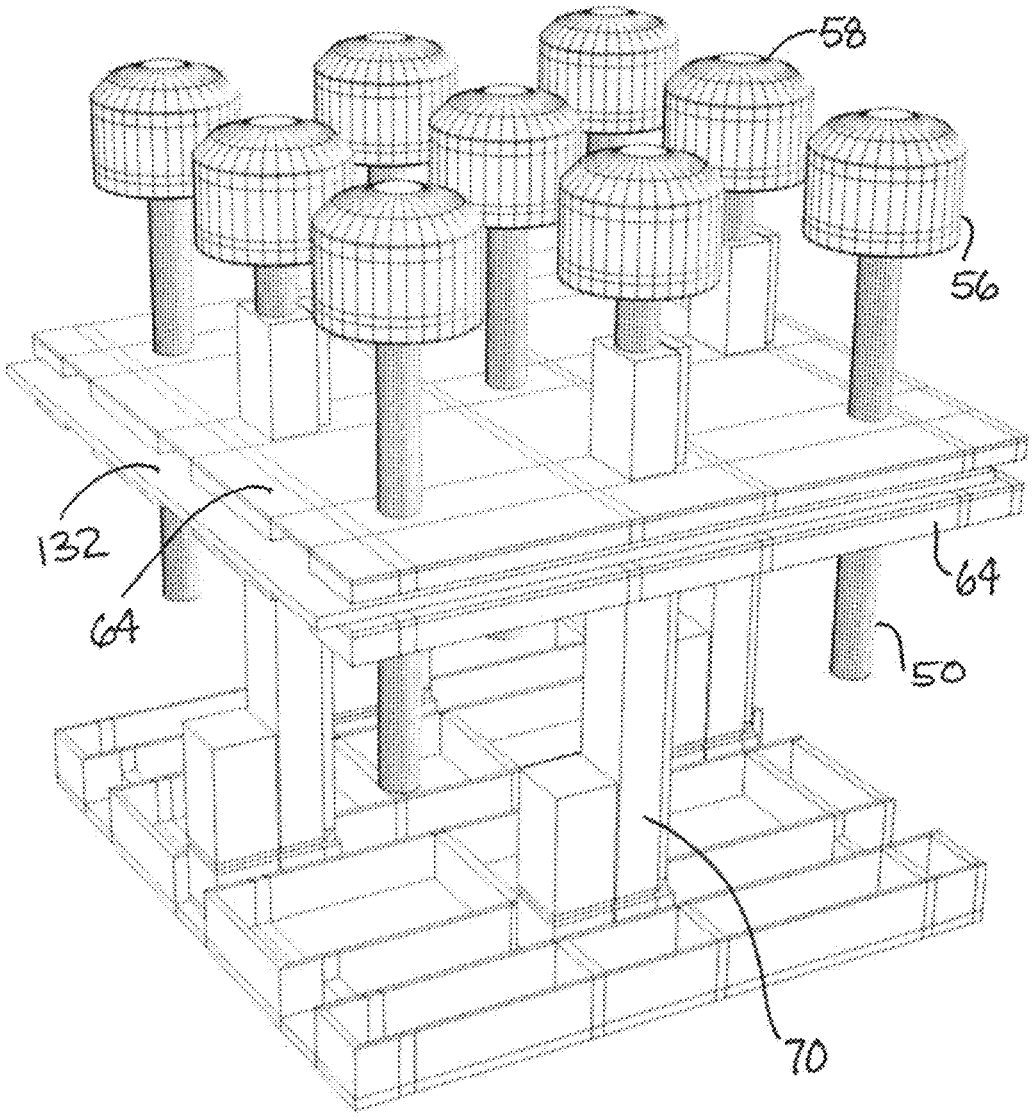
FIG. 26B is a schematic perspective view of a module of active and passive positioning elements, particularly showing an embodiment in which passive positioning elements lack movement actuators and guide tubes are removed from the passive positioning elements to show detail, according to an illustrative embodiment.
Figure 27:
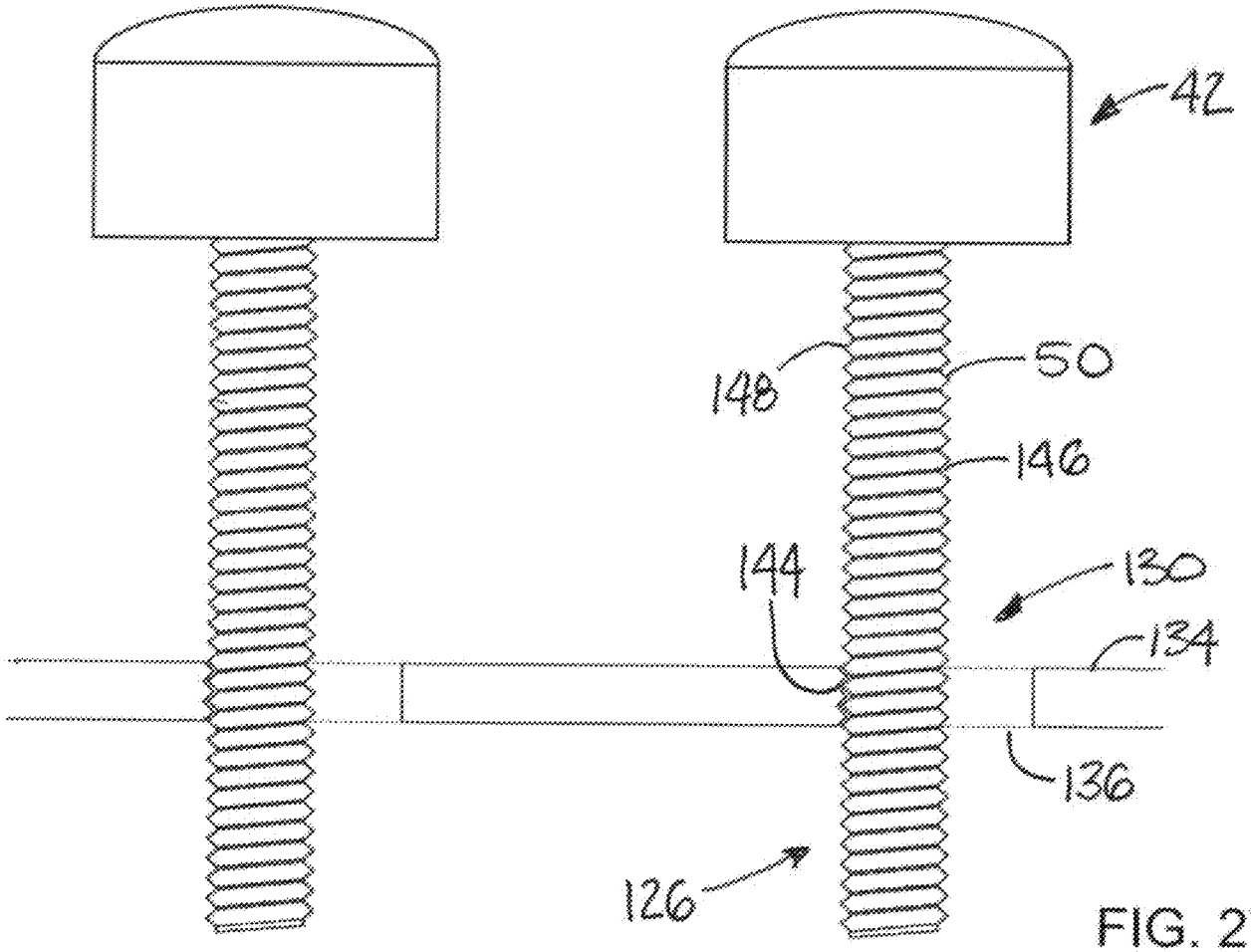
FIG. 27 is a schematic side view of positioning elements and an illustrative embodiment of a locking assembly shown in a locked position.
Figure 28:
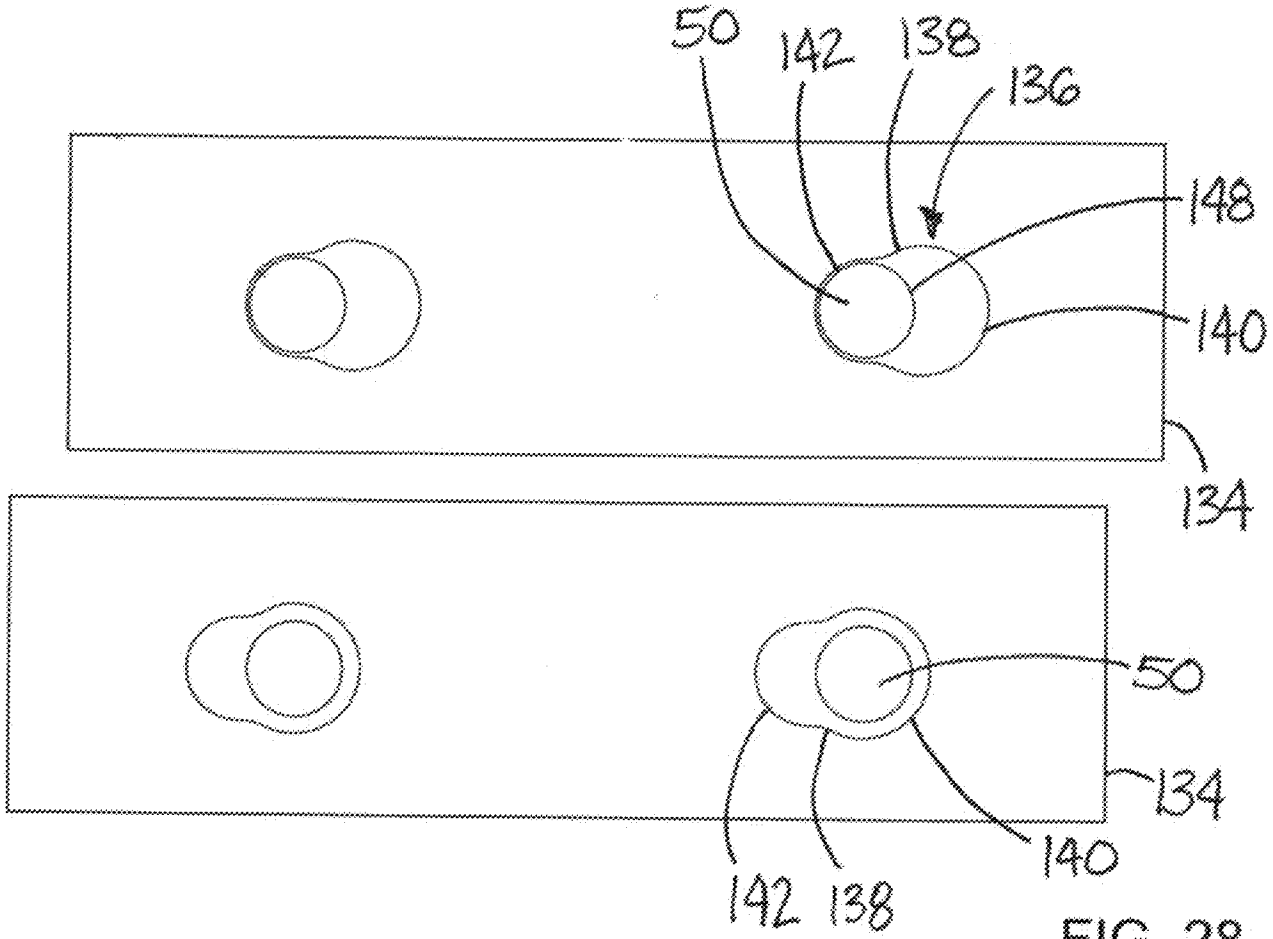
FIG. 28 is a schematic top view of positioning elements of FIG. 27 in a lock condition (above) with the lock plate in the lock position and the pins in the lock area of the aperture, and in a free condition (below) with the lock plate in the release position and the pins in the free area of the aperture, according to an illustrative embodiment.
Figure 29:
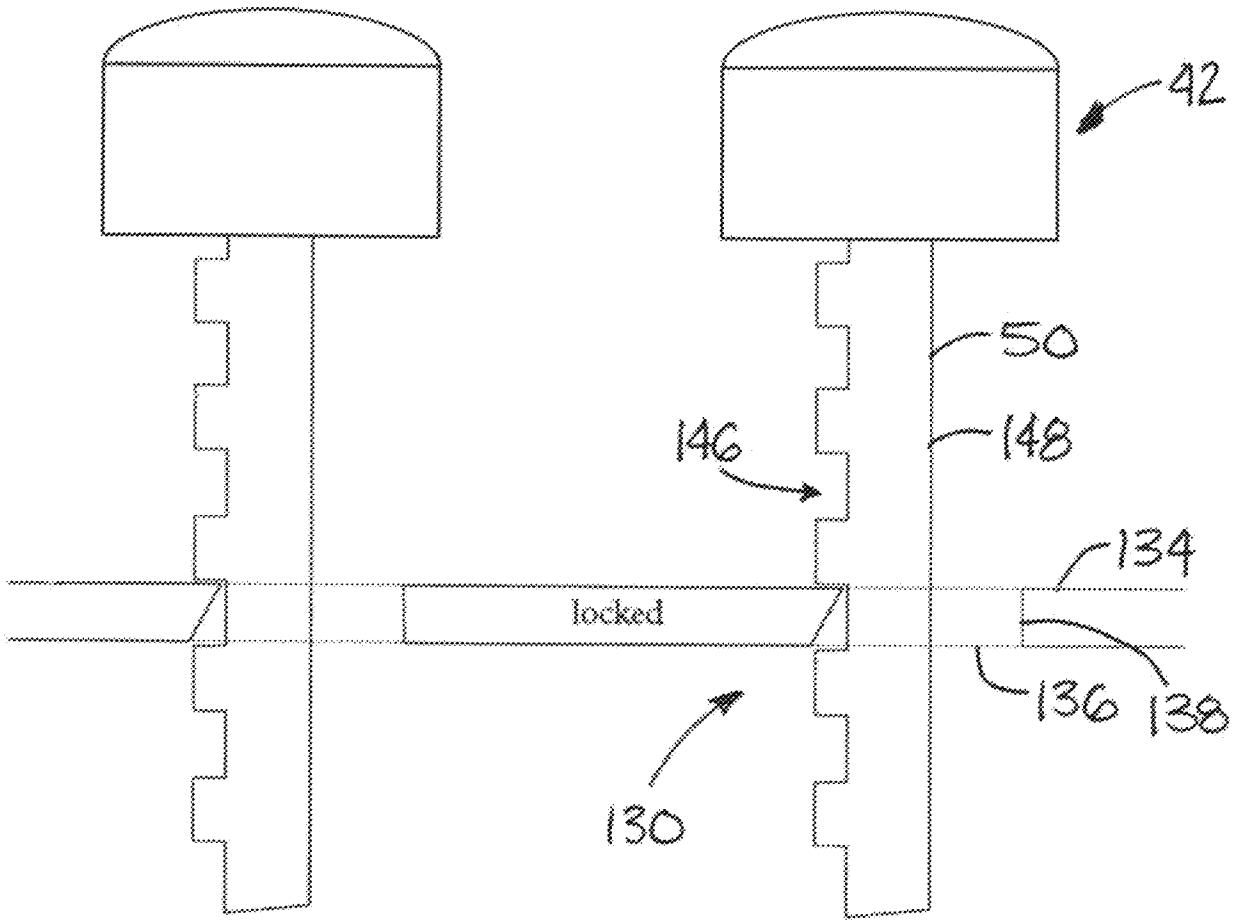
FIG. 29 is a schematic side view of positioning elements and another illustrative embodiment of a locking assembly of an embodiment shown in a locked position.
Figure 30:
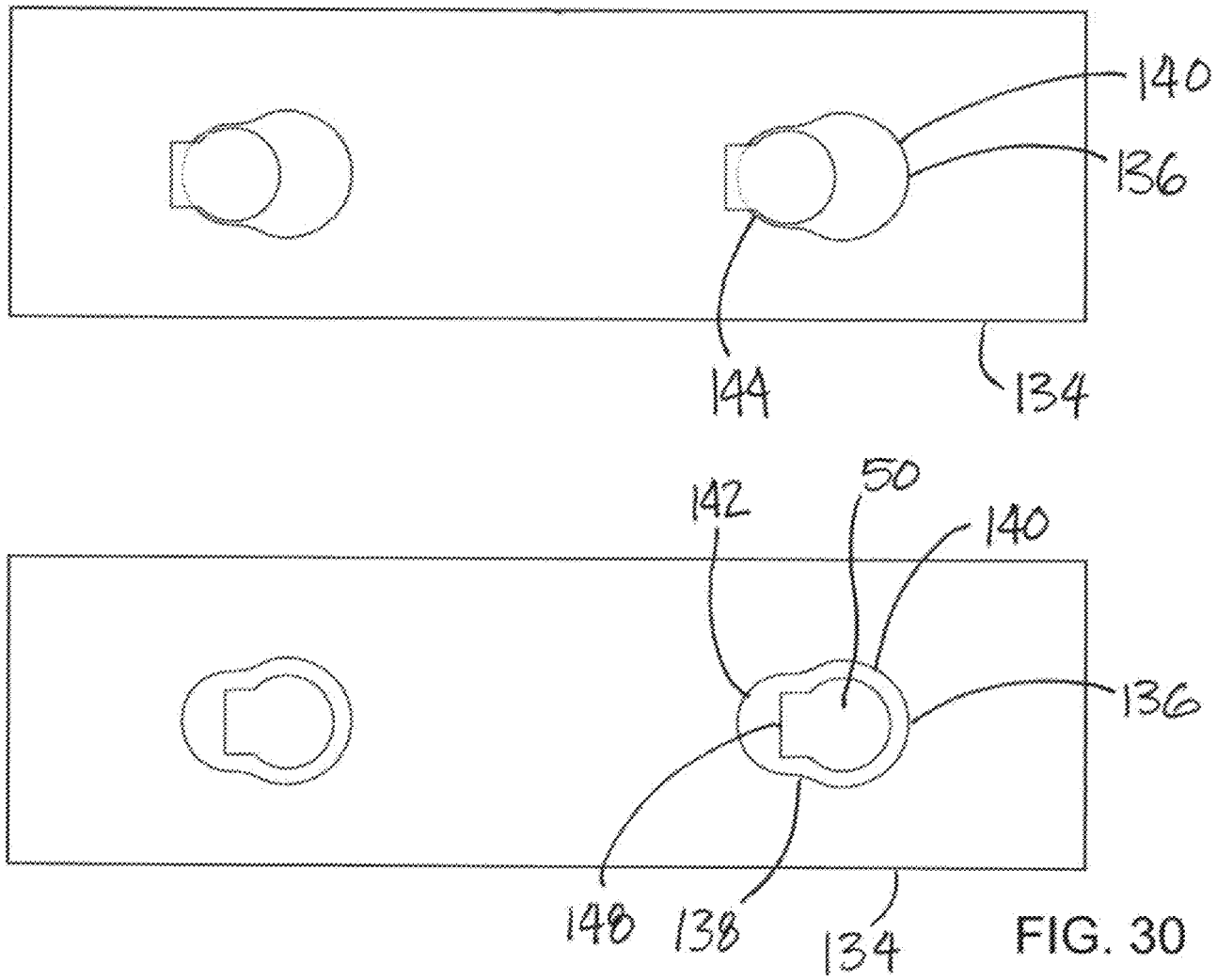
FIG. 30 is a schematic top view of positioning elements of FIG. 29 in a lock condition (above) with the lock plate in the lock position and the pins in the lock area of the aperture, and in a free condition (below) with the lock plate in the release position and the pins in the free area of the aperture, according to an illustrative embodiment.
Figure 31:
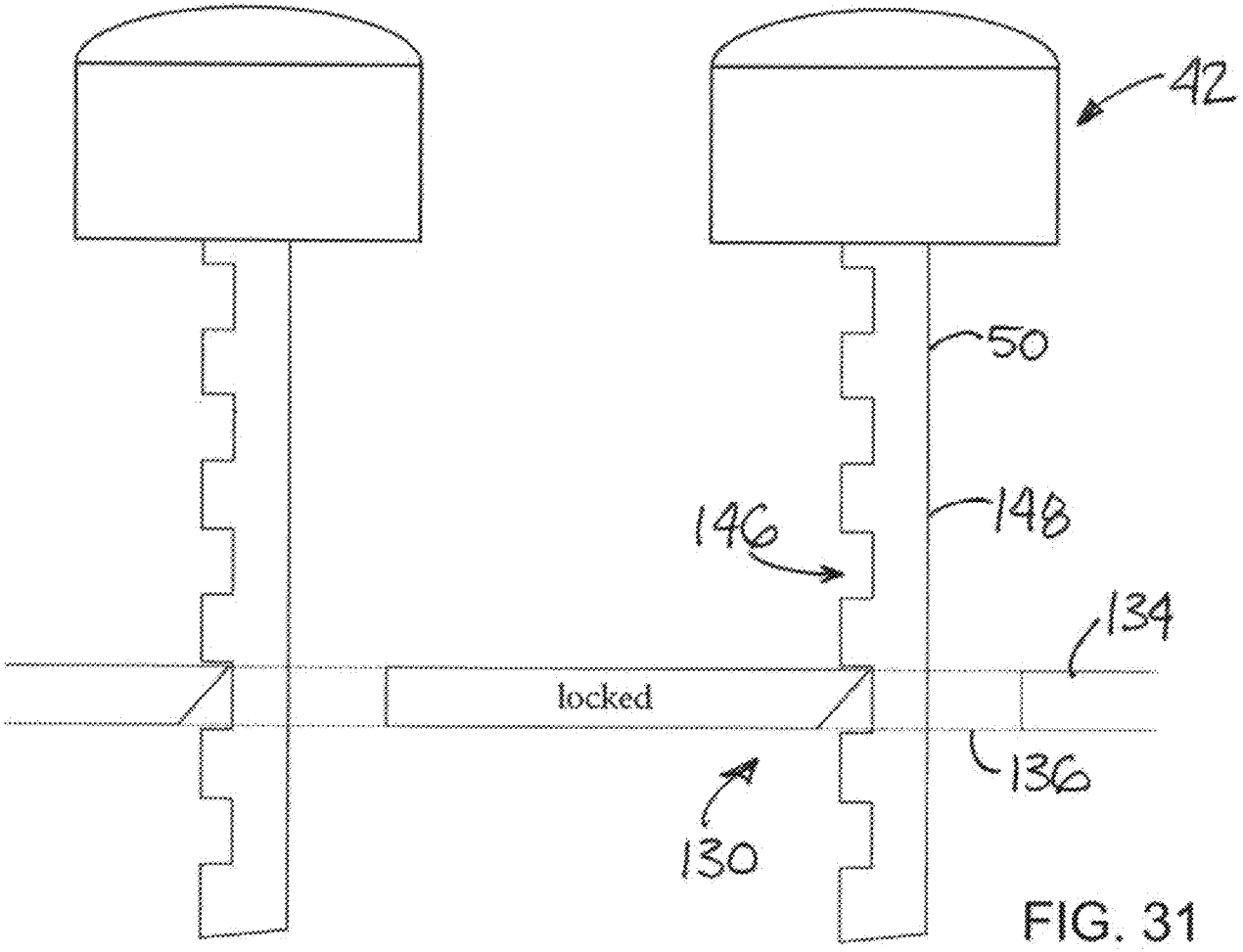
FIG. 31 is a schematic side view of positioning elements and still another illustrative embodiment of a locking assembly of an embodiment shown in a locked position.
Figure 32:
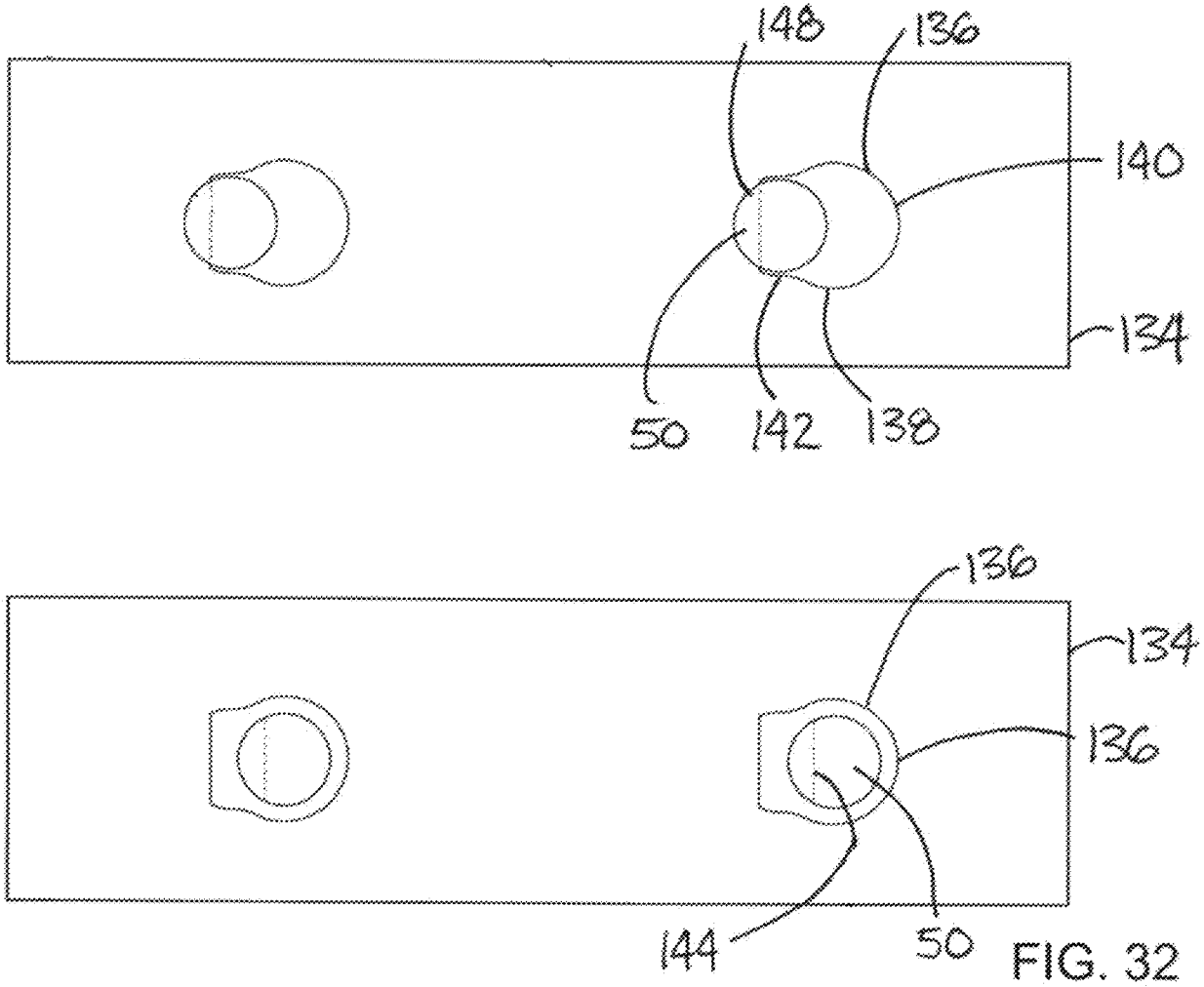
FIG. 32 is a schematic top view of positioning elements of FIG. 31 in a lock condition (above) with the lock plate in the lock position and the pins in the lock area of the aperture, and in a free condition (below) with the lock plate in the release position and the pins in the free area of the aperture, according to an illustrative embodiment.

The covering support assembly 40 may comprise a plurality of modules 122 (see FIGS. 22 and 26), with the modules being positioned adjacent to each other in an array of the modules (see FIGS. 23 and 25). Each of the modules 122 may include a plurality of the movable positioning elements 42 in an array, although a module having a single positioning element may be utilized for greater flexibility in shaping a perimeter of the apparatus 20. In modules 122 having a plurality of positioning elements, the number of elements 42 in the array may be substantially equal in both the X- and Y-directions. In other embodiments, the number of elements 42 in the array may be unequal in both the X- and Y-directions. The modules may be positioned adjacent to each other to create a larger size or area for the green simulation apparatus of varying size or shape of the perimeter of the apparatus. Each of the modules may have a substantially rectangular shape when viewed from above and along an axis generally parallel to the longitudinal axes of the pins, and in some embodiments the modules may be substantially square in shape with an equal number of positioning elements in an X direction and in a Y direction. In some embodiments, the covering may have a lateral extent that generally corresponds to the lateral extent of the module.

Figure 24:
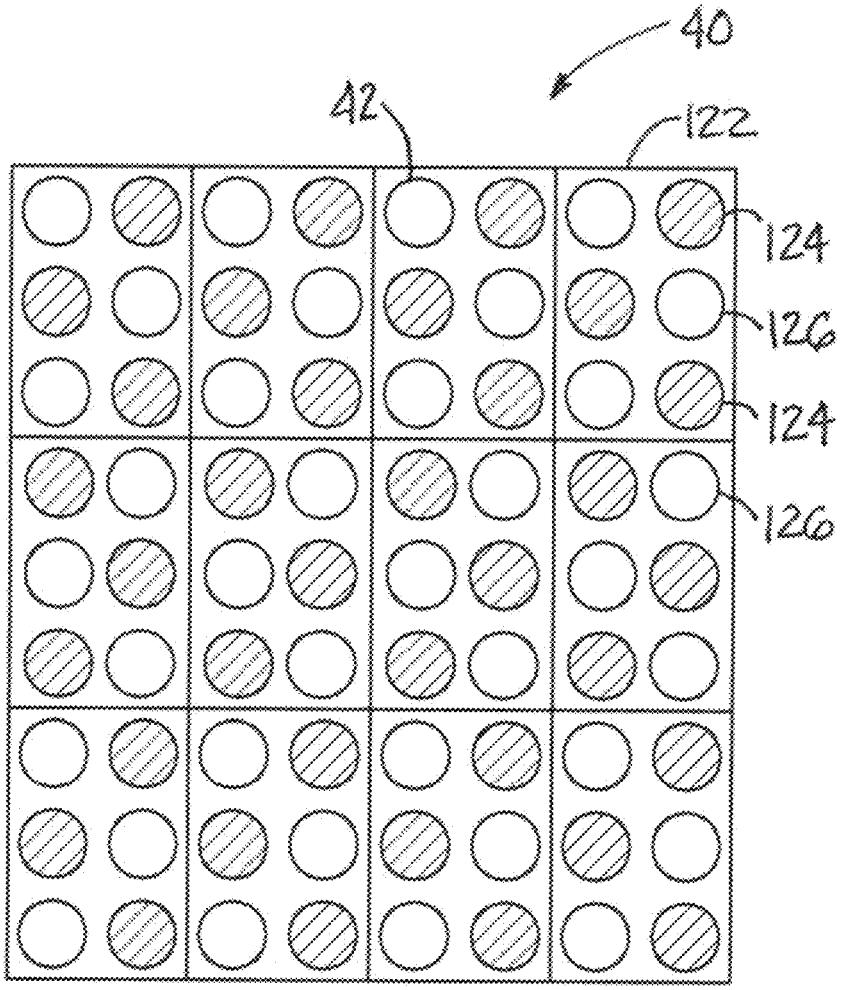
FIG. 24 is a schematic top diagrammatic view of an array of modules with positioning elements showing an illustrative pattern of active and passive positioning elements, according to an illustrative embodiment.

In some embodiments, the covering support assembly may include movable positioning elements 42 that are active and movable positioning elements that are passive (see FIGS. 24 through 32). Illustratively, the active positioning elements 124 may be associated with movement actuators, and the passive positioning elements 126 may not be associated with movement actuators, or may have movement actuators that are deactivated. The active positioning elements 124 may actively move against the covering to, for example, lift the covering to a desired position at the location of the positioning element. The passive positioning elements 126 may passively move in reaction to, or because of, the movement of the covering 30 by the active positioning element or elements. The passive movement of the passive positioning elements may be caused or influenced in various manners. Illustratively, in embodiments in which the upper end 44 of the passive positioning elements are attached to the bottom face 34 of the covering, the movement of the covering by the active positioning elements 124 may tend to move the passive positioning elements 126 connected to the covering. For example, movement of the covering by the active positioning elements in an upward direction may cause the covering to pull the attached passive elements upward. The passive movement of the passive positioning elements may be caused in other suitable ways, even without a direct connection of the top end to the covering, such as by applying a small degree of upward biasing force on the passive movement elements so that the elements 126 are caused to follow the upward movement of the covering when raised by active positioning elements as well as being pushed downwardly when the active positioning elements move downwardly. The active and passive positioning elements may be positioned in any suitable arrangement. Illustratively, FIG. 24 shows one suitable arrangement of active 124 and passive 126 positioning elements in modules in which the array of elements substantially alternates between the active and passive elements. The illustrative modules 122 include six positioning elements, and each row may include substantially similarly configured modules in similar orientations, with the modules of an adjacent row being rotated approximately 180 degrees to create an pattern of alternating orientations in each column, providing the alternating pattern of active and passive elements without requiring different module configurations.

The apparatus 20 may be configured to selectively lock and unlock the position of the positioning elements, and in particular the passive positioning elements, to maintain a raised position of the elements between movements of the elements to a desired position. Illustratively, the positioning elements, or at least the active positioning elements, may be moved to positons that create the desired contour in the top face 32 of the covering. By virtue of the movement of the covering 30 by the active positioning elements 124, the passive positioning elements 126 may also be moved to positions that abut or contact the bottom face 34 of the covering, such as by attachment of the passive elements to the covering or by an upward bias on the passive elements. The positions of the positioning elements may be locked or secured in the positons that result, thus providing the covering 30 with support at the locations of each of the positioning elements, whether active or passive. When it is desired to change the contour of the covering, requiring a repositioning of the positioning elements, the elements may be released from the locked or secured condition.

The covering support assembly 40 may include a locking assembly 130 for selectively locking the position of at least one of the positioning elements in a selected raised position. In some embodiments, the locking assembly may comprise at least one lock element 132 that is configured to selectively lock at least one of the positioning elements in at least one raised position. In some embodiments, the locking element may engage all of the active and passive positioning elements, and in other embodiments the locking elements may engage the passive positioning elements.

The lock element may comprise a lock plate 134 having at least one aperture 136 with one of the positioning elements 42 being positioned in the aperture, and in some embodiments the pin 50 of the positioning element may extend through the aperture. An aperture may be provided for each of the positioning elements to be locked into position, although this is not critical. The lock plate 134 may have a perimeter edge 138 which forms each of the apertures, and the perimeter edge may define a free area 140 and a lock area 142 within each of the apertures. At least a portion of the lock area may be located in a notch 144 formed in the perimeter edge 138. The lock plate 134 may be laterally movable relative to the positioning elements in order to change a position of the pin 50 of the positioning element in the aperture. The lock plate may thus be movable in a plane that is oriented substantially perpendicular to the longitudinal axes of the positioning elements. The lock plate may be movable relative to the positioning element to thereby move the pin between the free area 140 and the lock area 142 of the aperture, and correspondingly the lock plate may be movable between a lock position (see FIGS. 27, 29 and 31, and the upper positions of FIGS. 28, 30, and 32) and a release position (see FIGS. 25 and 26, and the lower positions of FIGS. 28, 30, and 32). The pin 50 may be positioned in the free area in the aperture 136 when the lock plate is in the release position for a free condition (see FIGS. 25 and 26, and the lower positions of FIGS. 28, 30, and 32) in which the pin is substantially freely movable with respect to the lock plate. The free condition of the pin may be characterized by the pin being substantially free of contact with the perimeter edge 138. The pin is positioned in the lock area of the aperture when the lock plate is in the lock position to create a locked condition (see FIGS. 27, 29 and 31, and the upper positions of FIGS. 28, 30, and 32). The locked condition of the pin is characterized by the perimeter edge of the aperture engaging one of the recesses 146 of the pin in a manner that resists or blocks movement of the pin in a direction substantially parallel to its longitudinal axis.

The pin 50 of the positioning element engaged by the lock element may have a length as well as an exterior surface 148 that extends along at least a portion of the length of the pin. The pin may also have at least one of the recesses formed therein, and may preferably include a plurality of recesses formed in the exterior surface that are arrayed along a portion of the length of the pin and may be substantially uniformly spaced from each other. The recesses may be formed by indentations (see FIGS. 31 and 32) that extend into the exterior surface 148 of the pin, or may be formed between a series of protrusions (see FIGS. 29 and 30) formed on the pin such that the recesses are effectively located between the protrusions.

Figure 2:
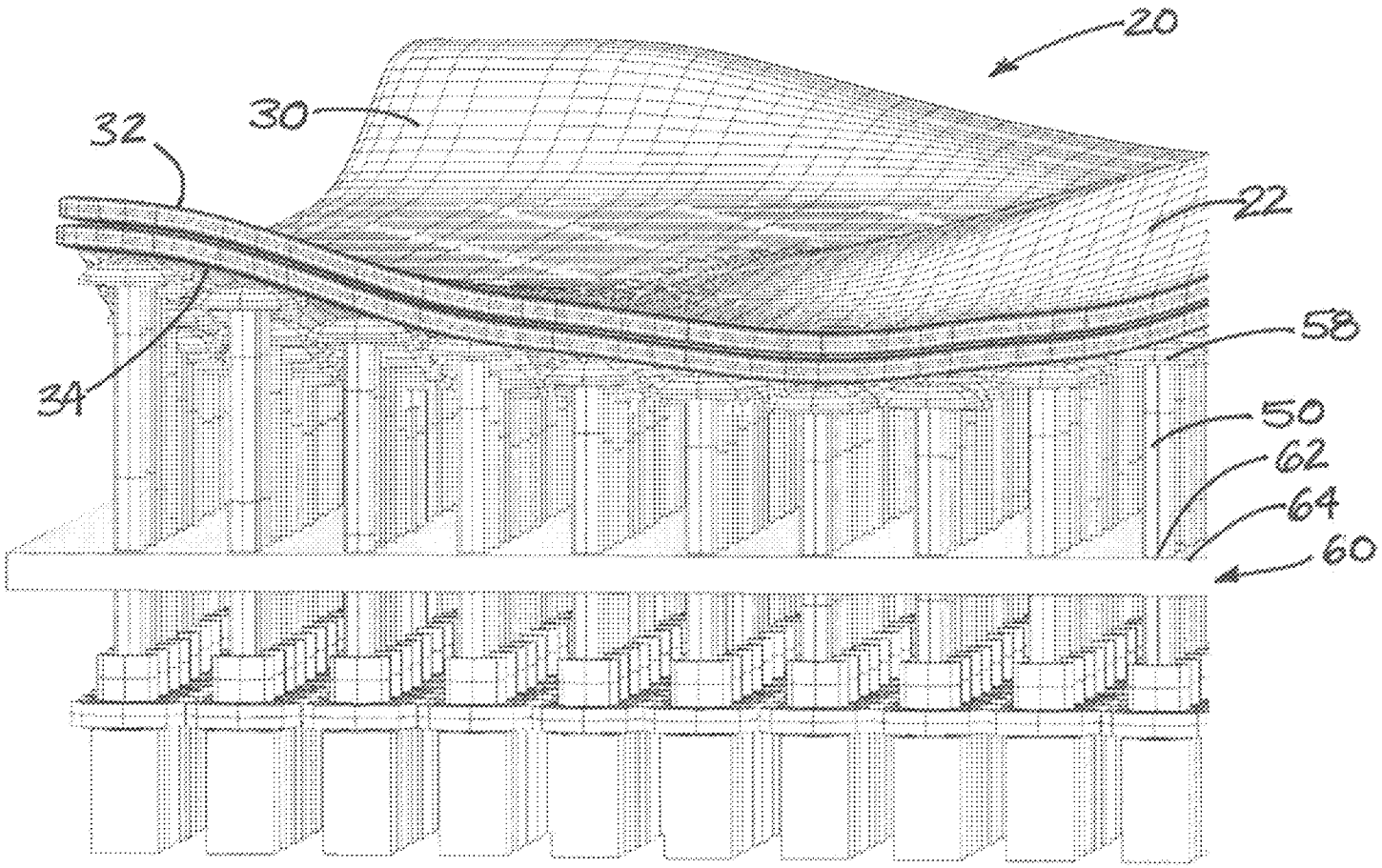
FIG. 2 is a schematic perspective view of the simulation apparatus with the covering in a contoured condition and the support assembly in a raised position.
Figure 33:
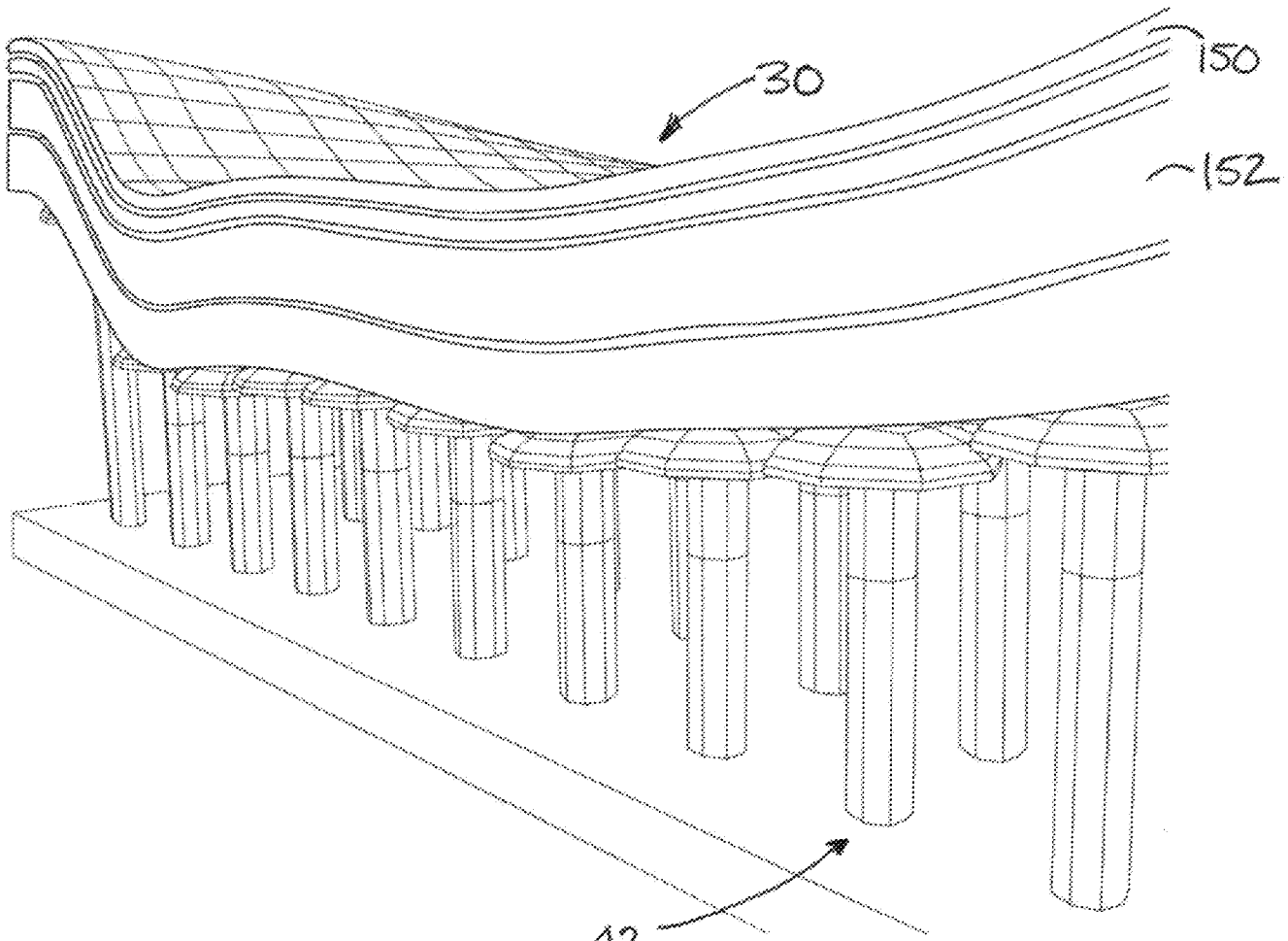
FIG. 33 is a schematic perspective view of an embodiment of the green simulation apparatus showing a covering including a plurality of layers.

In some embodiments, the covering 30 may include only a single layer of material. In other embodiments, such as is shown in FIGS. 1 and 2, and particularly in FIG. 33, the covering may comprise at least two layers 150, 152 which may be stacked upon each other, with at least some of the layers being formed by a continuous membrane. In some of the embodiments, at least two of the layers have different thicknesses, and at least one layer with a relatively thinner thickness may be positioned relatively closer to the top face of the covering, and at least one layer with a relatively thicker thickness may be positioned relatively closer to the bottom face of the covering. In some embodiments, at least two of the layers of the multiple layers may have different flexibility characteristics, although in some embodiments all of the layers may have similar flexibility characteristics. It will be recognized that a difference in flexibility characteristic may be a result of the use of different materials with different characteristics for the different layers, but also may be a result of the layers having different thicknesses, with the thicker layers being generally less flexible than thinner layers of the same material. For example, one or more layers may be formed of a foamed material (e.g., polyurethane foam). As a further example, one of more layers may be formed of a fibrous material, such as a material derived from wood or wood fibers including, but not limited to, those materials that do not have a grain or greater degree of strength in one direction as compared to another direction. Illustratively, medium density fiberboard (MDF) does not have a grain and in thinner thicknesses, such as approximately ⅛ inch (approximately 3 mm), exhibits a sufficient degree of flexibility to be utilized as one of the layers of the covering and may be positioned between or adjacent to layers of foamed (or other) material. The use of a foamed material layer and a fibrous layer material may provide a covering with a highly suitable degree of flexibility and rigidity. Further, a substance may be positioned between the faces of the stacked layers in order to facilitate the slippage of the face of one layer with respect to the opposing face of an adjacent layer. In one illustrative implementation, a dry powder such as talc (e.g., hydrated magnesium silicate) may be utilized to facilitate the slippage of one layer with respect to the adjacent layer.

The array of positioning elements 42 in the covering support assembly 40 may include positioning elements positioned in a central region 154 and positioning elements located in at least one peripheral region 156. The respective regions are oriented with respect to each other in a substantially horizontal direction, and may support corresponding regions of the covering 30. In some embodiments, a pair of the peripheral regions 156 and 157 may be utilized, and the peripheral regions 156, 157 may be located on substantially opposite sides of the central region 154. The central region 154 may include a hole or a hole region. The central region 154 may be elongated and extend between a front 158 of the array of positioning elements to a rear 159 of the array. For the purposes of this description, the rear 159 of the array may be located relatively closer to the screen 12 in systems 10 that include a screen 12, and the hole or hole region may be located towards the rear 159, while the front 158 may be located relatively opposite of the rear 159 and may be relatively further away from the screen 12 and may be located closer to where a user stands when utilizing the apparatus. The peripheral regions 156, 157 may extend generally between the front 158 and the rear 159 of the array in locations lateral to the central region 154.

Figure 34:
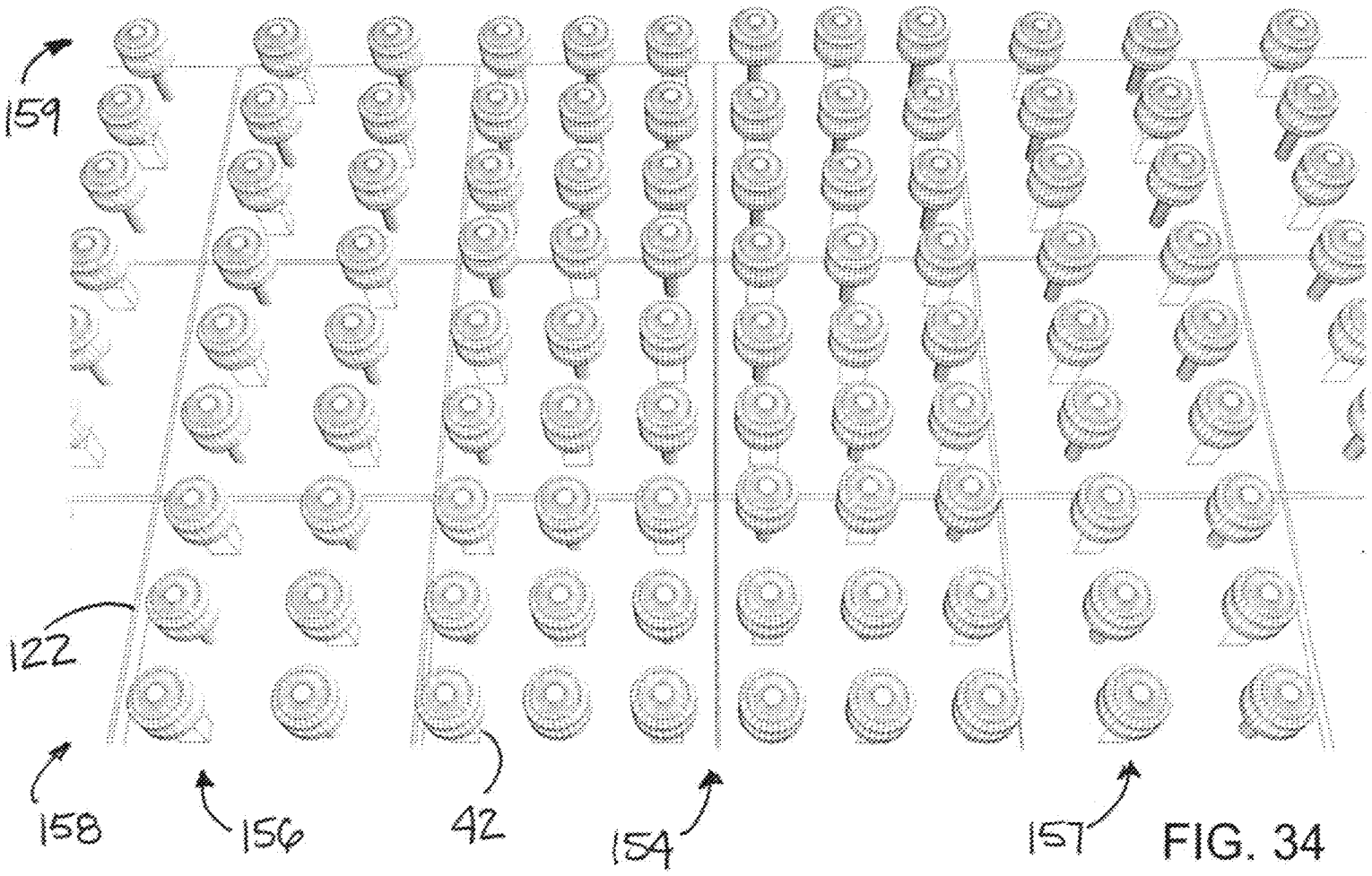
FIG. 34 is a schematic perspective view of an illustrative embodiment of the green simulation apparatus with the covering removed to show the plurality of positioning elements in an arrangement having a varying density.
Figure 35:
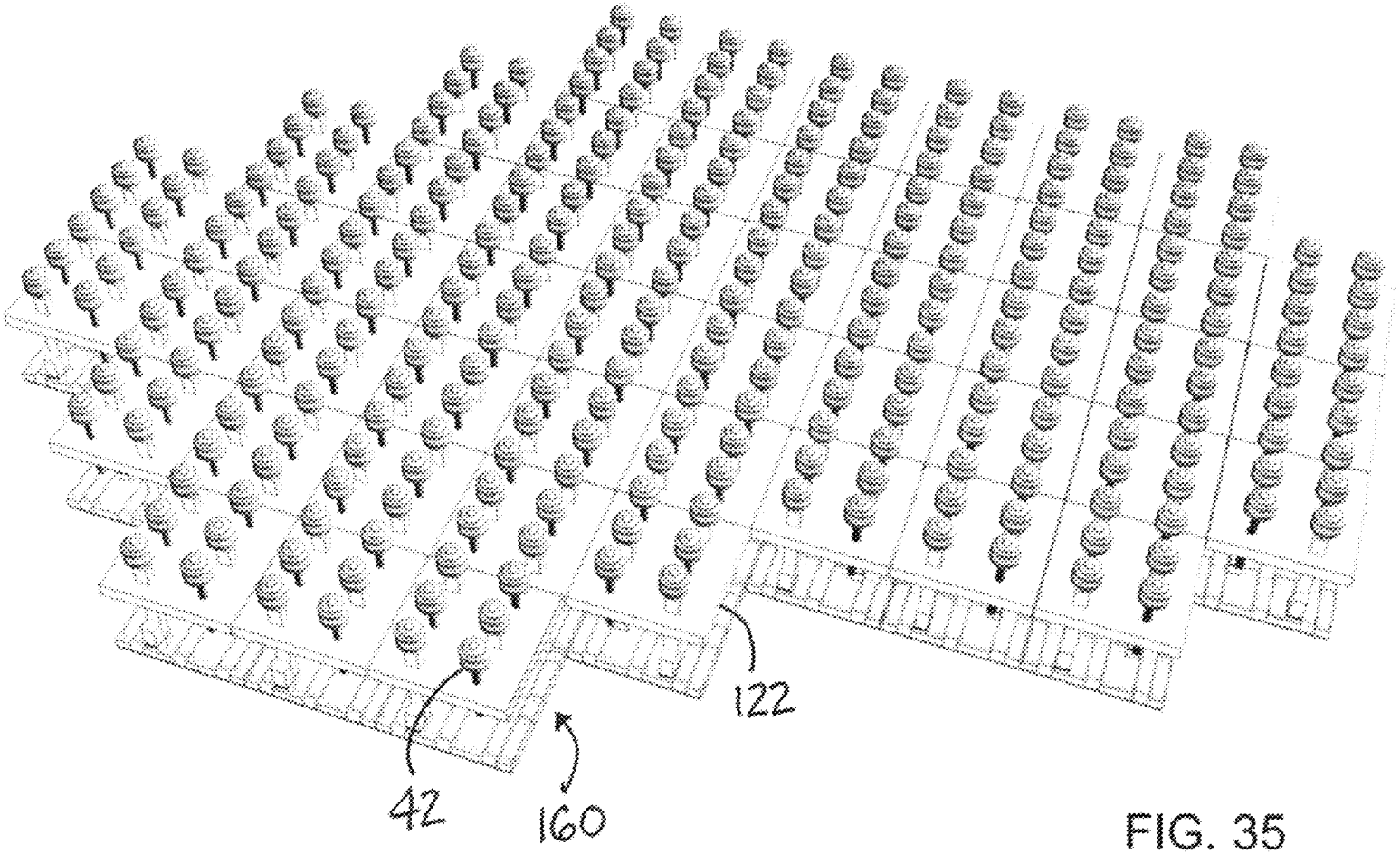
FIG. 35 is a schematic perspective view of an illustrative embodiment of the green simulation apparatus with the covering removed in which an array of modules of the positioning elements is arranged with irregular outer perimeter of the apparatus.
Figure 36:
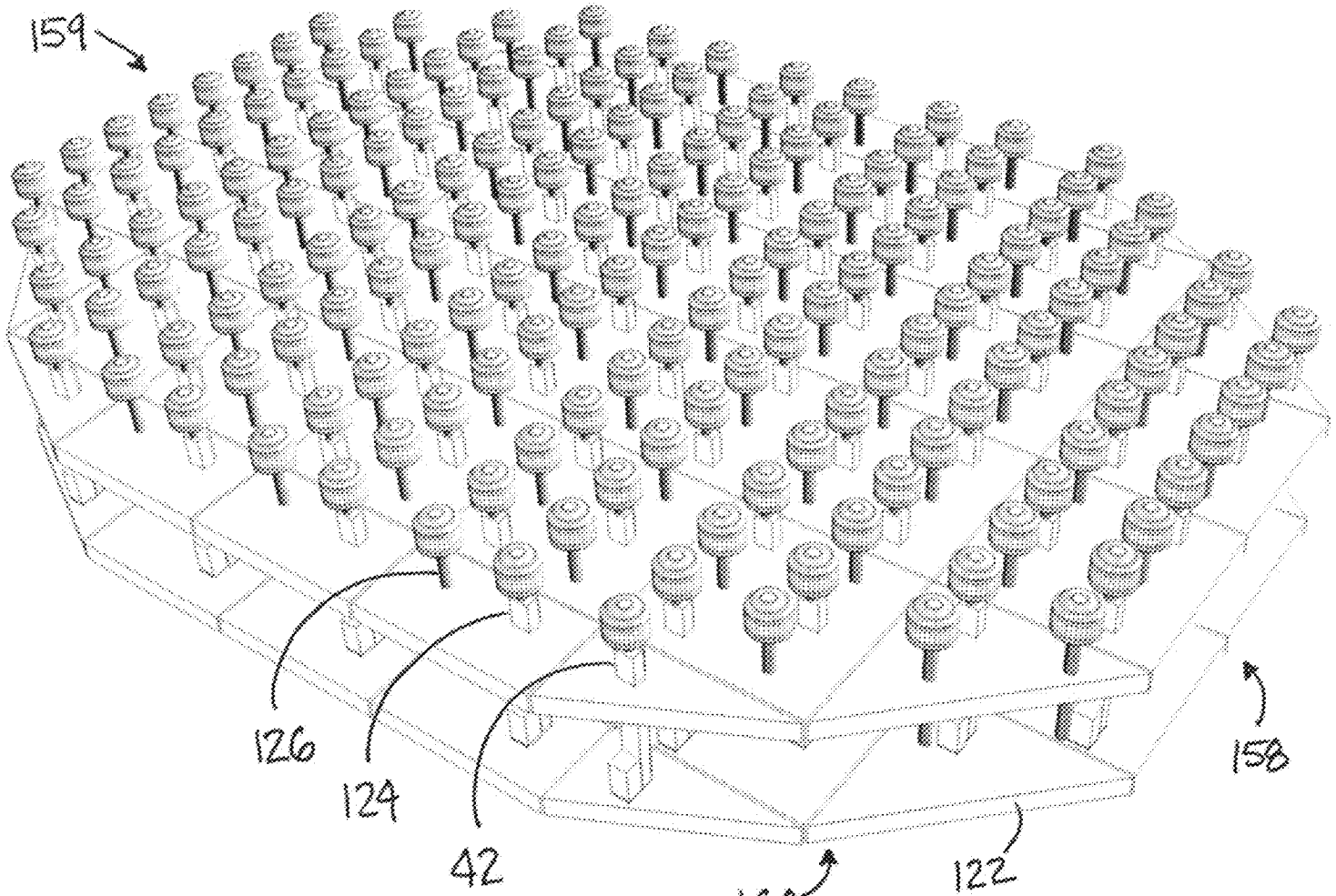
FIG. 36 is a schematic perspective view of an illustrative embodiment of the green simulation apparatus with the covering removed in which an array of modules of the positioning elements are arranged with smaller and/or irregularly shaped modules are positioned along the outer perimeter of the apparatus.
Figure 37:
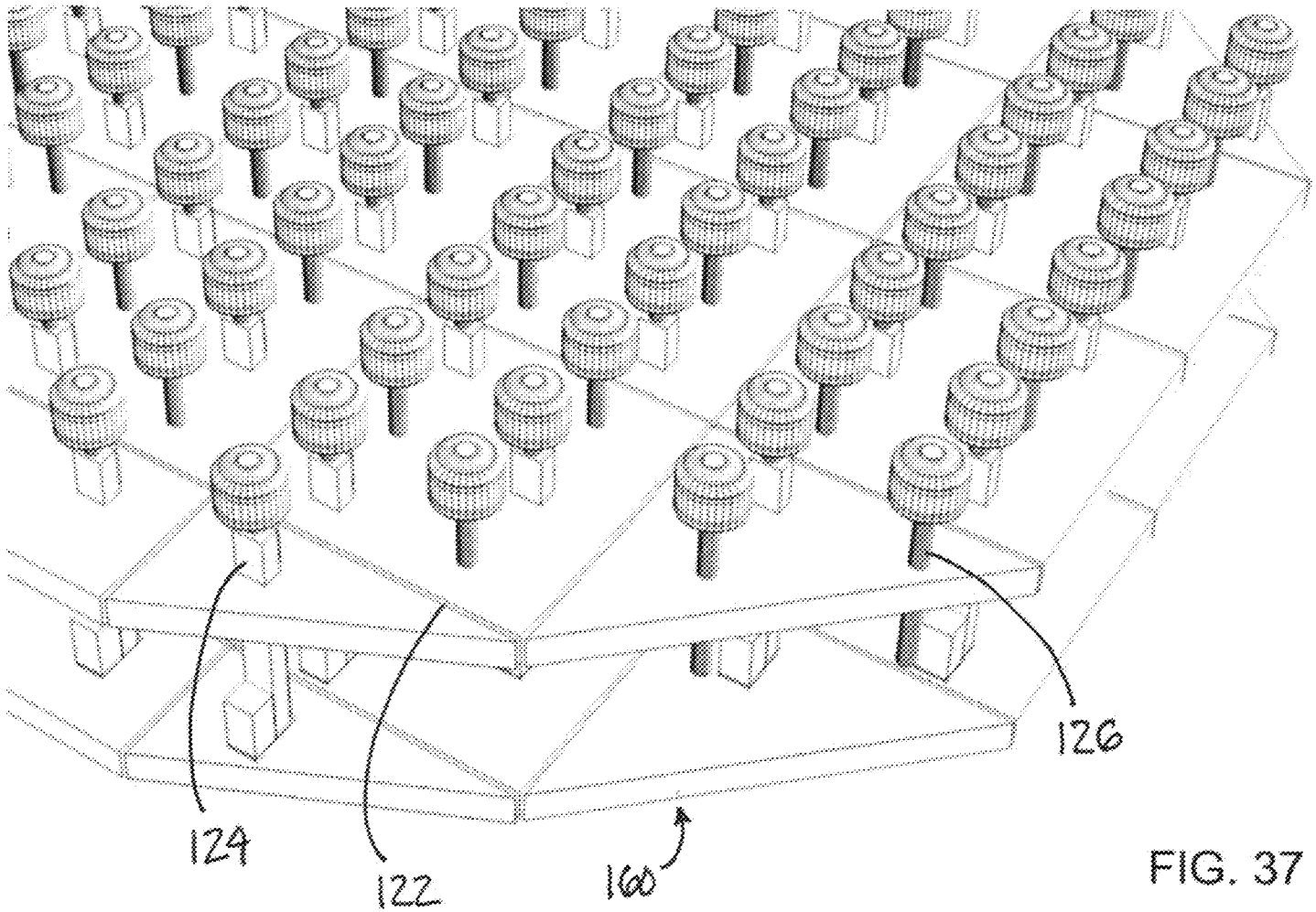
FIG. 37 is a schematic perspective view of an enlarged portion of the embodiment of the green simulation apparatus of FIG. 36.
Figure 38:
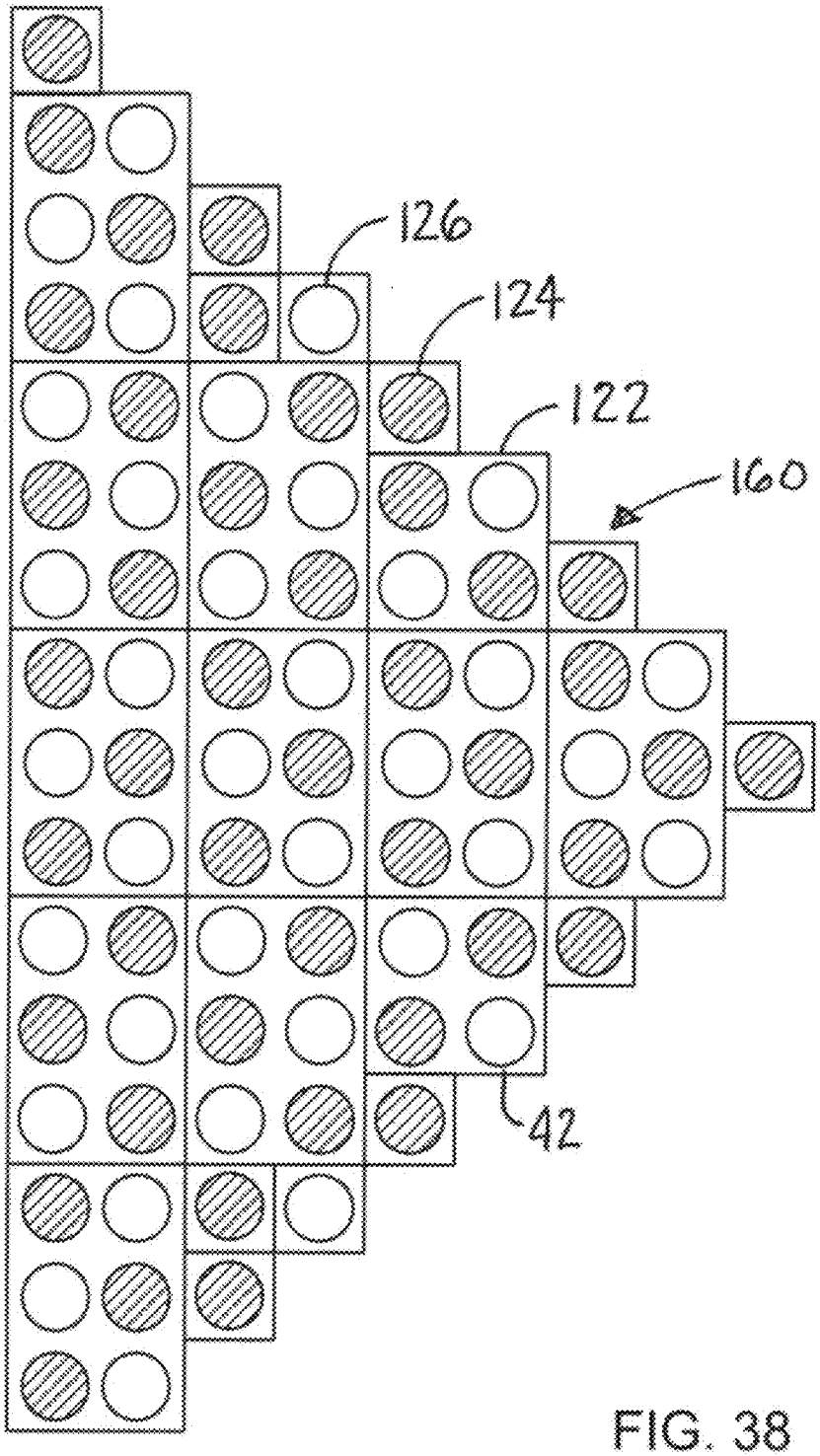
FIG. 38 is a schematic top diagrammatic view of an array of modules with positioning elements having modules with different sizes and irregular shapes and showing an illustrative pattern of active and passive positioning elements, according to an illustrative embodiment.

In some embodiments, a variation in the spacing between adjacent positioning elements in the array may be employed to produce a variation in the density of the positioning elements (see, e.g., FIG. 34). Illustratively, a positioning element 42 may be located at a spacing distance from an adjacent positioning element 42. The spacing distance between a pair of adjacent positioning elements in one region may be different than the spacing distance between a pair of positioning elements in another region. As a result, regions of the array in which the spacing distance is relatively greater will have a lesser density of positioning elements and regions in which the spacing distance is relatively smaller will have a higher density of positioning elements. Regions in which greater control of the upper surface contouring may have a relatively greater density of elements 42, while regions in which lesser control of the upper surface contouring is needed may employ a relatively lesser density of the elements 42. In some embodiments, the relative density of positioning elements in the array may be relatively greater or denser in the central region 154 than the density of positioning elements in the peripheral region or regions.

The array of positioning elements may have an outer perimeter 160 which may be located relatively adjacent to the periphery 24 of the upper surface of the apparatus. In some embodiments, the outer perimeter of the array may be relatively rectangular in shape, although in other embodiments the outer perimeter may be non-rectangular, or irregular, in shape (see, e.g., FIGS. 35 through 38). Portions of the outer perimeter 160 may be formed by modules having different arrangements of positioning elements, including different numbers of positioning elements. The peripheral modules may include different numbers of active and passive positioning elements and different patterns of active and passive positioning elements.

Figure 39:
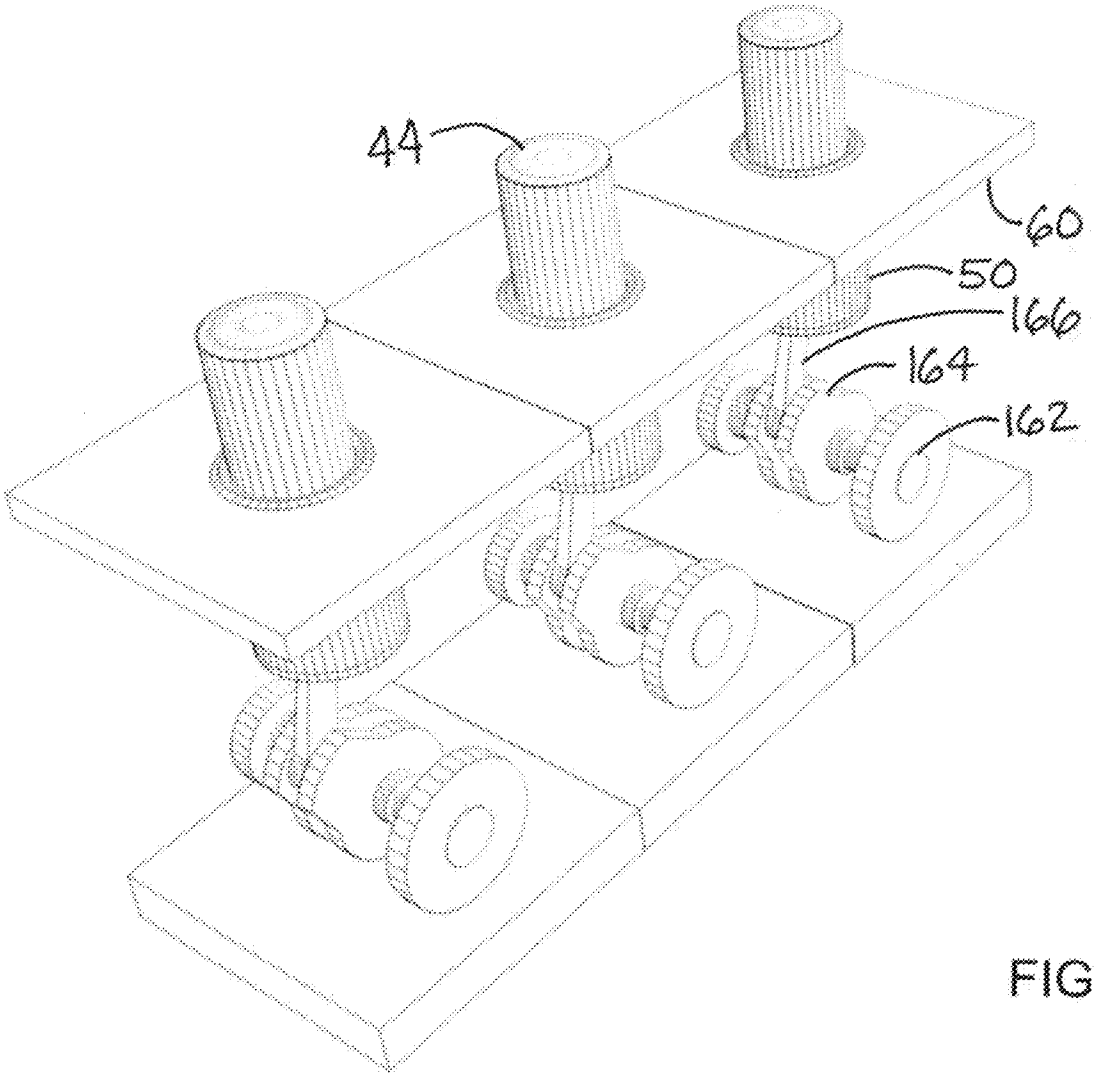
FIG. 39 is a schematic perspective view of an optional embodiment of the positioning elements of the covering support assembly, according to an illustrative embodiment.
Figure 41:
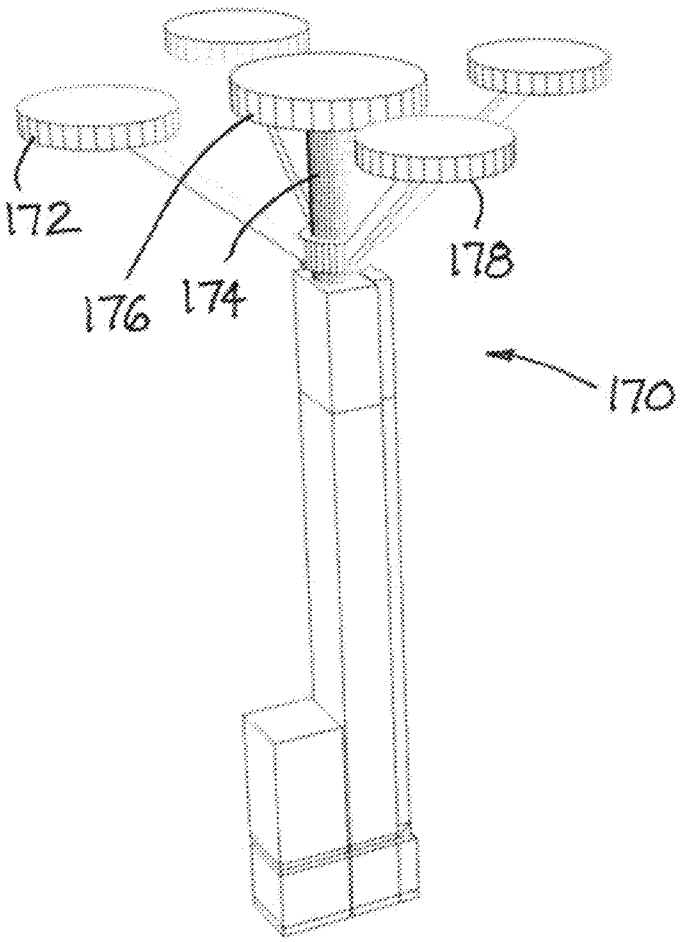
FIG. 41 is a schematic perspective view of an optional embodiment of the positioning elements of the covering support assembly, according to an illustrative embodiment.
Figure 40:
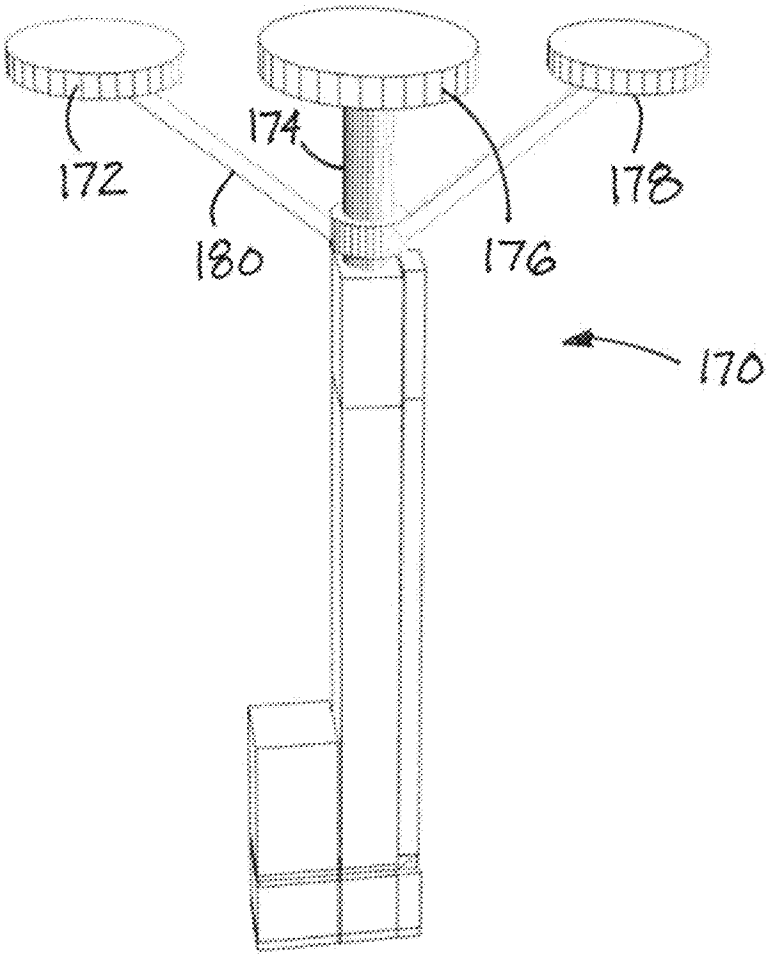
FIG. 40 is a schematic perspective view of an optional embodiment of the positioning elements of the covering support assembly, according to an illustrative embodiment.
Figure 42:
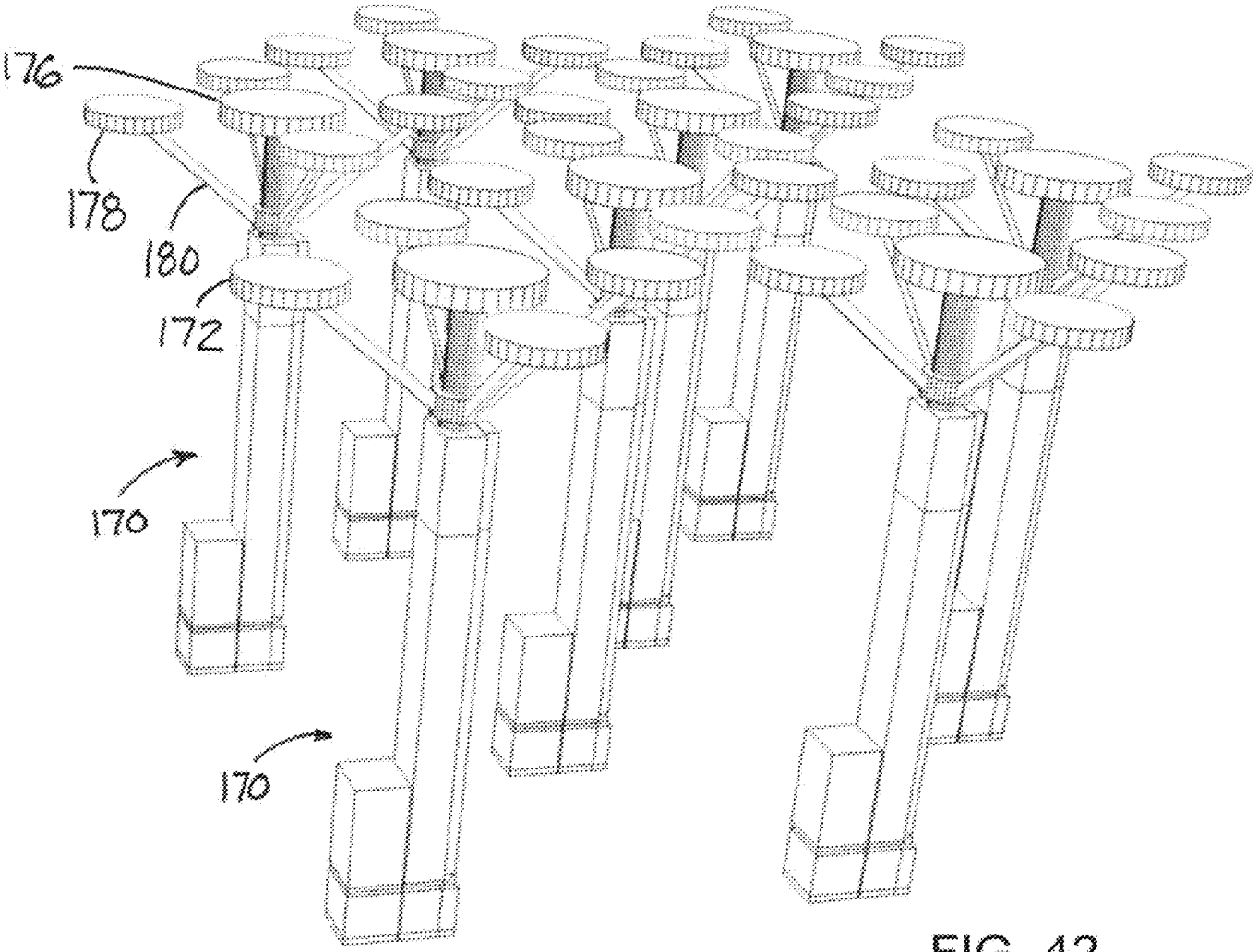
FIG. 42 is a schematic perspective view of a plurality of positioning elements of the covering support assembly similar to the embodiment of FIG. 41, according to an illustrative embodiment.

An optional embodiment of the movement actuator 70 (see, e.g., FIG. 39) may comprise a rotary shaft 162 that may extend in a direction oriented substantially perpendicular to a longitudinal axis and associated positioning element. In some embodiments, the rotary shaft 162 may generally extend in a horizontal plane. The rotary shaft may include an offset section 164 which is generally offset from a longitudinal axis of the rotary shaft about which the shaft rotates. The movement actuator may further include a connecting element 166 which connects the offset section 164 of the rotary shaft to the pin 50 of the associated positioning element such that rotation of the rotary shaft moves the pin in a vertical direction by virtue of the eccentric motion of the offset section of the rotary shaft.

In additional embodiments of the apparatus, such as shown in FIGS. 40 through 45, various optional configurations of the positioning element may be employed. Illustratively, a positioning element 170 may include a plurality of heads 172 which is supported on a single pin 174 (see, e.g., FIGS. 40 and 41). The heads 172 may be spaced from each other, and the top surface 58 of the each head of the plurality of heads may be substantially coplanar with each other although some variance in the degree of coplanar character may be employed. The heads 172 of the plurality may be positioned in a regular arrangement with respect to each other, such that the heads are positioned at apexes of a regular polygon. The heads of the positioning element may also be in an equally-spaced arrangement with respect to each other, and also with respect to the heads of adjacent positioning elements 170 (see, e.g., FIG. 42) in a grouping of positioning elements. The heads 172 of the positioning element may include a central head 176 and at least two peripheral heads 178. The central head 176 may be positioned at the top end of the pin 174, and the peripheral heads 178 may be arranged about the central head in a configuration such that the central head is generally positioned central to the peripheral heads although irregular arrangements may be employed. In the illustrative embodiments, the number of peripheral heads may include two, three, four, or more peripheral heads. A head support 180 may extend between the pin 174 and one of the peripheral heads 178. The head support 180 may be mounted on the pin 174 at a location between the top end and bottom end of the pin, and may extend radially outwardly from the pin toward the peripheral head. In some embodiments, the head support 180 may be inclined upwardly and outwardly from the pin toward the peripheral head 178, and may be in a substantially cantilevered arrangement with respect to the pin. The head support 180 may be substantially rigid, but in some embodiments may also have a degree of flexibility.

Figure 43:
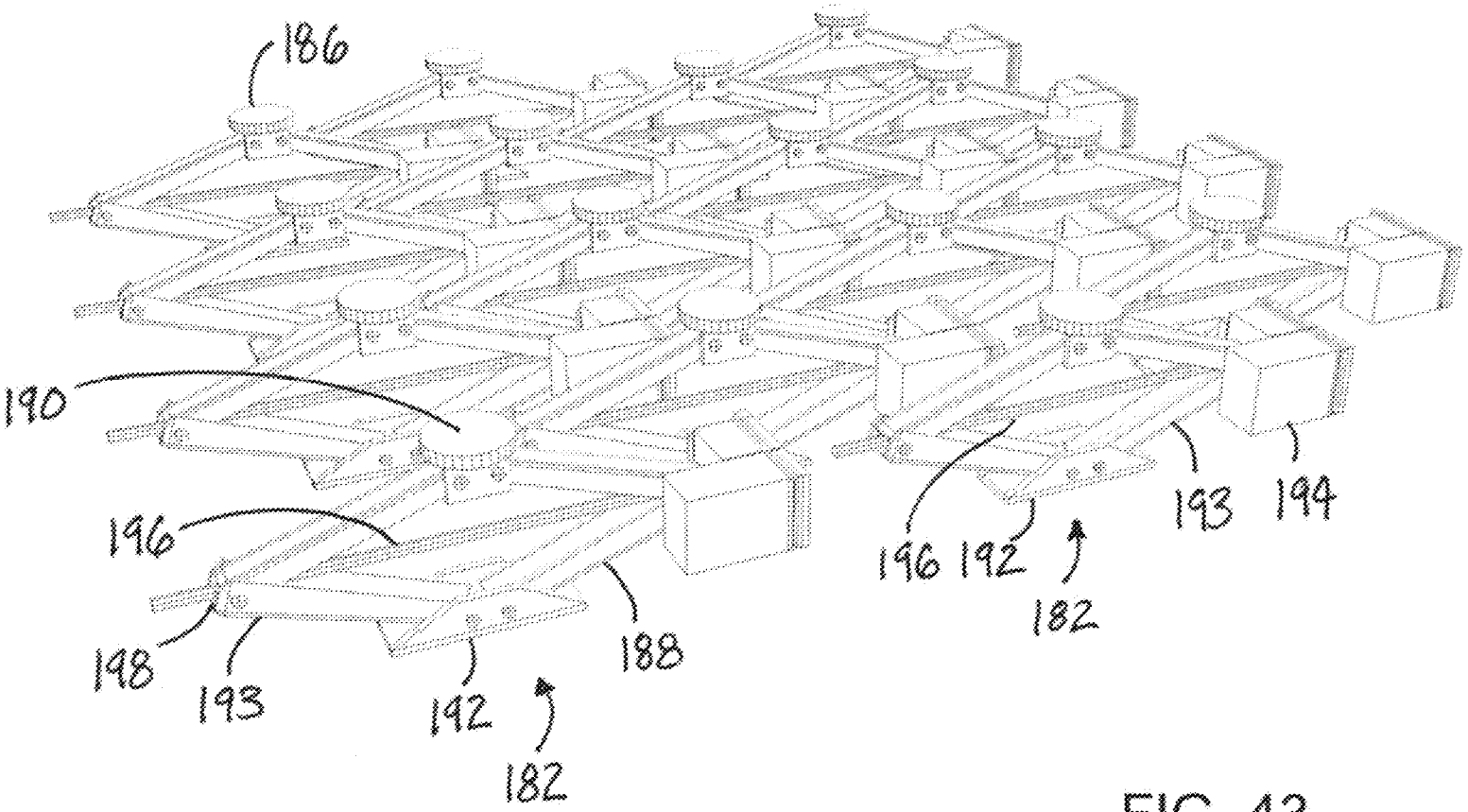
FIG. 43 is a schematic perspective view of a plurality of positioning elements of the covering support assembly, according to another illustrative embodiment.
Figure 44:
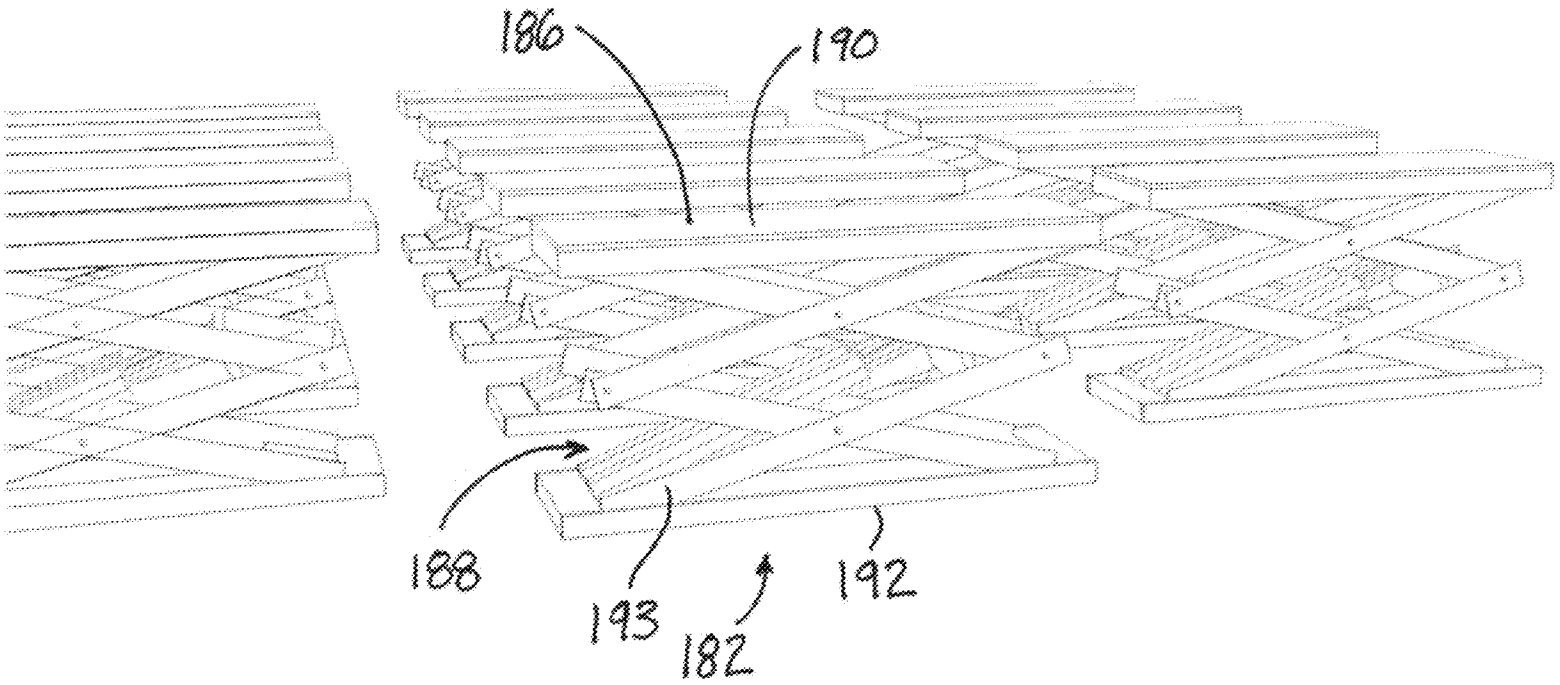
FIG. 44 is a schematic perspective view of a plurality of positioning elements of the covering support assembly, according to another illustrative embodiment.

In embodiments of the positioning elements, such as shown in FIGS. 43 and 44, a position element 182 may include a head 186 and a support frame 188 which is configured to raise and lower the vertical level of the top surface 190 of the head. The support frame 188 may be mounted on a bottom member 192 such that the support frame is generally positioned between the head 186 and the bottom member 192. The support frame may include a plurality of frame members 193 which may be pivotally connected to each other in a scissors arrangement. The frame members 193 may be pivotally mounted on the head 186 and on the bottom member 192 to facilitate a scissors movement of the frame members. A movement actuator 194 may be configured to move the frame members with respect to each other to increase a relative distance between the head and bottom member to raise the vertical level of the top surface of the head, and may also be configured to move the frame members with respect to each other to decrease a distance between the head and the bottom member to thereby lower the vertical level of the top surface of the head. The movement actuator 194 may rotate a threaded rod 196 which is threaded into a pivot nut 198 located at a joint between the frame members 193 of the support frame. Illustratively, the head 186 may have a circular perimeter shape (see, e.g., FIG. 43) or a rectangular perimeter shape (see, e.g., FIG. 44), and may also have an elongated shape.

Figure 45:
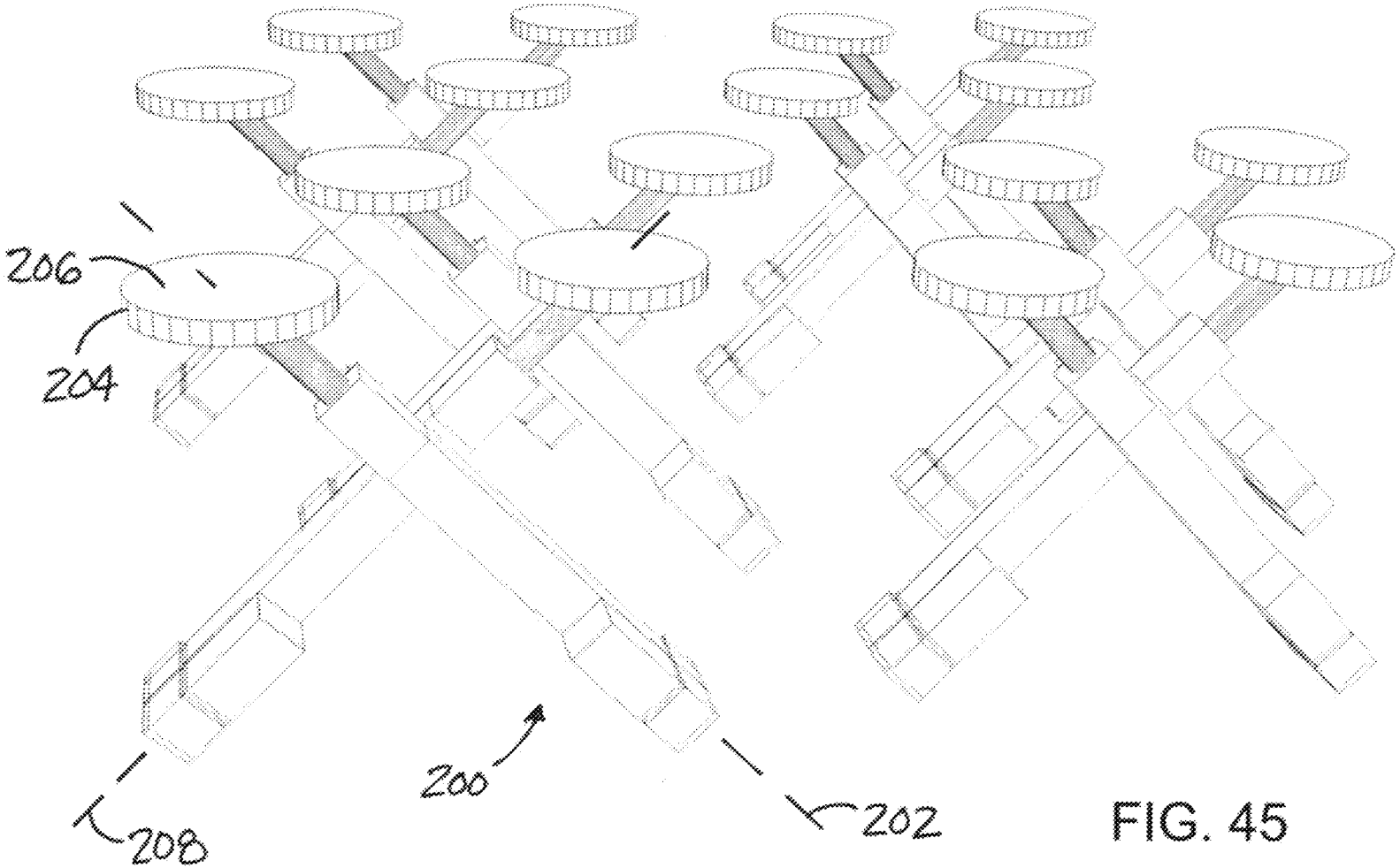
FIG. 45 is a schematic perspective view of a plurality of positioning elements of the covering support assembly, according to another illustrative embodiment.
Figure 46:
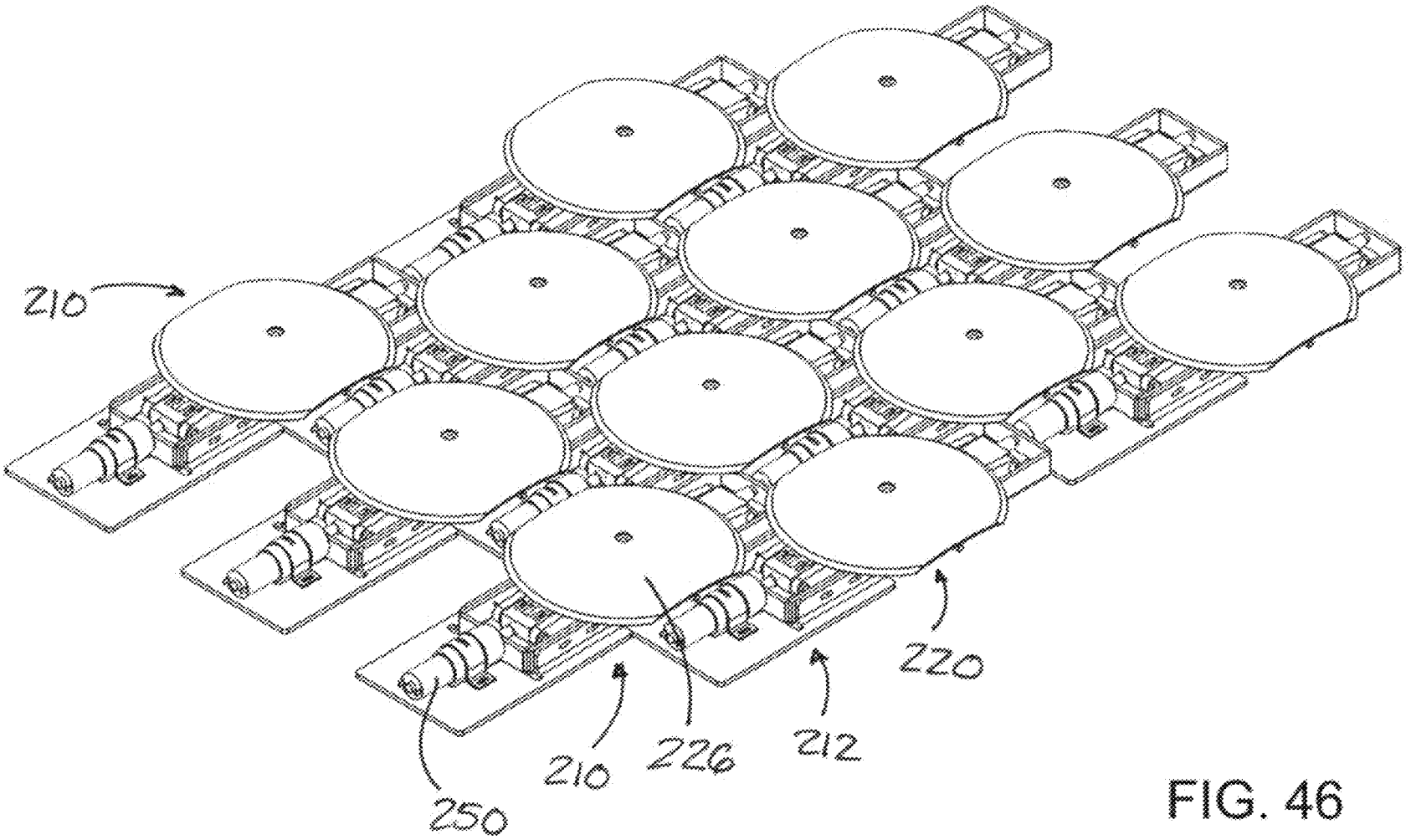
FIG. 46 is a schematic perspective view of another embodiment of the apparatus with a plurality of positioning elements of the covering support assembly shown primarily in a lowered condition.
Figure 47:
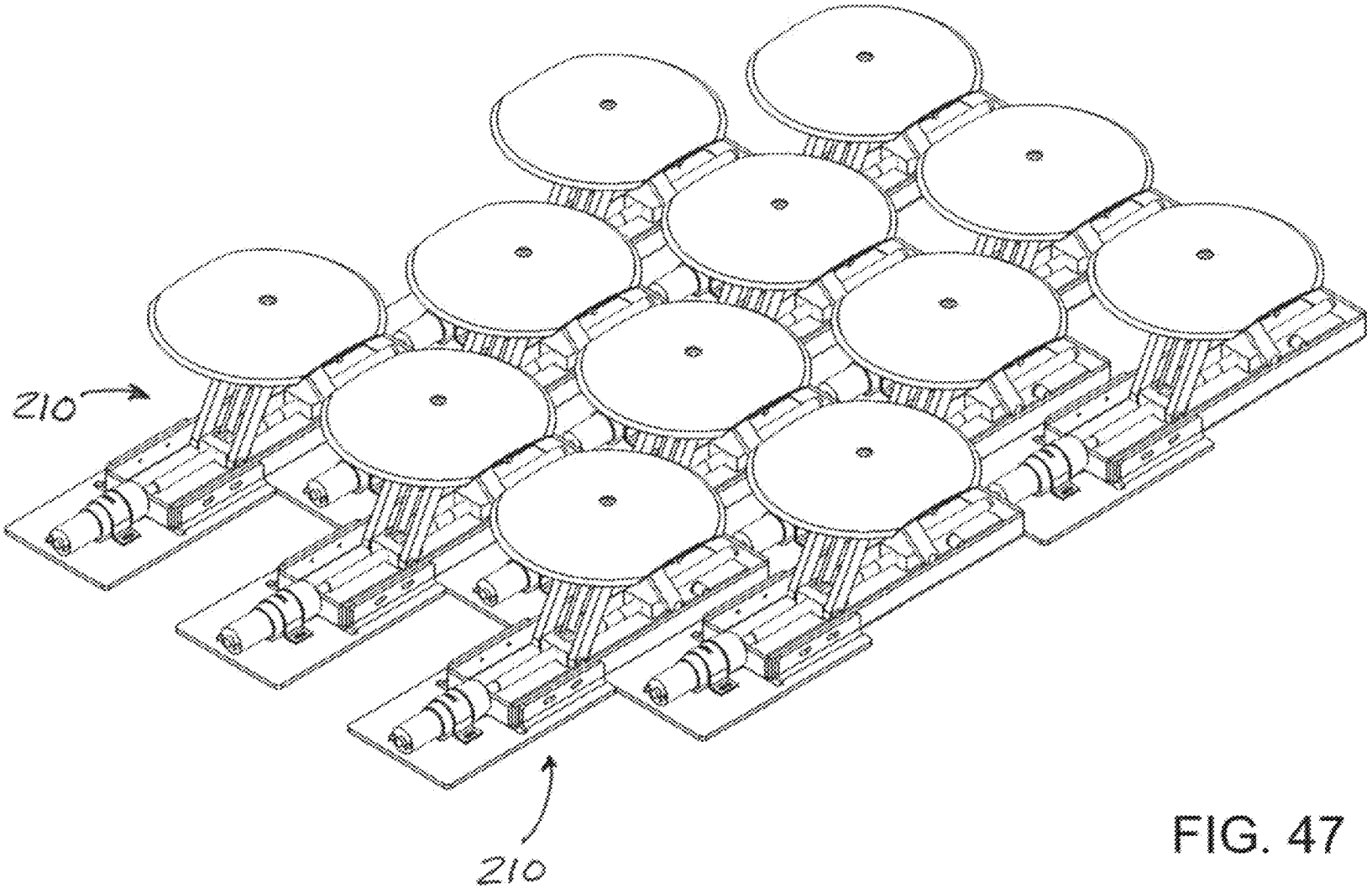
FIG. 47 is a schematic perspective view of the embodiment of the apparatus shown in FIG. 46 with the plurality of positioning elements shown primarily in a raised position.
Figure 48:
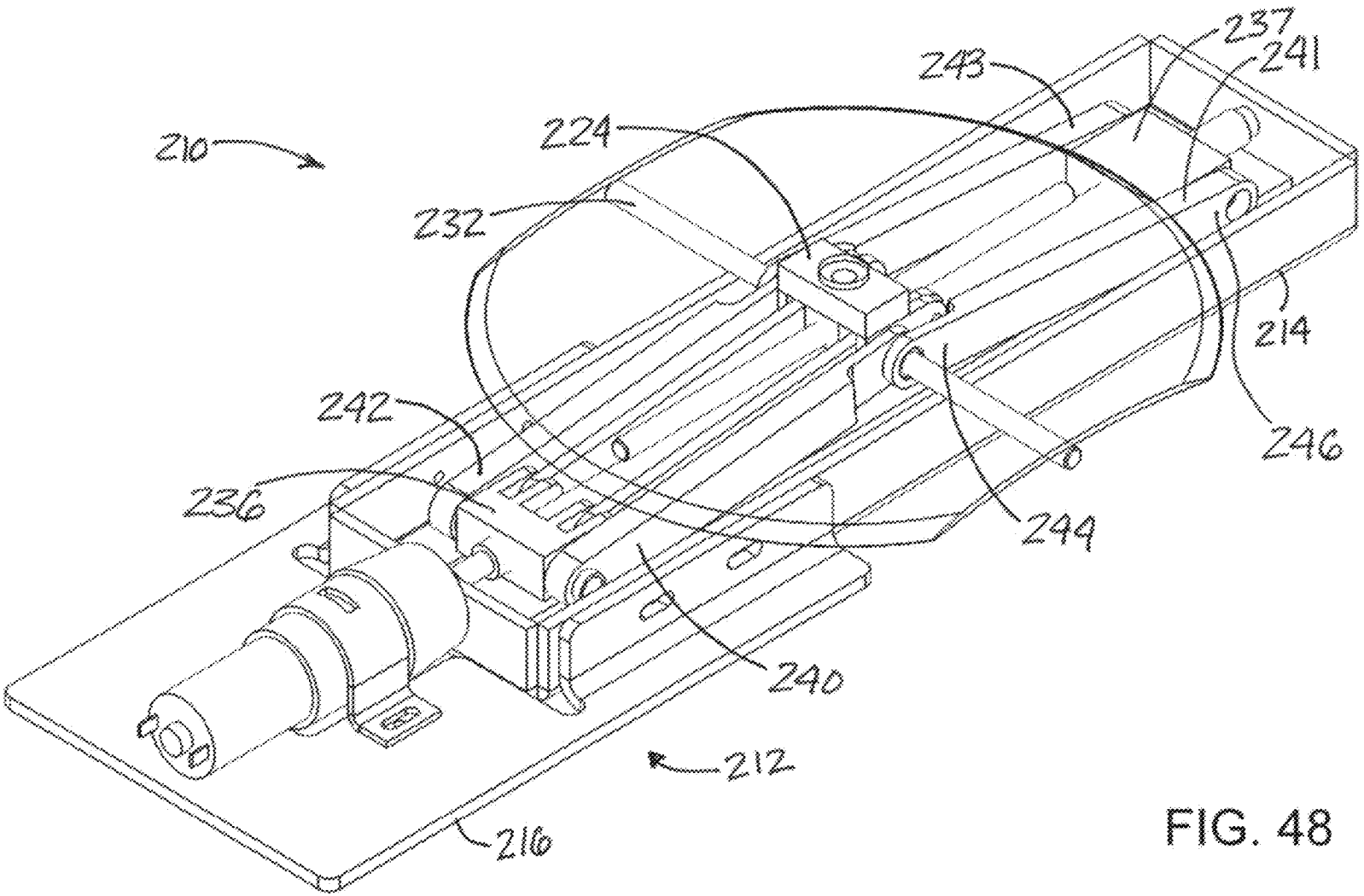
FIG. 48 is a schematic perspective view of one of the positioning elements of the embodiment of the apparatus of FIG. 46 shown in a lowered position.
Figure 49:
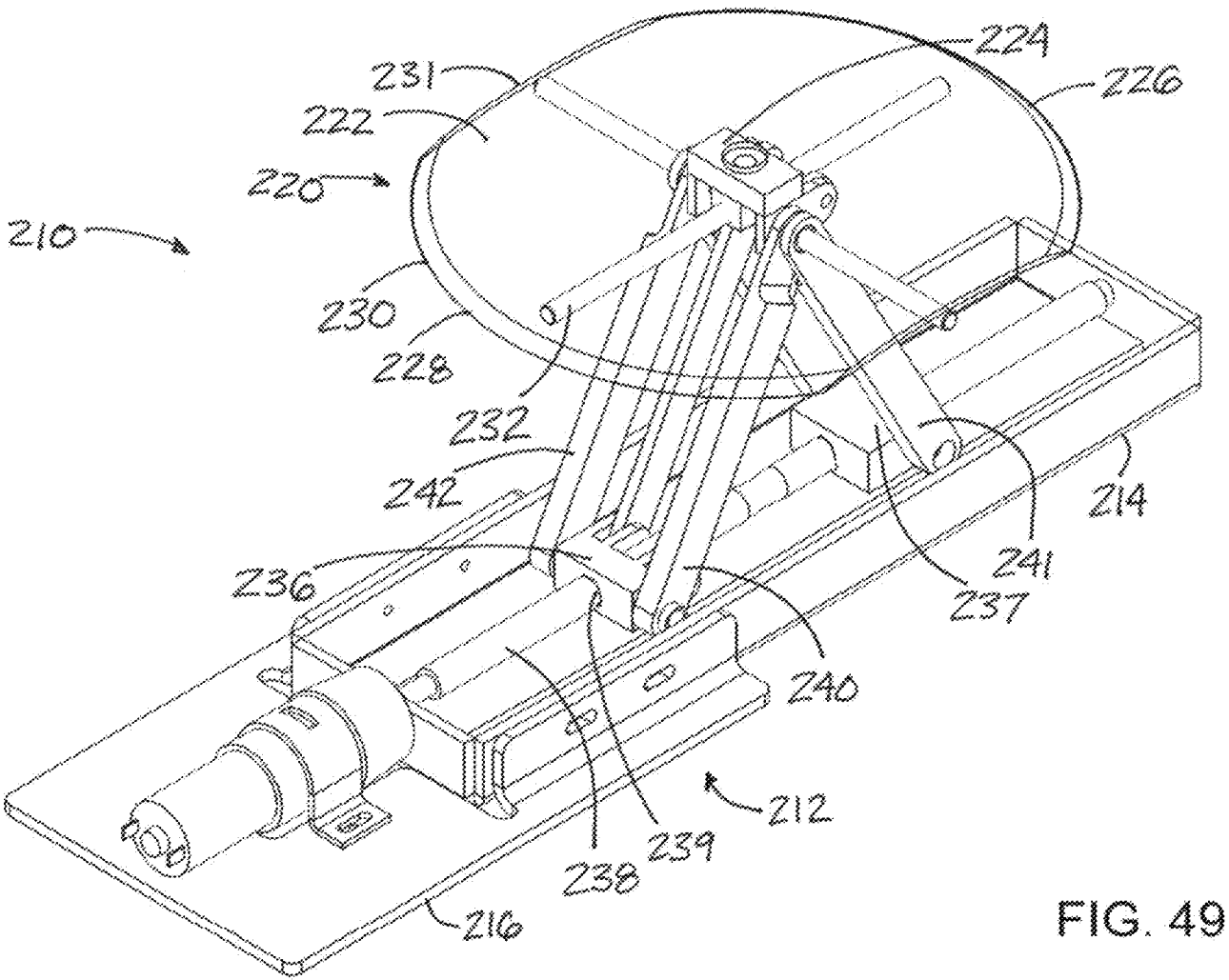
FIG. 49 is a schematic perspective view of one of the positioning elements of the embodiment of the apparatus of FIG. 46 shown in a raised position.
Figure 50:
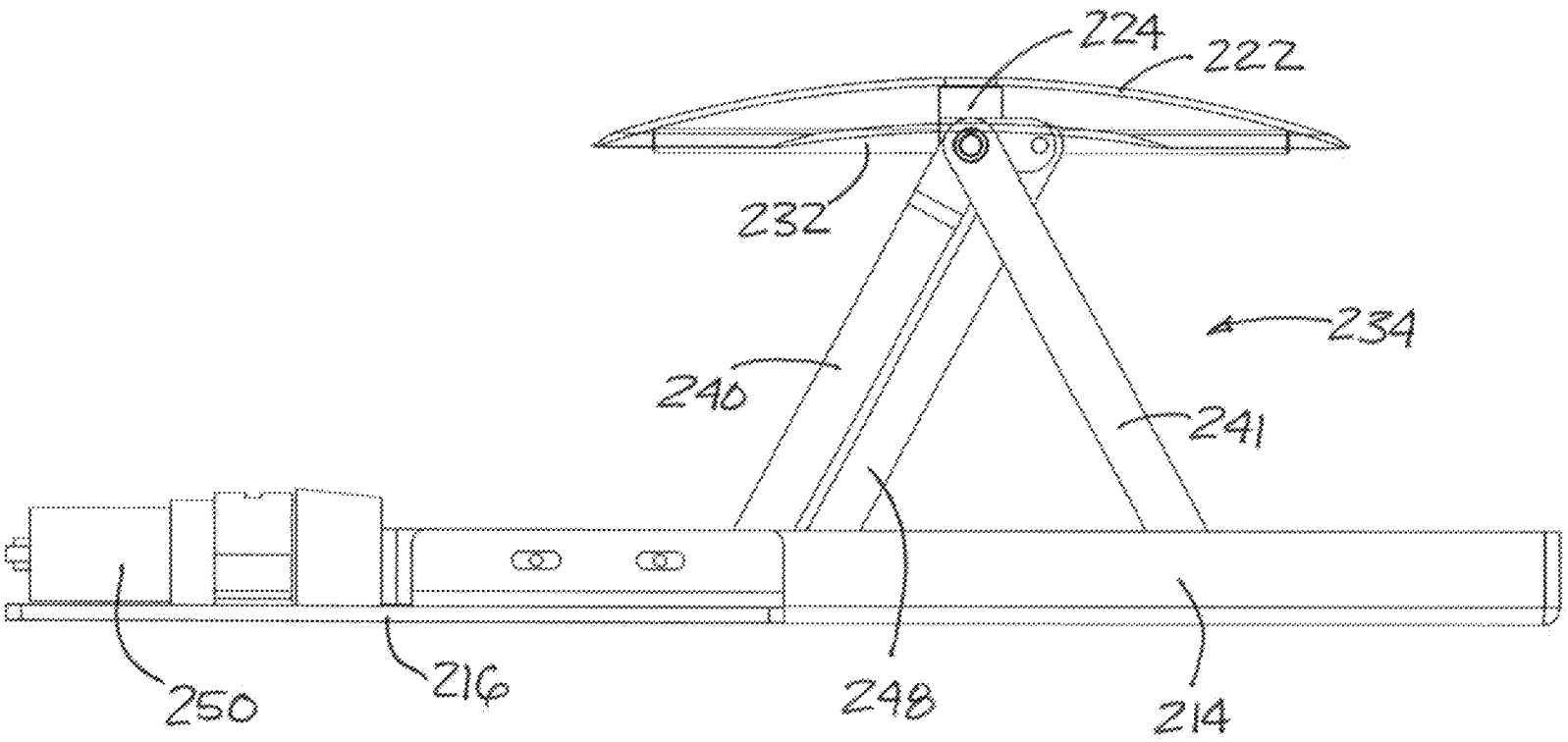
FIG. 50 is a schematic side view of one of the positioning elements of the embodiment of the apparatus of FIG. 46 shown in a raised position.
Figure 51:
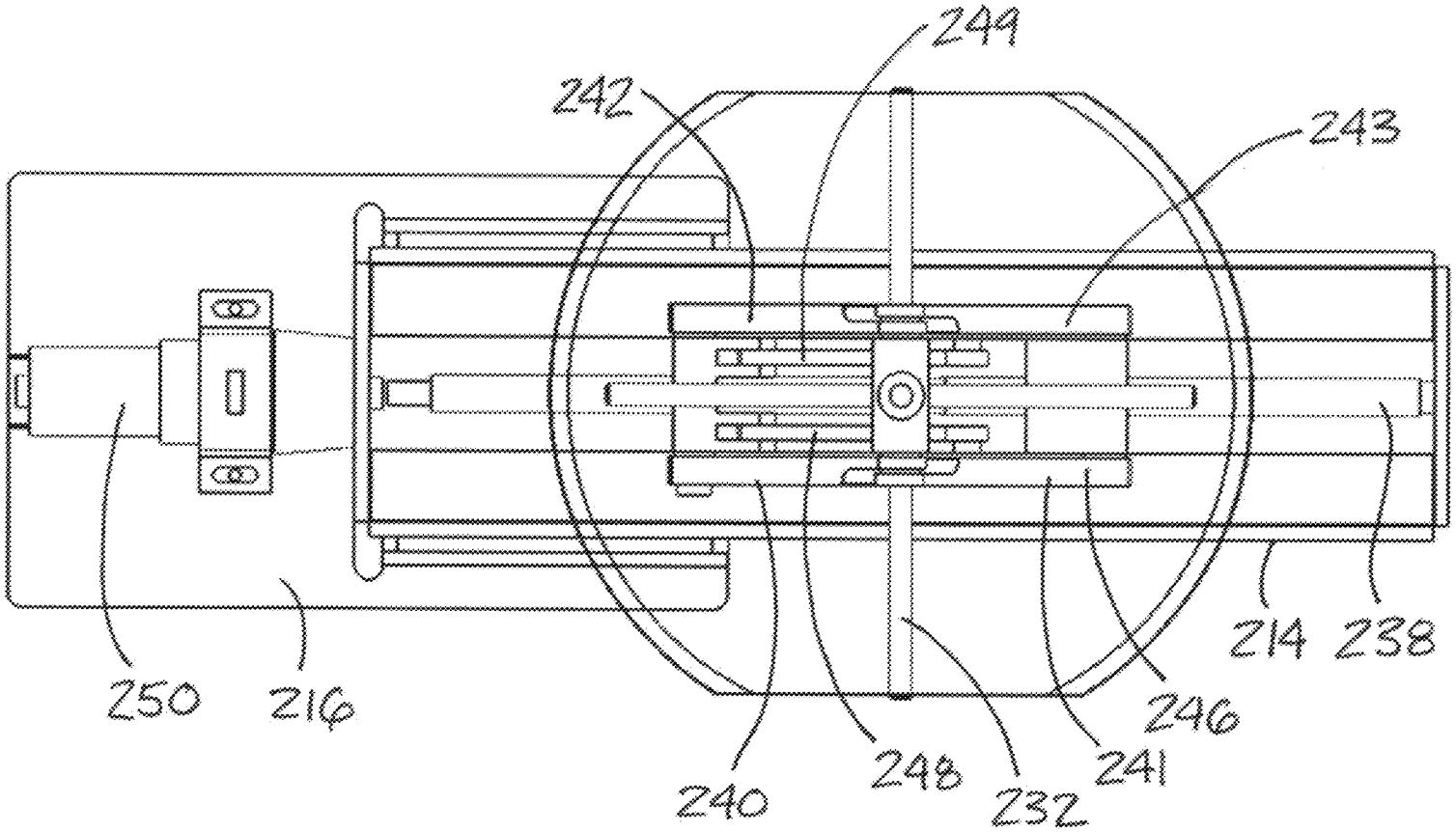
FIG. 51 is a schematic top view of one of the positioning elements of the embodiment of the apparatus of FIG. 46 shown in a raised position.

In still other embodiments, such as shown in FIG. 45, a positioning element 200 may be tilted or inclined from an orientation substantially perpendicular to the reference plane of the apparatus. The positioning element 200 may have an axis 202 which is oriented at an oblique angle, or a non-parallel angle and/or non-perpendicular angle, to the reference plane. Optionally, the angle of the axis 202 may be from approximately 30 degrees to approximately 60 degrees with respect to the reference plane. The positioning element 200 may have a head 204 with a top surface 206, and the top surface may extend in a plane that is skewed with respect to the axis 202 of the positioning element, and the top surface 206 may be oriented in a plane that is substantially parallel to the reference plane. The pin of the positioning element 200 may move the head 204 along the axis 202. In some embodiments, an axis 208 of another positioning element may be oriented substantially perpendicular to the axis 202 of the positioning element 200. A grouping of the positioning elements may include elements arranged in an alternating manner of opposite tilt orientations.

In further embodiments, such as those shown in FIGS. 46 through 51, a positioning element 210 is disclosed with a design that minimizes the vertical profile of the element 210 while providing a significant degree of vertical adjustment movement between lowered and raised position. The positioning element 210 may be positioned in an array of elements that may be used to support a covering as disclosed herein. In greater detail, the positioning element 210 may include a bottom element 212 which may typically be positioned on a lower surface or support, and which in turn may include a bottom frame 214 and a bottom plate 216.

The positioning element 210 may also include a head 220 which is movable with respect to the bottom elements 212, generally in a vertical direction with respect to the bottom element although other directions of movement may be utilized. The head 220 may have a top surface 222 on which a portion of the cover may be rested. In some embodiments, the head 220 may include a support block 224 and a support disk 226 which has the top surface. The support disk may be positioned above the support block and the support block may be substantially centrally located with respect to the support disk. The support disk 226 may have a perimeter 228, and the perimeter may have a generally circular shape with arcuate portions 230. The perimeter 228 may also have linear portions 231 that truncate the generally circular shape of the perimeter and may increase the density of the positioning elements in the array. The arcuate portions 230 may be positioned at opposite locations on the perimeter from each other, and the linear portions may be positioned at opposite locations of the perimeter with respect to each other. It should be recognized that other perimeter shapes may be employed.

The support disk 226 may be relatively thin in configuration and in some embodiments may be formed of a rigid material, but may also be formed from a flexible or pliable material. The disk may be mounted on the support block 224 at substantially the center of the disk, with the radially outward portions of the disk having a degree of upward and downward deflection possible, such as from flexure of a flexible material forming the disk or from pivoting of a substantially rigid disk on a pivot. To help support the disk against excessive downward deflection, the head 220 may include at least one deflection peg 232 positioned below the disk to restrict downward deflection of the support disk when a portion of the disk has moved downwardly sufficiently to close a gap between the disk and the peg which is normally spaced from a lower surface of the disk. The deflection peg 232 may be mounted on the support block and may extend outwardly from the support block toward the perimeter of the support disk. In some embodiments, four deflection pegs 232 are employed and extend from the support block in different directions, such as directions separated by 90 degrees.

The positioning element 210 may also include a support frame 234 which is configured to raise and lower the vertical level of the head 220 by increasing and decreasing the distance between the head and the bottom element. The support frame 210 may be mounted on the bottom elements 212 such that the support frame is generally positioned between the head and the bottom element. The support frame 234 may comprise at least one support nut 236 which is mounted on an actuating rod 238. The actuating rod 238 may pass through an aperture 239 in the support nut 236. The actuating rod 238 may have external threads, and the external threads of the rod may engage a threaded surface on the aperture 239 such that rotation of the rod translates (or moves in a linear manner) the support nut. A pair of support nuts 236, 237 may be utilized and may comprise a first support nut 236 and a second support nut 237. Each support nut may have a threaded aperture through which a portion of the threaded actuating rod may pass to increase the area of the bearing of the rod on the support nuts. The threading of the apertures of the nuts and the actuating rod may be configured such that rotation of the actuating rod moves the support nuts toward each other or away from each other depending upon the direction of rotation of the actuating rod. The support nuts may be positioned in the bottom frame 214 of the bottom element 212 to move in a substantially horizontal plane of the bottom frame.

The support frame 234 may include a plurality of frame members 240, 241 which are connected in a pivoting arrangement. Each of the frame members may have upper 244 and lower 246 ends. The upper ends 244 may be positioned toward the head 220 and the lower ends may be positioned toward the bottom element. The upper ends may be mounted on the head, and may be pivotally mounted on the support block 224 of the head. The frame members may extend downwardly from the head toward the bottom element. The frame members may also be mounted on the support nuts 236, 237, with at least one of the frame members being mounted to each of the support nuts. In some embodiments, the lower ends of the frame members are pivotally mounted on the support nuts. At least two of the frame members may diverge away from each other to mount to respective support nuts. The frame members may include at least two pairs of frame members 240, 241, 242, 243 with each pair of frame members being mounted on one of the support nuts.

The support frame may also include at least one leveling member 248 which is configured to maintain a substantially level or horizontal orientation of the support disk during movement of the head 220 toward and away from the bottom element 212. The leveling member 248 may be mounted on the support block and one of the support nuts to form a four bar linkage with one of the frame members. In some embodiments, a pair 248, 249 of leveling members may extend between the support block and one of the support nuts.

The positioning element 210 may also include a movement actuator 250 which is configured to adjust the distance between the head and the bottom element to thereby raise and lower the vertical level of the top surface of the head when the bottom element is rested upon a support or surface below the head. The movement actuator 250 may be configured to move the frame members with respect to each other to decrease a distance between the head and the bottom element to lower the vertical level of the top surface of the head. The movement actuator 250 may be configured to rotate the actuating rod 238 such that rotation of the movement actuator in a first rotational direction increases a distance between the bottom element and the head, and rotation of the actuating rod in a second (opposite) rotational direction decreases the distance between the bottom element and the head. The movement actuator may comprise a motor with suitable controls for controlling the degree to which the shaft of the motor rotates the rod 238 for control of the raising and lowering of the head.

Figure 52:
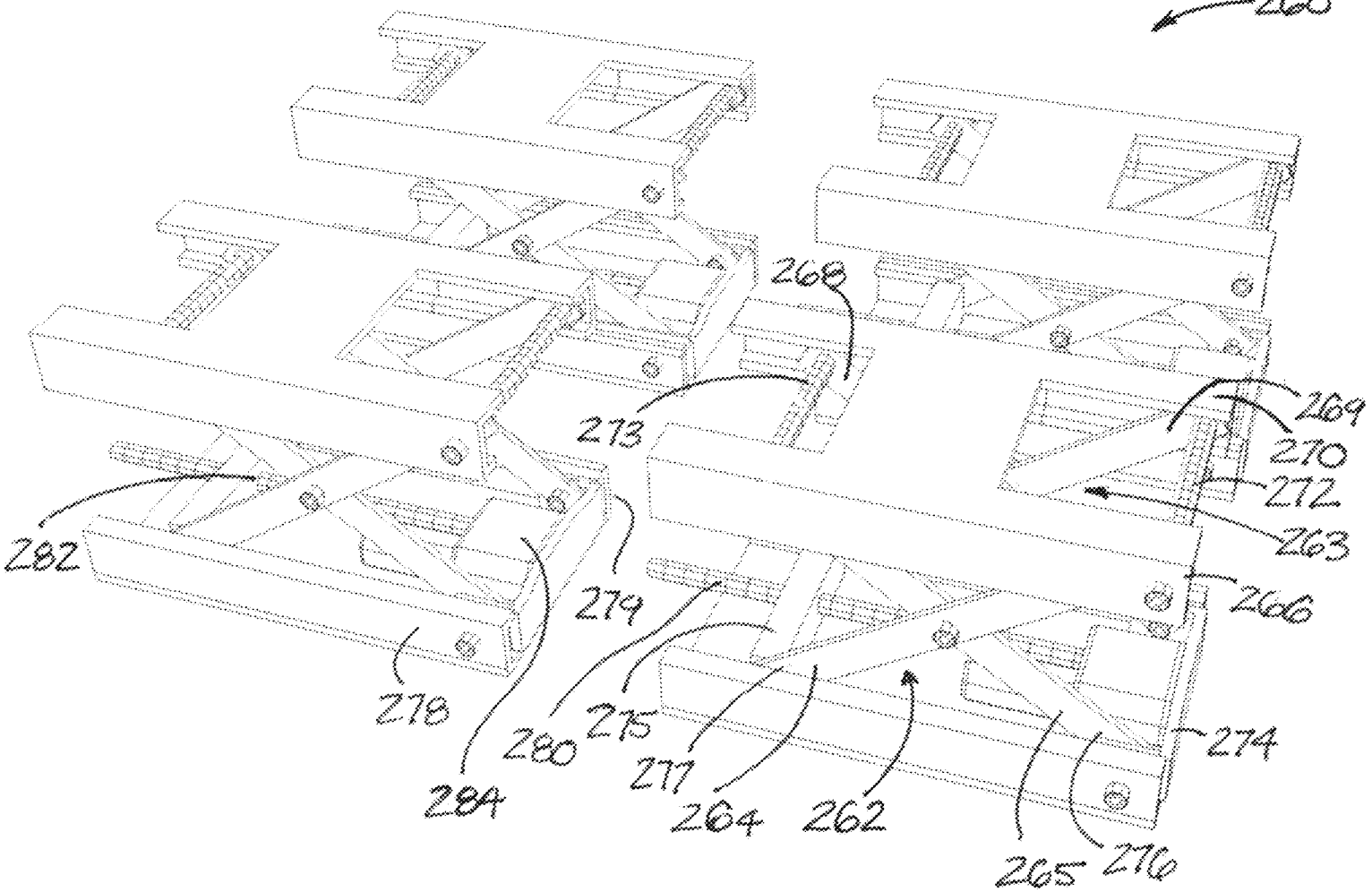
FIG. 52 is a schematic perspective view of another embodiment of the apparatus with a plurality of positioning elements of the covering support assembly shown primarily in a raised condition.
Figure 53:
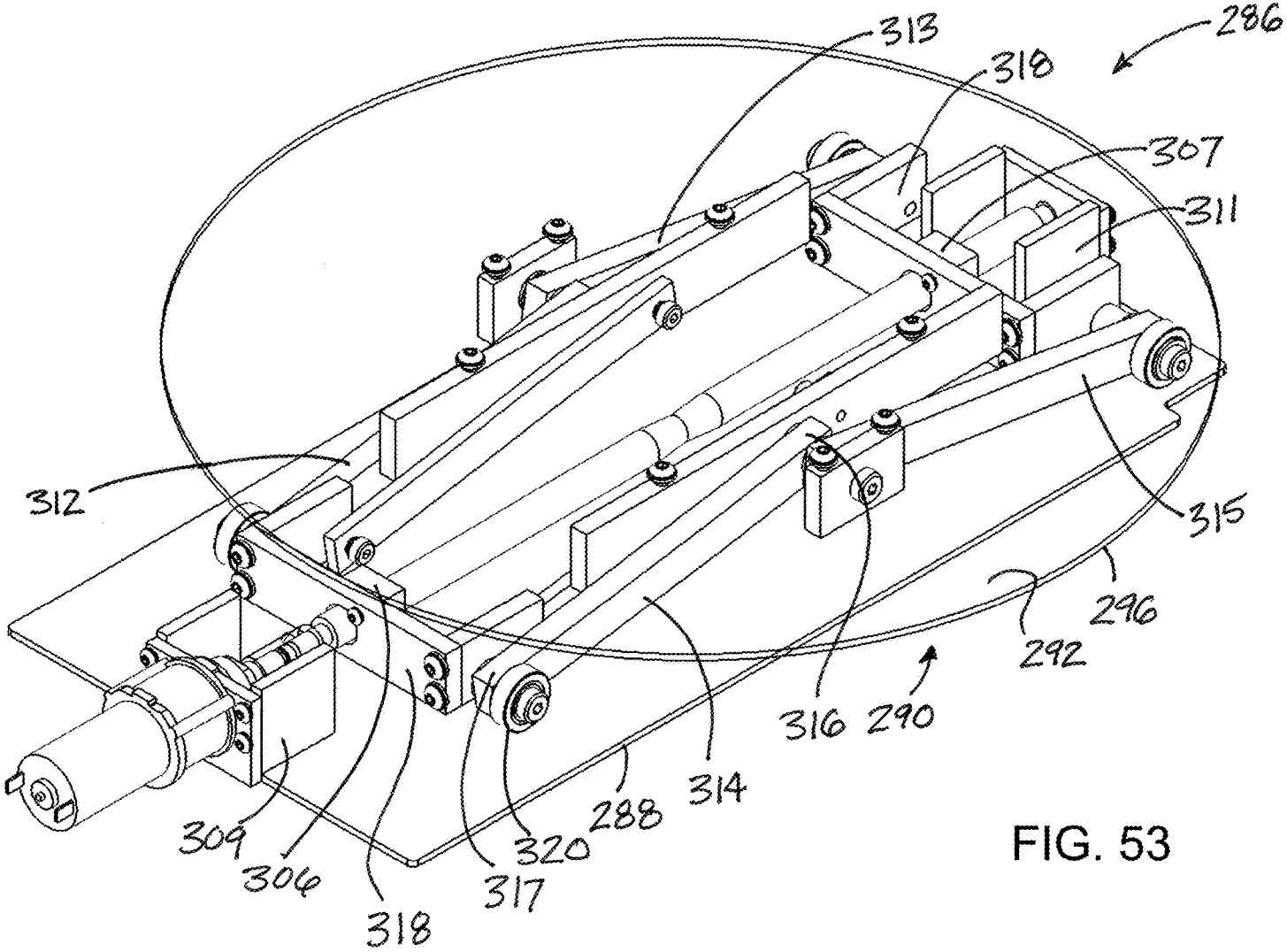
FIG. 53 is a schematic perspective view of yet another embodiment of a positioning element of the covering support assembly shown in a lowered condition.
Figure 54:
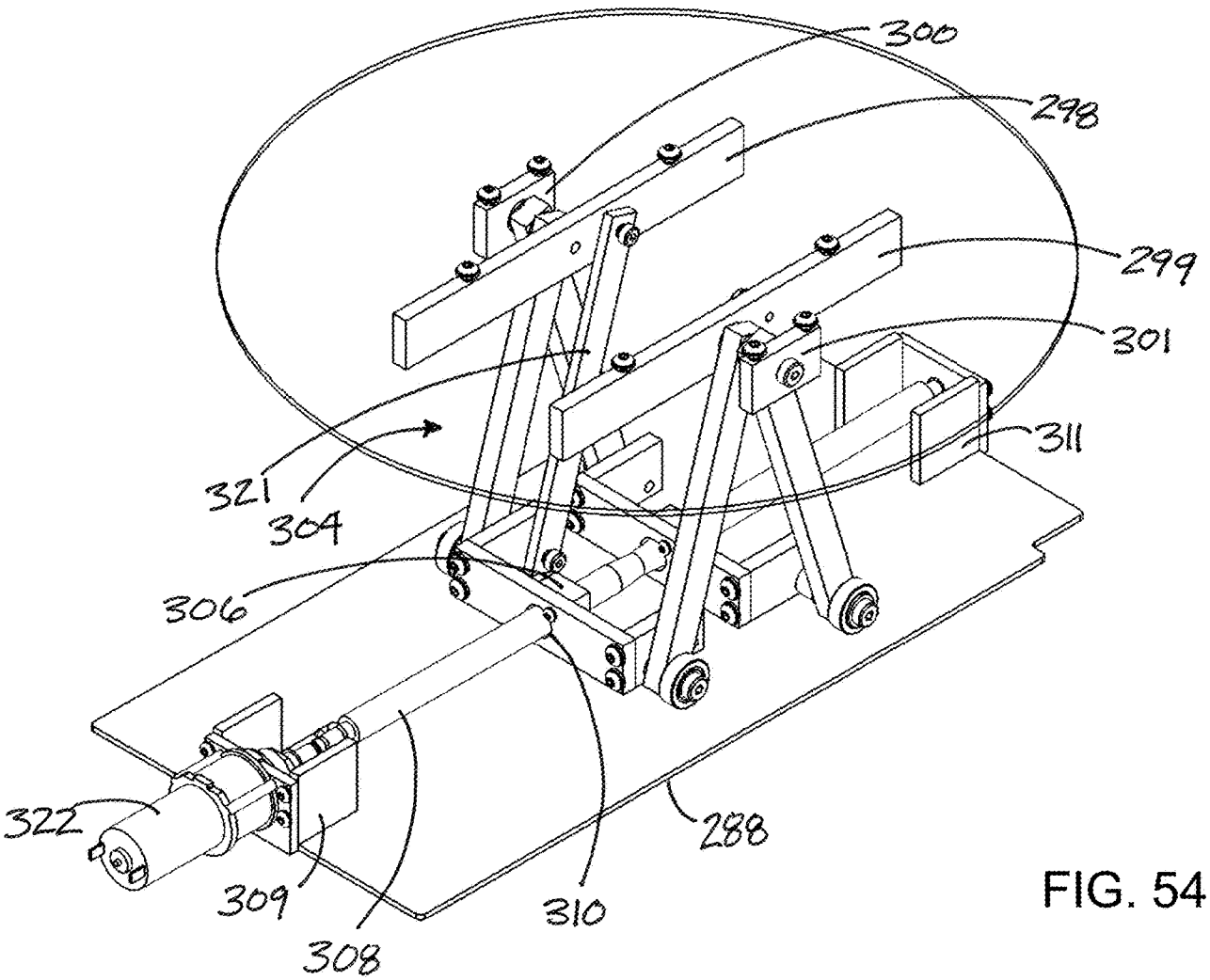
FIG. 54 is a schematic perspective view of the positioning element embodiment of FIG. 53 shown in a raised condition.
Figure 55:
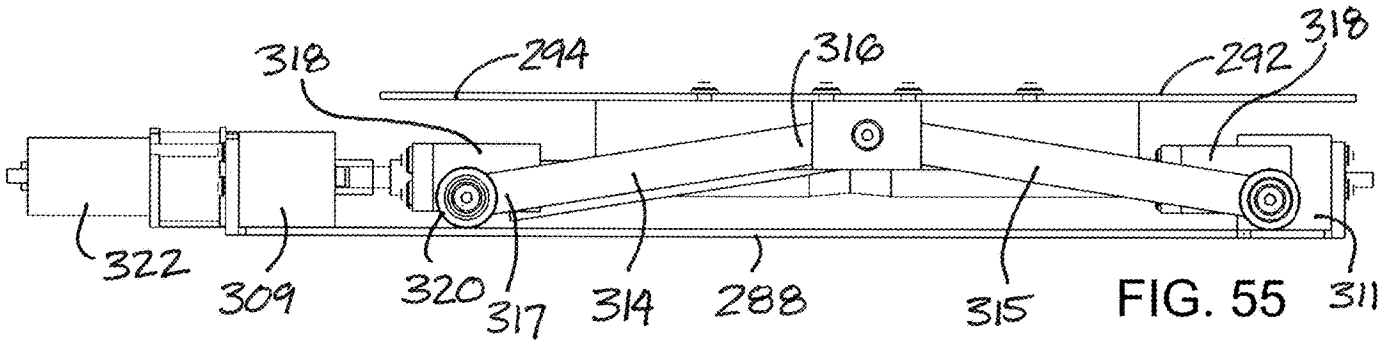
FIG. 55 is a schematic side view of the positioning element embodiment of FIG. 53 shown in a lowered condition.
Figure 56:
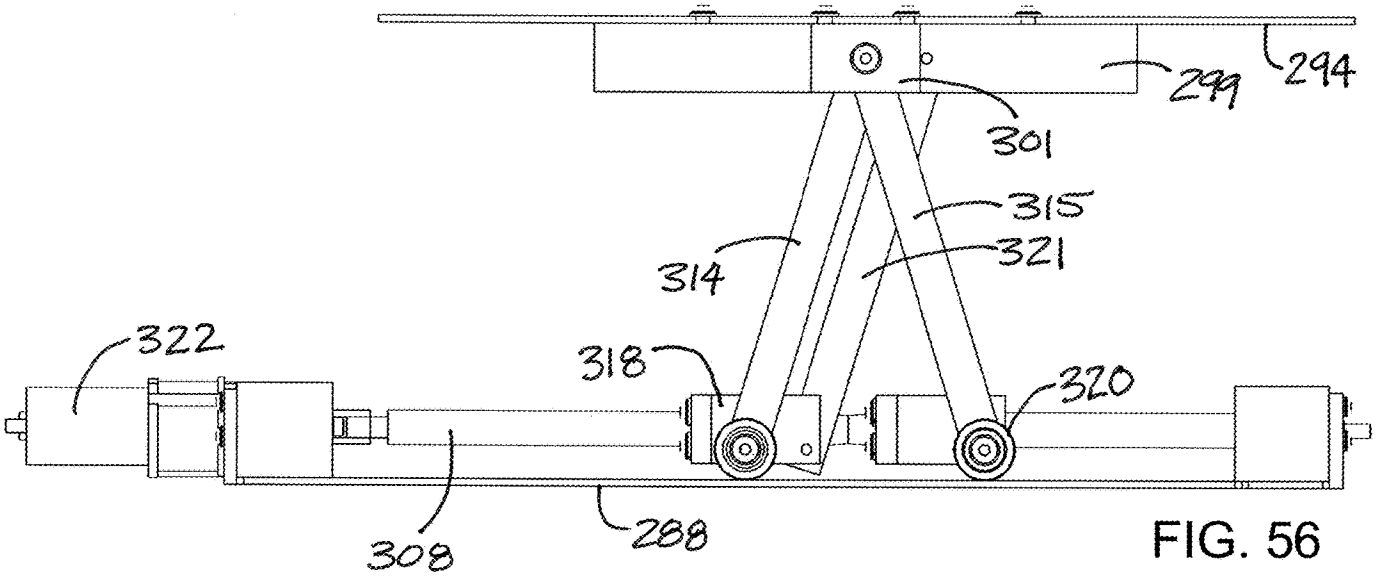
FIG. 56 is a schematic side view of the positioning element embodiment of FIG. 53 shown in a raised condition.
Figure 57:
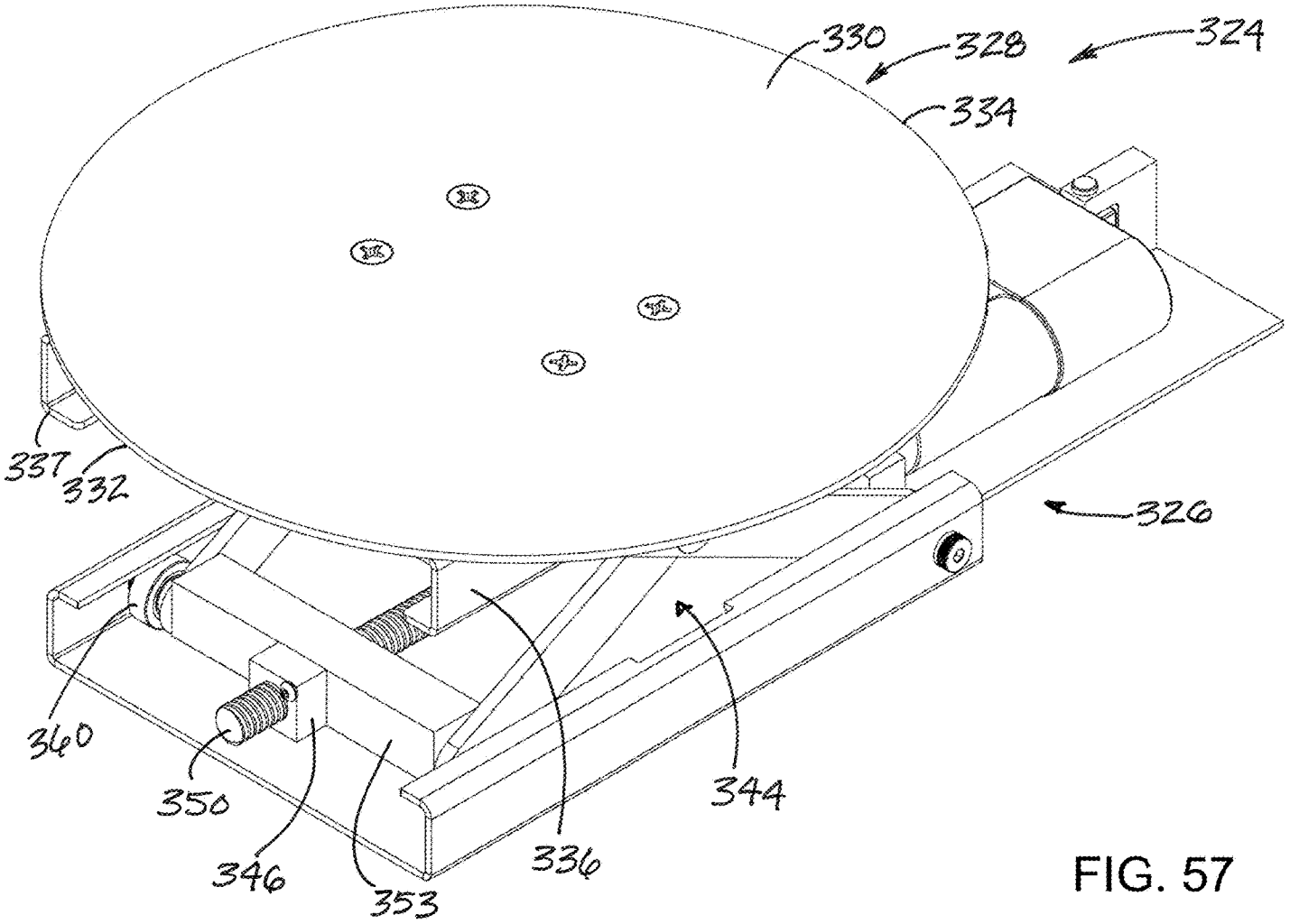
FIG. 57 is a schematic perspective view of another illustrative embodiment of a positioning element.
Figure 58:
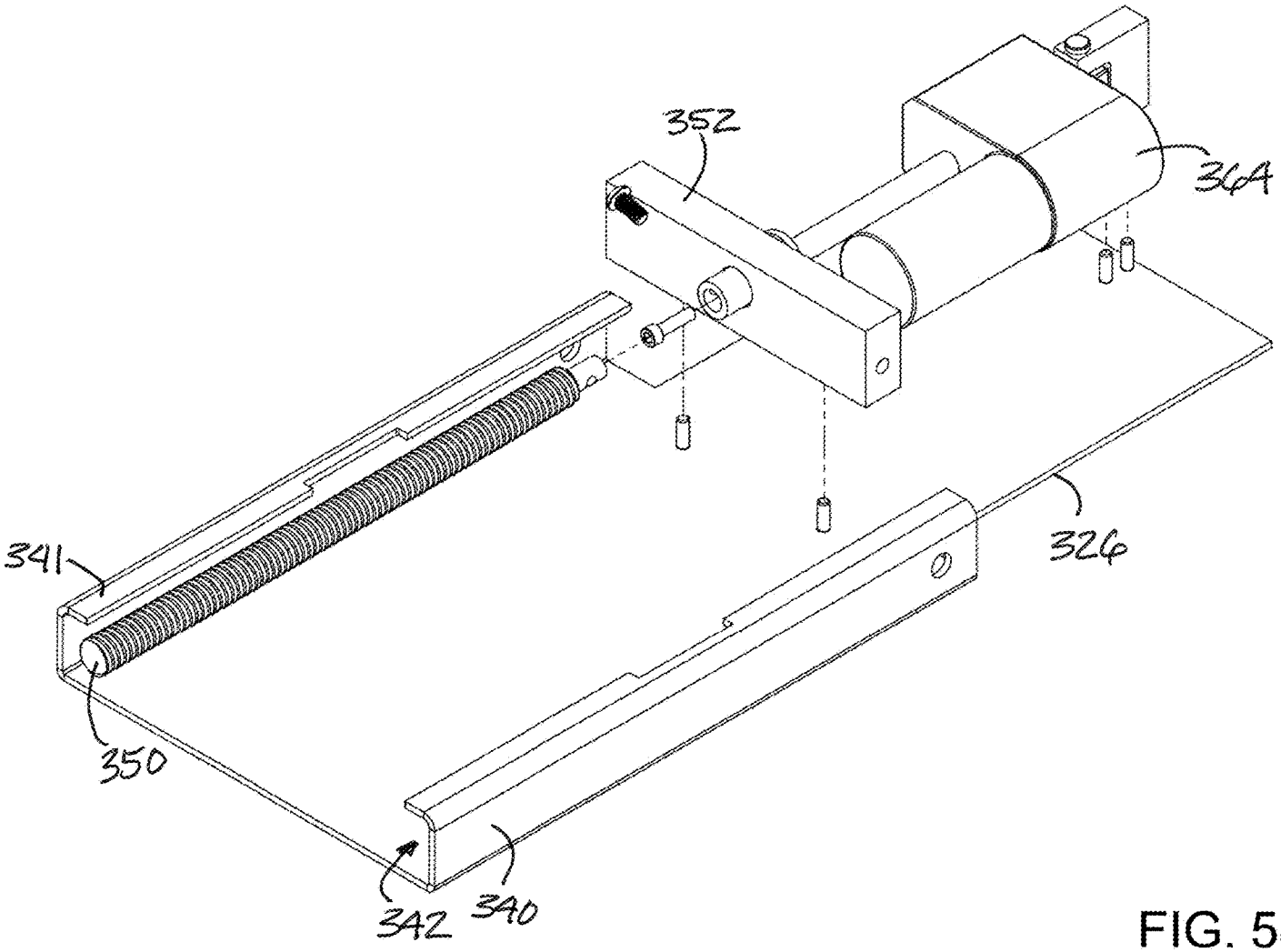
FIG. 58 is a schematic exploded perspective view of selected elements of the embodiment of the positioning element of FIG. 57, particularly showing elements of the bottom element and actuator assembly.
Figure 59:
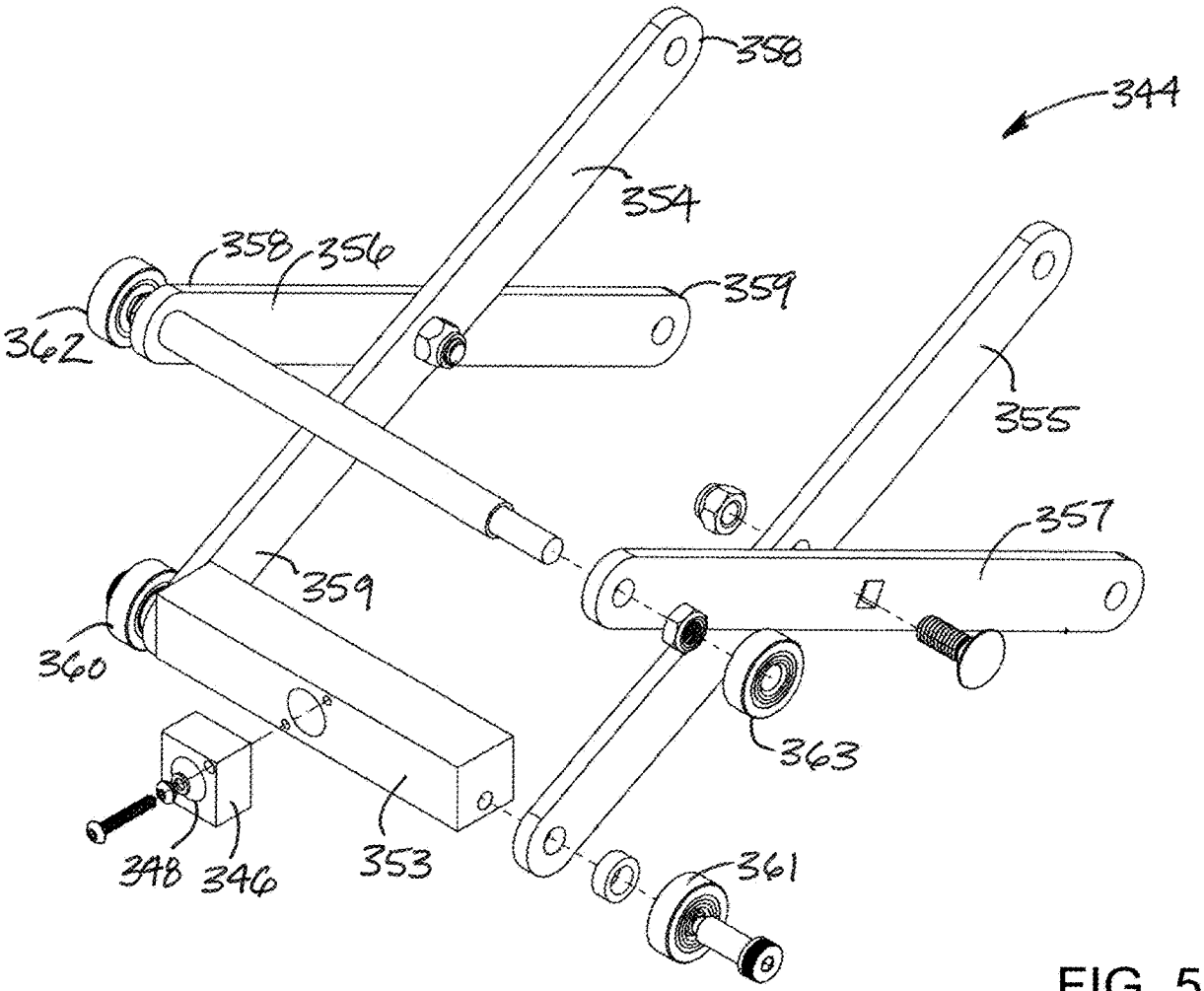
FIG. 59 is a schematic exploded perspective view of selected elements of the embodiment of the positioning element of FIG. 57, showing elements of the support frame.
Figure 60:
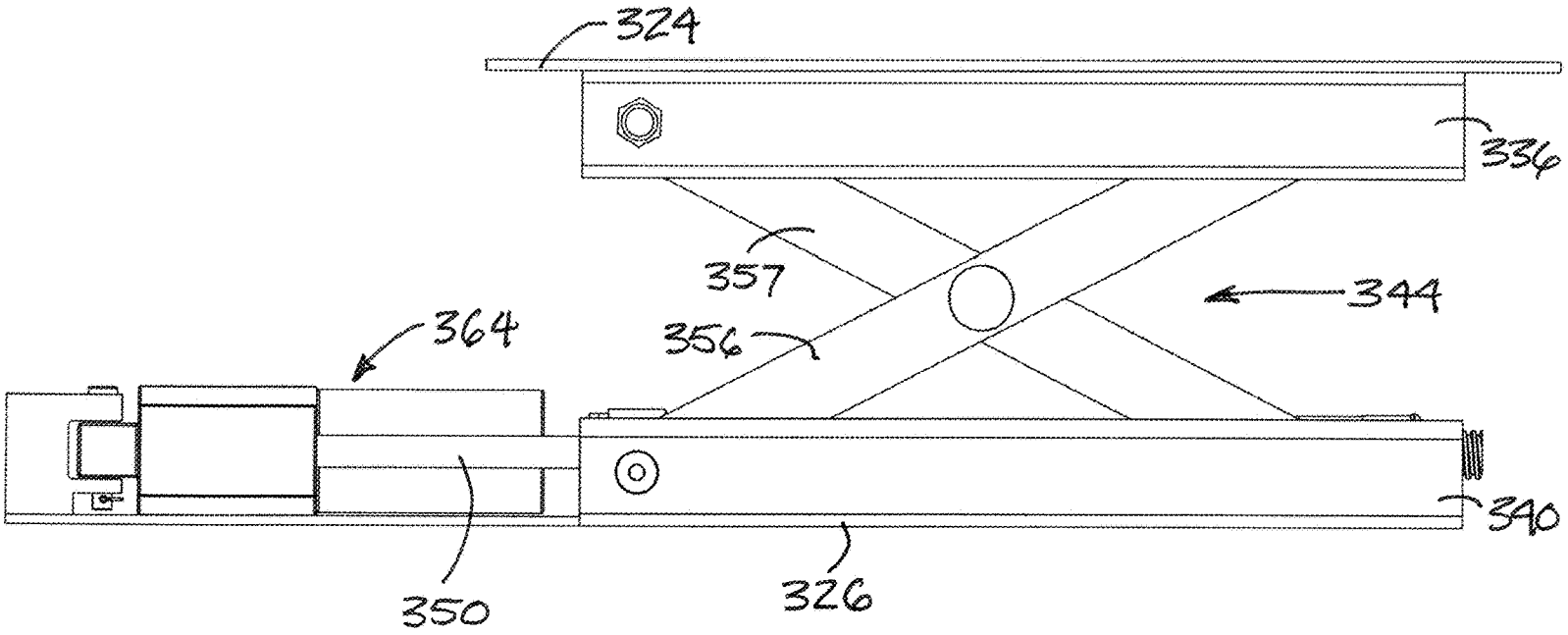
FIG. 60 is a schematic side view of the positioning element of FIG. 57 in a substantially lowered condition.
Figure 61:
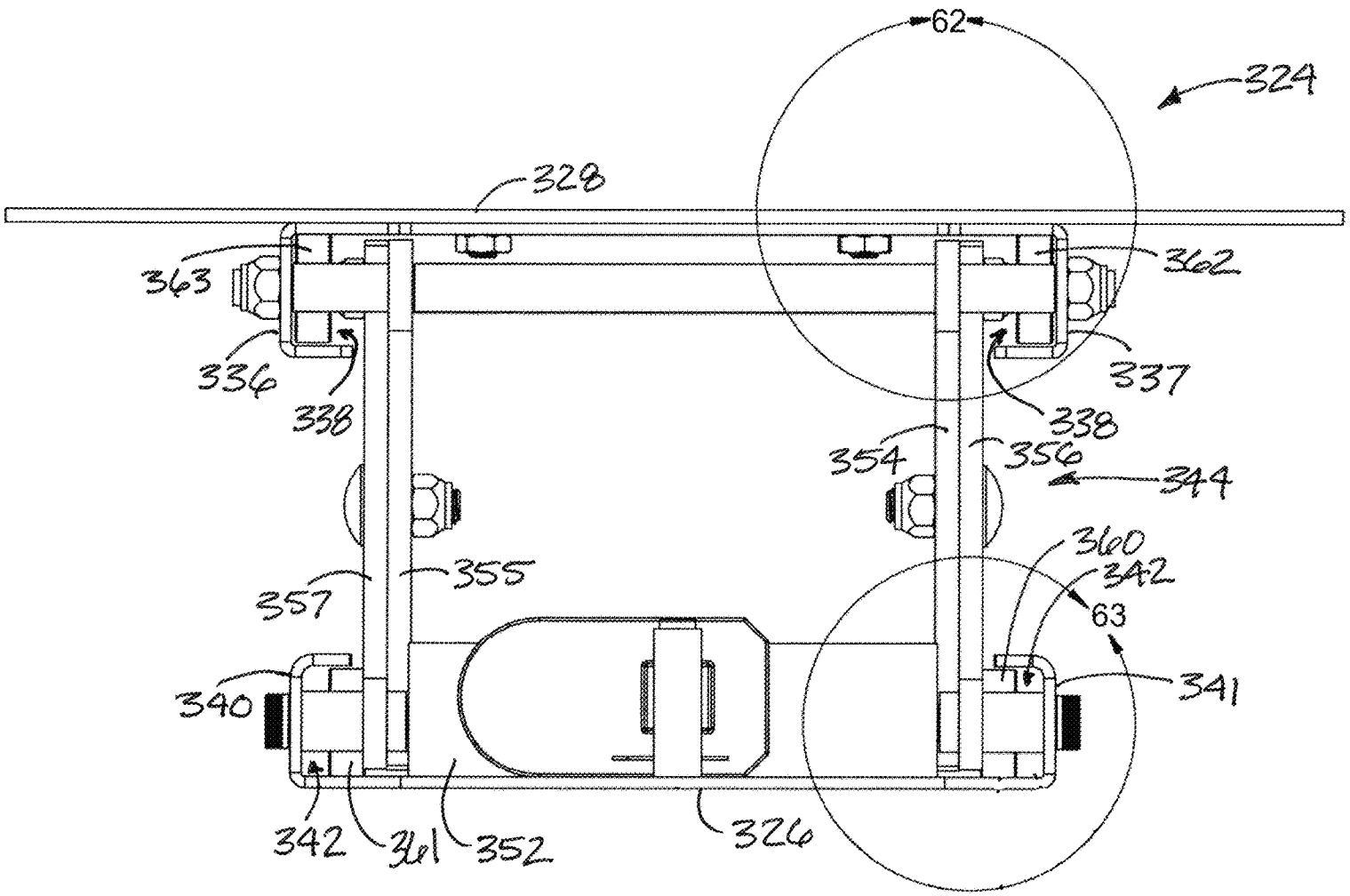
FIG. 61 is a schematic end view of the positioning element of FIG. 57.
Figure 62:
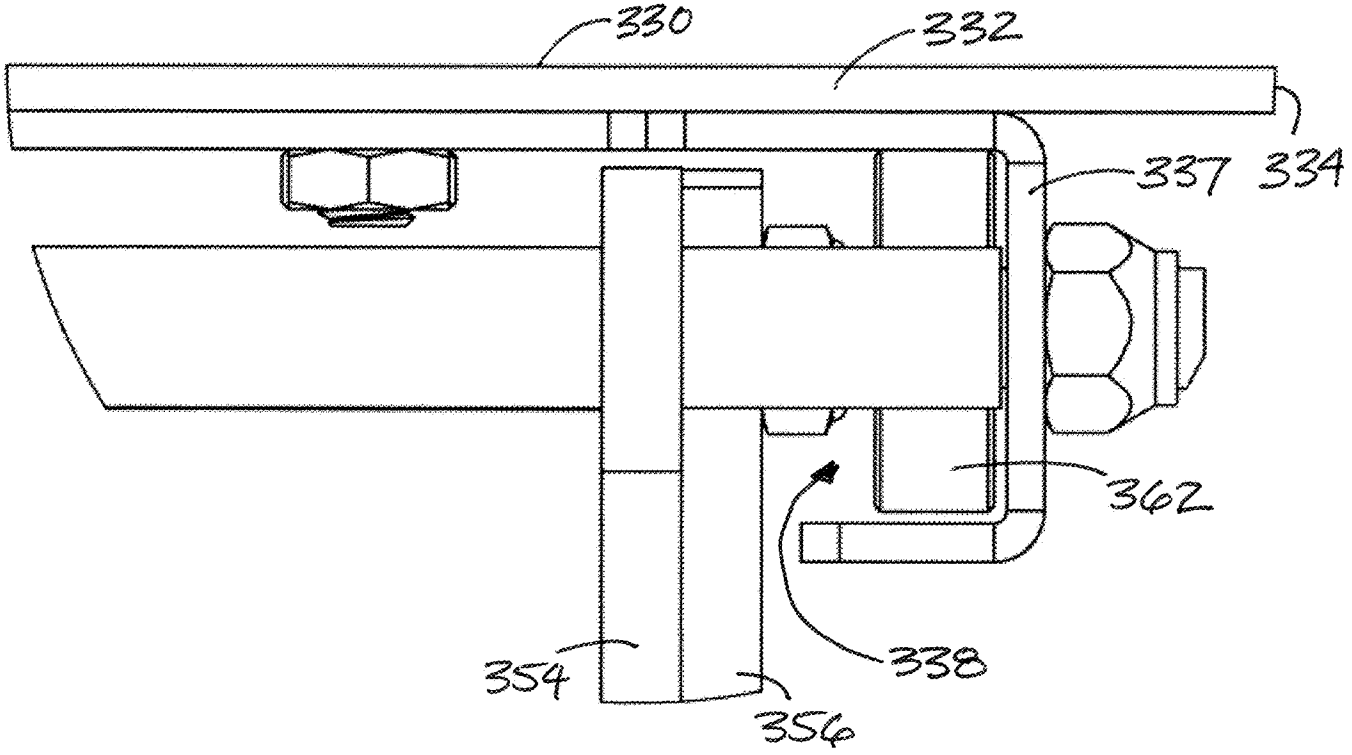
FIG. 62 is a schematic enlarged view of the portion of FIG. 61 encompassed by the circle labeled "62."

In other configurations, such as shown in FIG. 52, the positioning element 260 may include a scissors jack support frame 262, 263 with pairs of crossed frame members 264, 265 positioned on lateral sides of the element 260 and a support plate 266 that is pivotally mounted on the upper ends 268, 269 of the frame members 264, 265 and which may maintain the upper surface 270 of the support plate in a substantially horizontal orientation. Upper cross members 272, 273 may connect the upper ends of the frame members of the laterally-spaced support frames, and the position of one cross member 272 may be fixed on the support plate, while the position of the other upper cross member 273 may be movable and may be slidable with respect to the support plate to compensate for the change of the spacing between the upper ends as the support frame is pivoted. Lower cross members 274, 275 connect the lower ends 276, 277 together, and one lower cross member 274 may be fixed in place and the position of the other lower cross member 275 may be movable and slidable, such as between guide channels 278, 279. A movement member 280 may move the second lower cross member 275 with respect to the first lower cross member 274, and in some embodiments the movement member has a threaded exterior surface which engages a threaded aperture 282 in the second lower cross member such that rotation of the movement member in a first rotational direction moves the cross members 274, 275 away from each other and rotation in a second rotational direction moves the cross members toward each other, lowering and raising (respectively) the support plate 266. An actuator 284 may rotate the movement member in either rotational direction to cause the raising and lowering of the support plate.

Figure 6:
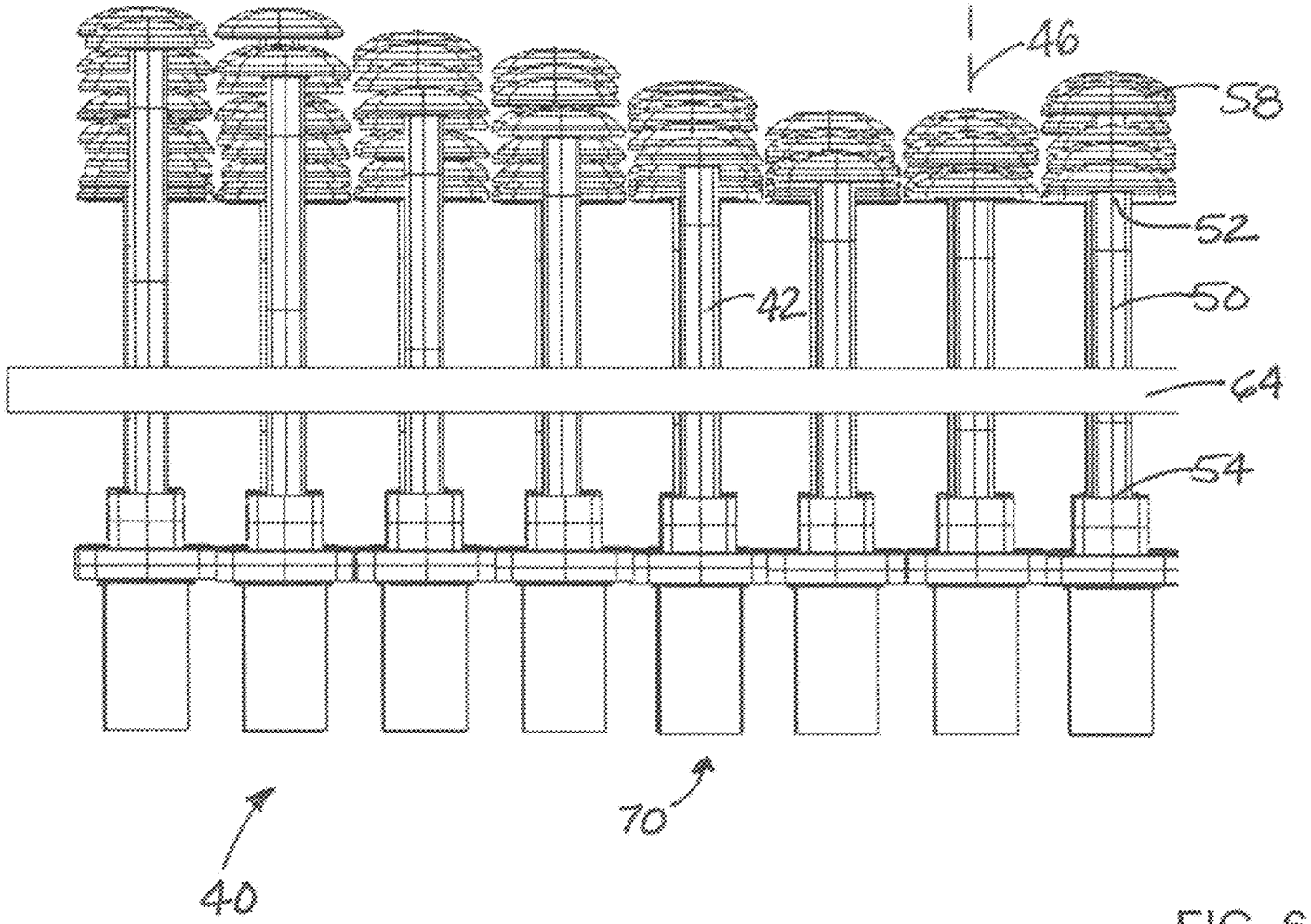
FIG. 6 is a schematic side view of the support assembly with the covering removed to show detail of the support assembly in the raised position.

In still further embodiments, such as those shown in FIGS. 53 through 56, a positioning element 286 with a minimal vertical profile provides a significant degree of vertical adjustment movement between lowered (see FIGS. 53 and 55) and raised (see FIGS. 54 and 6) positions. The positioning element 286 may be arranged in an array of the positioning elements to provide support for a covering. The positioning element 286 may include a bottom element 288, which may comprise a bottom plate or other planar member for resting on a support surface such as a floor. The positioning element 286 may also include a head 290 which is movable with respect to the bottom element 288, such as in a substantially vertical direction with respect to the element 288. The head 290 may have a top surface 292 for resting a portion of the covering thereon. The top surface of the head 290 may be formed by a support disk 294 with a perimeter 296, and in some embodiments the perimeter may be substantially circular in shape although other shapes may be utilized. Illustratively, the head may also include at least one primary support element 298 positioned below the support disk, and optionally may utilize a pair of the primary support elements 298, 299, which may be laterally spaced from each other and may be substantially horizontally oriented. In some embodiments, the head 290 may also include at least one secondary support element 300 which is also positioned below the support disk 294. A pair of the secondary support elements 300, 301 may be utilized in laterally spaced positions below the disk, and optionally the secondary support elements may be positioned on opposite sides of the primary support elements. The primary and secondary support elements may be mounted on the support disk by suitable fasteners or fastening device.

The positioning elements 286 may also include a support frame 304 which is configured to raise and lower the vertical level of the head 290 above the bottom element. The support frame 304 may rest upon the bottom plate of the bottom element, and may extend upwardly from the bottom element 288 such that the support frame is generally positioned between the head and the bottom element. The support frame may comprise at least one support nut 306, and may include a pair of the support nuts with a first support nut 306 and a second support nut 307. At least one, and typically both, of the support nuts 306, 307 have an aperture 310 formed therein. The support frame 304 may also include an actuating rod 308 which may be mounted on at least one, and preferably both, of the support nuts. The actuating rod 304 may pass through the apertures of one or both of the support nuts. The actuating rod may have external threads formed thereon, and those external threads may engage internal threads formed on the aperture of one or both of the nuts such that rotation of the rod translates at least one of the support nuts with respect to the bottom element. In some embodiments, the external threads of the rod engage threads on the apertures of both of the support nuts, and rotation of the rod causes the support nuts to simultaneously move toward each other or away from each other depending upon the direction of rotation of the rod. The support frame 304 may also include at least one actuating rod mount 309 that is mounted on the bottom element and receives a portion of the actuating rod to support the rod. In some embodiments a pair of the actuating rod mounts 309, 311 are located on the bottom element at spaced locations and configured to receive substantially opposite end portions of the rod 308.

The support frame may also include a plurality of frame members, such as the four frame members 312, 313, 314 and 315, which may be connected together in a pivoting arrangement with respect to the head and the bottom element. In some embodiments, a pair of the frame members is pivotally connected together and to the head of the positioning element. Each of the frame members may have an upper end 316 and a lower and 317, with the upper end generally being positioned toward the head and the lower end generally being positioned toward the bottom element. The upper ends may be pivotally mounted on the head by the support elements of the head. More specifically, the upper ends of a pair of the frame members may be pivotally connected together and connected to one of the primary support elements. In some embodiments the upper ends may be positioned between one of the primary support elements and one of the secondary support elements on the head with a common pivot pin extending between the support elements and the upper ends. The frame members may extend downwardly from the head toward the bottom element, and the lower ends of the frame members may be mounted on the support nuts. Typically, the lower end of one of the pair of frame members is mounted on one of the support nuts while the lower end of the other one of the pair of frame members is mounted on the other one of the support nuts. In the illustrative embodiments, the pair of frame members extends downwardly and outwardly from the support elements of the head such that the frame members diverge toward the bottom element, and the degree to which the members diverge governs the height of the head above the bottom element.

The support frame may also include a support link 318 which is configured to link one of the support nuts to the lower end of at least one of the frame members, and in the illustrative embodiments a support link is associated with each of the support nuts and is utilized to link the support nut to the lower ends of two frame members, one from each pair of frame members. The support link 318 may be pivotally mounted on each of the frame members and may be configured to cause the lower ends of the connected frame members and the support nut to move in concert with each other over the bottom element. The support frame may also include a support wheel 320 which is rotatably mounted on the lower end of the frame members. Each support wheel 320 may rest on the upper surface of the bottom element to thereby support the respective frame member on the bottom element. The support wheel may also be connected to one of the support links and the respective support nut associated with the support link. The support wheel 320 may facilitate movement of the support link and the lower ends of the frame members over the bottom element as the rotating actuating rod acts on the support nuts as well as other frame elements. The support frame my also include at least one leveling member 321 which is configured to facilitate a level orientation of the support disk. The leveling member 321 may be mounted on one of the support element s and one of the support links to effectively form a four bar linkage in parallel with one of the frame members also connected to the same support element and support link. Suitably, only one leveling member may be utilized.

A movement actuator 322 may be configured to adjust the distance between the head 290 and the bottom element 288 of the positioning element to thereby raise or lower the vertical level of the top surface of the head. The movement actuator 322 may be connected to one of the ends of the actuating rod 308 such that rotation by the movement actuator causes rotation of the rod. Rotation of the movement actuator 322 and the actuating rod in a first rotational direction may function to move the support nuts, as well as the support links and lower ends of the frame members associated with the respective support nuts, closer together to thereby cause the frame members to lift the head 290. Conversely, rotation of the movement actuator and rod in a second and opposite rotational direction may function to move the support nuts, as well as the support links and lower ends of the frame members associated with the respective support nuts, away from each other to thereby cause the frame members to lower the head.

In still further embodiments, such as shown in FIGS. 57 through 63, a positioning element 324 advantageously has a relatively short profile in a lowered condition while also providing a relatively large differential between the lowered and raised conditions. In some embodiments, the positioning element without the covering has a height of approximately 3 inches or less in the lowered condition, and has a height of approximately 9 inches in the raised condition, providing a range of approximately 6 inches between the extremes of the raised and lowered conditions, which provide a relatively wide range of adjustment while also providing a relatively minimal install profile.

The positioning element 324 may include a bottom element 326 suitable for resting upon a surface and the element 326 may include a bottom plate which may rest upon a surface on which the system is installed. The positioning element 324 may also include a head 328 which is movable with respect to the bottom element 326, and may be movable in a substantially vertical direction with respect to the bottom element. The head 328 may have a top surface 330 which may be configured for resting a portion of the cover thereon or may be configured to form a portion of the upper surface of the apparatus in those implementations lacking a covering. In some embodiments, the head 328 includes a support disk 332 with a perimeter 334 which may be substantially circular in shape or may have other suitable shapes. In some embodiments, the head may have a width, or diameter, which is approximately 12 inches to approximately 18 inches. In an array of the positioning elements, the heads of adjacent positioning elements 324 may be spaced by approximately one quarter inch to approximately one half to three quarter inch, although one quarter inch has been found to be highly suitable.

The head 328 may also include at least one upper track element 336 which is positioned below the support disk, and may include a pair of the upper track elements 336, 337 which may be laterally spaced from each other in substantially horizontal orientations. Each upper track member may form a channel 338, with the elements 336, 337 being oriented such that the channels of the track members are positioned in substantial opposition to each other. Illustratively, the upper track members may be formed of the same piece of the material, such as a sheet metal piece.

The bottom element 326 may additionally include at least one lower track element 340, and may include a pair of lower track elements 340, 341 which are positioned below the upper track element or elements. The lower track elements 340, 341 may be laterally spaced from each other and may be substantially horizontally oriented. The lower track elements 340, 341 may each form a channel 342 and may be oriented such that the channels formed by the elements are positioned in substantial opposition to each other. In some embodiments, each of the lower track elements may be formed by a portion of the bottom plate of the bottom element The positioning element 324 may also include a support frame 344 which is configured to raise and lower the vertical level of the head 328. The support frame 344 may extend upwardly from the bottom element such that support frame is generally positioned between the head 328 and the bottom 326, and may be rested upon an upper surface of the bottom plate. The support frame may extend between the upper track members and the lower track members. In some embodiments, the support frame 344 may comprise at least one support nut 346 which may have an aperture 348 which may be threaded. The support frame may also include an actuating rod 350, and the support nut 346 may be mounted on the actuating rod. The actuating rod 350 may pass through the aperture 348 of the support nut, and the actuating rod may have external threads which engage threads of the aperture 348 such that rotation of the rod translates the support nut along the rod. Rotation of the actuating rod in a first rotational direction moves the support nut in a first direction and rotation of the actuating rod in a second rotational direction moves the nut in a second direction which is opposite of the first direction.

The support frame 344 may also include at least one support link 352 which is positioned adjacent to the bottom element 326 and may receive a portion of the actuating rod 350. In some embodiments, a pair of the support links 352, 353 may be utilized and configured to receive portions of the actuating rod. A first support link 352 may be fixedly mounted on the bottom element against movement relative to the bottom element and a second support link 353 may be movable with respect to the bottom element and may be generally movable over the upper surface of the bottom plate. The support nut 346 may be mounted on the second support link 353 such that rotation of the actuating rod 350 in the first rotational direction moves the second support link in the first direction (with respect to the first support link 352) and rotation of the actuating rod in the second rotational direction moves the second support link in the second direction with respect to the first support link, thus moving the second support link closer to and away from the first support link depending upon the direction of support rod rotation. It will be recognized that the aperture through the second support link may be threaded to engage the threads on the rod directly, and the nut eliminated if desired.

The support frame may also include a plurality of frame members 354, 355, 356, and 357 which may be connected in a pivoting arrangement. Each of the frame members may have an upper end 358 and the lower end 359, with the upper end being positioned toward the head 328 and the lower end being positioned toward the bottom element 326. The frame members 354 and 356 may be pivotally mounted together at a location approximately hallway between the ends, and similarly the frame members 355 and 357 may be pivotally mounted together at a location approximately hallway between the ends. The plurality of frame members may include a first pair 354, 355 of frame members and a second pair 356, 357 of frame members. Each frame member of the first pair may have an upper end being pivotally mounted on one of the upper track elements 336, 337, and may have a lower end pivotally mounted on the second support link 353 so as to be freely movable over the bottom element. The second support link 353 may link the lower ends of the first pair of frame members together. A wheel 360, 361 may be mounted on the lower ends of the frame members of the first pair to facilitate movement of the first ends over the bottom element 326. The wheels 360, 361 may be at least partially positioned in the channels 342 of the lower track elements to help guide movement of the wheels on the bottom element. Each frame member of the second pair of frame members may have a lower end pivotally mounted on the lower track element 340, 341 to pivot with respect to the lower track element. The first support link 352 may link the lower ends of the second pair of frame members together, and may fix the position of the lower ends with respect to the bottom element. The upper ends of the second pair of frame members may be freely movable with respect to the upper track element. A wheel 362, 363 may be mounted on the upper end of each of the frame members of the second pair to facilitate movement of the upper ends of the members along the upper track elements. The wheels 362, 363 may be at least partially positioned in the channels 338 of the upper track elements to help guide movement of the wheels with respect to the head.

A movement actuator 364 may be configured to adjust a distance between the head 328 and the bottom element 326 to raise the vertical level of the top surface of the head with respect to the bottom element, and thus any covering resting upon the head. The movement actuator 364 may be configured to move the frame members with respect to each other to decrease a distance between the head and the bottom member to raise and lower the vertical level of the top surface of the head. The movement actuator 364 may be configured to rotate the actuating rod 350 such that rotation of the movement actuator in a first rotational direction increases a distance between the bottom element and the head, and rotation of the actuating rod in a second rotational direction decreases the distance between the bottom element and the head. Rotation of the actuating rod by the movement actuator in the first rotational direction causes the second support link 353 to move toward the first support link 352 and thus moves the frame members in such as way so as to raise the head with respect to the bottom element. Rotation of the actuating rod by the movement actuator in the second rotational direction causes the second support link to move away from the first support link and thus moves the frame members in such as way so as to lower the head with respect to the bottom element. The movement actuator 364 may be positioned adjacent to the first support link 352 in a location opposite of the second support link 353. A thrust bearing may be mounted on the first support link where the rod 350 passes through the link 352 to help isolate the movement actuator from the axial forces applied to the rod by the links, and in particular the second support link which transfer the weight of the head (and anything supported by the head) to the rod through the support nut.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane; and a movement actuator configured to move at least one of the positioning elements independently of other positioning elements in the array;

wherein at least one of the positioning elements comprises a head, a bottom element and a support frame positioned between the bottom element and the head and supporting the head in a manner permitting movement of the head along an axis extending substantially perpendicular to the reference plane, the support frame including at least a first frame member and a second frame member each having opposite ends and being pivotally connected together in a scissor-like configuration at a cross-over point spaced from opposite ends of the frame members such that convergence of the frame members produces movement of the head in a first direction away from the bottom element and divergence of the frame members produces movement of the head in a second direction towards the bottom element, and wherein the first frame member has an upper end pivotally mounted on the head at a fixed location and a lower end freely movable along the bottom element, and the second frame member has a lower end pivotally mounted on the bottom element at a fixed location and an upper end freely movable on the head.

2. The apparatus of claim 1, wherein the support frame includes a support nut connected to the lower end of the first frame member and an actuating rod engaging a support nut such that rotation of the actuating rod moves the support nut so that the lower end of the first frame member moves toward and away from the lower end of the second frame member and rotation of the actuating rod in a first rotational direction moves the frame members toward convergence and rotation of the actuating rod in a second and opposite rotational direction moves the frame members toward divergence to raise and lower a vertical level of a top surface of the head.

3. The apparatus of claim 2, wherein the support frame includes two spaced pairs of first and second frame members, each pair of frame members being pivoted together at a location spaced between the respective opposite ends of the frame members, the lower ends of both first frame members being movable with respect to the bottom element and the lower ends of both second frame members being pivoted on the bottom element at spaced locations, a first link extending between the lower ends of the first frame members of each pair of frame members and connected to the support nut.

4. The apparatus of claim 3, wherein a support wheel is mounted at each opposite end of the support link such that the support link, the support nut and the two first frame members are supported on the bottom element by the support wheels.

5. The apparatus of claim 2, wherein at least a portion of the actuating rod has a threaded exterior, and the support nut has an aperture with a threaded surface configured to engage the threaded exterior surface of the threaded rod.

6. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane; and a movement actuator configured to move at least one of the positioning elements independently of other positioning elements in the array;

wherein at least one of the positioning elements comprises a head, a bottom element and a support frame positioned between the bottom element and the head and supporting the head in a manner permitting movement of the head along an axis extending substantially perpendicular to the reference plane, the support frame including at least a first frame member and a second frame member each having opposite ends and being pivotally connected together in a scissor-like configuration at a cross-over point spaced from opposite ends of the frame members such that convergence of the frame members produces movement of the head in a first direction away from the bottom element and divergence of the frame members produces movement of the head in a second direction towards the bottom element, and wherein at least one lower support wheel is mounted on a lower end of the first frame member to support the first frame member on the bottom element.

7. The apparatus of claim 6, wherein the bottom element has at least a first lower track element and the at least one lower support wheel is configured to roll over the first lower track element as the first and second frame members pivot with respect to each other.

8. The apparatus of claim 6, further comprising at least one upper support wheel mounted on the upper end of the second frame member for rolling engagement with the head.

9. The apparatus of claim 8, wherein the head has at least a first upper track element and the at least one upper support wheel is configured to roll over the first upper track element as the first and second frame members pivot with respect to each other.

10. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane; and a movement actuator configured to move at least one of the positioning elements independently of other positioning elements in the array;

wherein at least one of the positioning elements comprises a head, a bottom element and a support frame positioned between the bottom element and the head and supporting the head in a manner permitting movement of the head along an axis extending substantially perpendicular to the reference plane, the support frame including at least a first frame member and a second frame member each having opposite ends and being pivotally connected together in a scissor-like configuration at a cross-over point spaced from opposite ends of the frame members such that convergence of the frame members produces movement of the head in a first direction away from the bottom element and divergence of the frame members produces movement of the head in a second direction towards the bottom element;

wherein the support frame comprises first and second spaced pairs of first and second frame members, the first and second frame members of the respective first and second pairs being pivotally connected together in a scissors-like configuration at respective first and second cross-over points spaced between opposite ends of the respective pairs of frame members, and wherein the two first frame members each have an upper end pivotally mounted at a respective fixed position on the head and a lower end having a support wheel rotatably mounted thereon and resting on the bottom element to permit rolling contact between the first pair of frame members of the support frame and the bottom element as the frame members pivot.

11. The apparatus of claim 10, wherein the two second frame members each have a lower end pivotally mounted on the bottom element at a respective fixed position and an upper end having a support wheel rotatably mounted relative to the head to permit rolling movement thereon as the frame members pivot.

12. A green simulation apparatus having a configurable upper surface with a changeable contour, the apparatus comprising:

a covering forming the upper surface;

a covering support assembly configured to support the covering, the support assembly comprising:

a plurality of movable positioning elements having the covering resting thereon, the plurality of positioning elements being positioned in an array extending in a reference plane; and a movement actuator configured to move at least one of the positioning elements independently of other positioning elements in the array;

wherein at least one of the positioning elements comprises a head, a bottom element and a support frame positioned between the bottom element and the head and supporting the head in a manner permitting movement of the head along an axis extending substantially perpendicular to the reference plane, the support frame including at least a first frame member and a second frame member each having opposite ends and being pivotally connected together in a scissor-like configuration at a cross-over point spaced from opposite ends of the frame members such that convergence of the frame members produces movement of the head in a first direction away from the bottom element and divergence of the frame members produces movement of the head in a second direction towards the bottom element;

wherein the support frame comprises first and second spaced pairs of first and second frame members, the first and second frame members of the respective first and second pairs being pivotally connected together in a scissors-like configuration at respective first and second cross-over points spaced between opposite ends of the respective pairs of frame members, and wherein the head of the positioning element includes a pair of upper track elements and the bottom element includes a pair of lower track elements, each of the first frame members having an upper end pivotally mounted on a respective one of the upper track elements at a fixed location and a lower end freely movable along a respective one of the lower track elements, and each of the second frame members having an upper end freely movable along a respective one of the upper track elements and a lower end pivotally mounted on respective one of the lower track elements at a fixed location.

* * * * *